US006475710B2

(12) United States Patent
Kudo et al.

(10) Patent No.: US 6,475,710 B2
(45) Date of Patent: Nov. 5, 2002

(54) PHOTOTHERMOGRAPHIC MATERIAL

(75) Inventors: Shinji Kudo, Hino (JP); Keiko Chigusa, Hino (JP); Hiroshi Kashiwagi, Hino (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/764,828

(22) Filed: Jan. 17, 2001

(65) Prior Publication Data

US 2001/0031430 A1 Oct. 18, 2001

(30) Foreign Application Priority Data

| | | |
|---|---|---|
| Jan. 20, 2000 | (JP) | 2000-011733 |
| Feb. 7, 2000 | (JP) | 2000-028875 |
| Mar. 14, 2000 | (JP) | 2000-070296 |

(51) Int. Cl.[7] ..... G03C 1/498; G03C 1/34

(52) U.S. Cl. ..... 430/350; 430/528; 430/529; 430/607; 430/611; 430/613; 430/614; 430/619

(58) Field of Search ..... 430/619, 350, 430/528, 613, 614, 607, 529, 611

(56) References Cited

U.S. PATENT DOCUMENTS 3,220,839 A * 11/1965 Hez et al.
6,146,822 A * 11/2000 Asanuma et al.
6,165,707 A * 12/2000 Hirano et al.
6,265,146 B1 * 6/2001 Kashiwagi

* cited by examiner

*Primary Examiner*—Thorl Chea
(74) *Attorney, Agent, or Firm*—Bierman, Muserlian and Lucas

(57) ABSTRACT

A photothermographic material is disclosed, comprising a light-sensitive silver halide, an organic silver salt, a reducing agent, a thiuronium salt and a binder, wherein the photothermographic material further contains at least one of compounds represented by formulas such as

21 Claims, No Drawings

PHOTOTHERMOGRAPHIC MATERIAL

FIELD OF THE INVENTION

The present invention relates to thermally developable photothermographic materials and in particular to photothermographic materials having higher contrast and exhibiting enhanced uniformity in image density, specifically, enhanced uniformity in solid image density in the middle tone and an image forming process by the use thereof.

BACKGROUND OF THE INVENTION

There are known a number of photosensitive materials comprising a support having thereon a photosensitive layer, which forms images upon imagewise exposure. Of these, techniques of forming images through thermal development are cited as a system suitable for environmental preservation and yet simplifying the image forming means.

Thermally developable photothermographic materials are disclosed, for example, in D. Morgan and B. Shely, U.S. Pat. Nos. 3,152,904 and 3,457,075, and D. H. Klosterboer, "Thermally Processed Silver Systems" (Imaging Processes and Materials, Neblette, 8th Edition, edited by J. M. Sturge, V. Walworth, and A. Shepp, page 2, 1969), etc. Such photothermographic materials contain a reducible light-insensitive silver source (such as organic silver salts), a catalytically active amount of photocatalyst (such as silver halide) and a reducing agent, which are dispersed in a binder matrix. Such photothermographic materials are stable at ordinary temperature and forms silver upon heating, after exposure, at a relatively high temperature (e.g., 80° C. or higher) through an oxidation-reduction reaction between the reducible silver source (which functions as an oxidizing agent) and the reducing agent. The oxidation-reduction reaction is accelerated by the catalytic action of a latent image produced by exposure. Silver formed through reaction of the reducible silver salt in exposed areas produces a black image, which contrasts with non-exposed areas, leading to image formation.

Such image forming processes are employed for medical diagnostic imaging and graphic art materials. In a medical diagnostic imaging system, it is desired to be efficiently exposed using a laser image setter or a laser imager. However, if a photothermographic material is not relatively highly sensitive and high in contrast, the use of high power laser is dispensable, leading to disadvantages in cost. Of various lasers having different wavelengths, lasers having an oscillating wavelength of 600 nm or more are preferred in terms of cost and power, necessitating spectral sensitizers in the panchromatic or infrared region and supersensitizers. With regard to the infrared-supersensitizer used in a photothermographic system, JP-A No. 2-4241 (hereinafter, the term, JP-A refers to unexamined and published Japanese patent Application) discloses aminopolycarboxylic acid derivatives and JP-A Nos. 4-182639 and 5-341432 disclose an aromatic heterocyclic mercapto-compound and an aromatic heterocyclic disulfide compound. However, there were problems in that supersenstizing effects by the use of the aminopolycarboxylic acid derivatives were relatively low, leading to low sensitivity, and in addition, the use of the aromatic heterocyclic mercapto-compound or aromatic heterocyclic disulfide compound resulted in reduction in sensitivity after storage under high humidity.

There were proposed techniques for enhancing such storage stability, including cyclic carbonyl compounds described in JP-A No. 7-146527 and disulfide compounds having a specific structure described in JP-A Nos. 10-90823, 10-90824, 10-90825, 10-319534 and 11-4489. However, it was proved that such techniques were insufficient in the supersensitization effect and storage performance, and a further improvement is still sought.

European Patent No. 761,196 and JP-A 9-90550 both disclose light-sensitive silver halide grains used in a photothermographic image recording material which occlude metal ions of the 7th to 11th groups of the periodical table or their complex ions and incorporation of hydrazine derivatives into the photothermographic material, thereby leading to desired photographic characteristics such as high contrast. As is known in the photographic art, the use of hydrazine derivatives advantageously leads to enhanced performance such as relatively high contrast or high density, which is suitable for use in printing plate making. However, there were serious disadvantages in practical use in that it also easily produced so-called black spots which were commonly shown as sand-like fogging in unexposed areas, and unevenness in image density caused by slight fluctuations in developing temperature was rather marked.

SUMMARY OF THE INVENTION

Accordingly, it is an object of the present invention to provide a photothermographic material having a relatively high contrast and exhibiting enhanced uniformity in image density, and particularly, uniformity in solid image density in the middle tone region.

It is another object of the invention to provide a photothermographic material exhibiting enhanced sensitivity, high image quality and superior storage stability, a preparation method thereof and an image forming method thereby.

It is another object of the invention to provide a photothermographic material using a red- to infrared-sensitive silver halide emulsion exhibiting little variation in sensitivity caused by variation in exposure conditions.

The above object of the invention can be accomplished by the following constitution:

1. A photothermographic material comprising a light-sensitive silver halide, an organic silver salt, a reducing agent, a thiuronium salt and a binder, wherein the photothermographic material comprises a compound represented by the following formula (1):

formula (1)

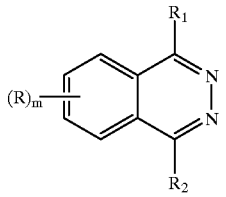

wherein R represents a univalent substituent; m is an integer of 1 to 4 and when m is 2 or more, plural Rs may be the same with or different from each other, or adjacent Rs may combine with each other to form an aliphatic ring, aromatic ring or heterocyclic ring; $R_1$ and $R_2$ each represent a hydrogen atom or a univalent substituent;

2. A photothermographic material comprising a light-sensitive silver halide, an organic silver salt, a reducing agent, a thiuronium salt and a binder, wherein the photothermographic material comprises a compound represented by the following formula (2):

formula (2)

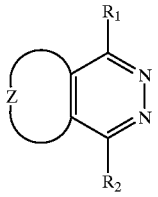

wherein Z represents a non-metallic atom group necessary to form an aromatic heterocyclic 5-membered ring; $R_1$ and $R_2$ each represent a hydrogen atom or a univalent substituent;

3. A photothermographic material comprising a light-sensitive silver halide, an organic silver salt, a reducing agent, a thiuronium salt and a binder, wherein the photothermographic material comprises a compound represented by the following formula (3):

formula (3)

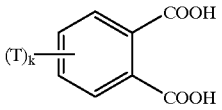

wherein T represents a univalent substituent; k is an integer of 1 to 4 and when k is 2 or more, T may be the same with or different from each other.

DETAILED DESCRIPTION OF THE INVENTION

The photothermographic material according to this invention, comprising a light-sensitive silver halide, an organic silver salt, a reducing agent, a thiuronium salt and a binder, wherein the photothermographic material further comprises a compound represented by the following formula (1), (2) or (3). Thereby is obtained a photothermographic material having a relatively high contrast and exhibiting enhanced uniformity in image density, particularly, uniformity in solid image density in the middle tone region. On the contrary, the use of a compound other than compounds of formulas (1), (2) and (3) tends to lead to occurrence of process non-uniformity, a lowered maximum density (Dmax) and reduced high-contrast.

Formula (1) will be described. R is a univalent substituent and preferred R is an alkyl group having 1 to 8 carbon atoms, more preferably 1 to 5 carbon atoms, such as methyl, ethyl, n-propyl, iso-propyl, n-butyl, iso-butyl, tert-butyl, tert-amyl and n-octyl. Further, m is an integer of 1 to 4 and when m is 2 or more, plural Rs may be the same with or different from each other. When Rs are adjacent, the Rs may combine with each other to form an aliphatic ring, aromatic ring or heterocyclic ring. $R_1$ and $R_2$ each represent a hydrogen atom or a univalent substituent.

Exemplary examples of the compound represented by formula (1) are shown below but the invention is not to be construed as limiting the same.

1-1

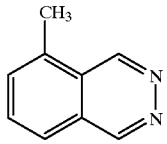

1-2

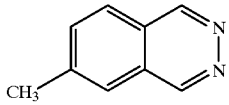

1-3

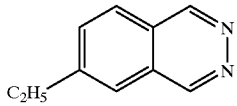

1-4

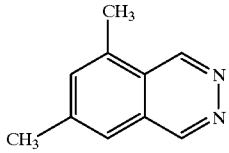

1-5

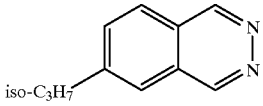

1-6

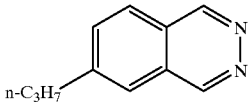

1-7

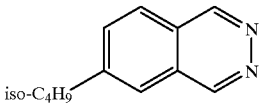

1-8

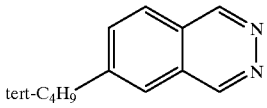

1-9

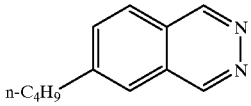

1-10

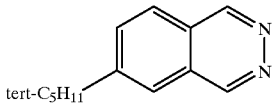

1-11

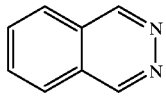

1-12

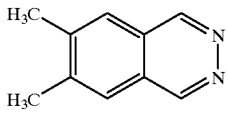

-continued
1-13
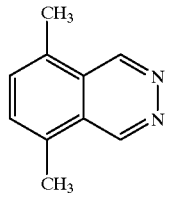
1-14
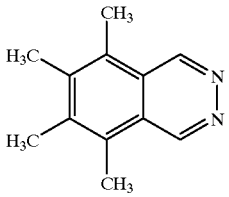
1-15
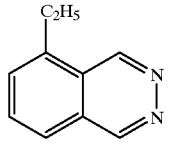
1-16
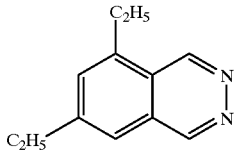
1-17
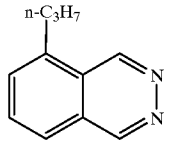
1-18
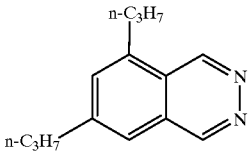
1-19
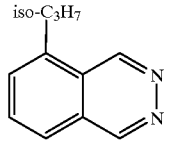
1-20
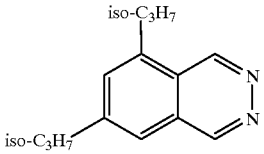
1-21
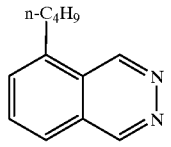
-continued
1-22
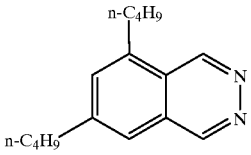
1-23
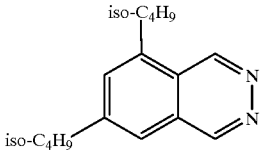
1-24
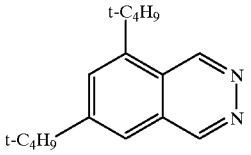
1-25
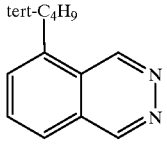
1-26
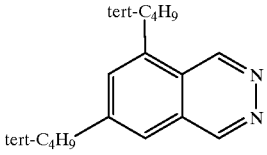
1-27
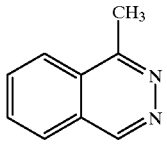
1-28
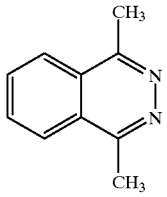
1-29
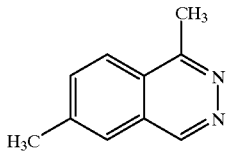
1-30
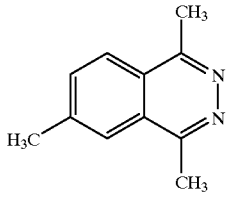

-continued 1-31

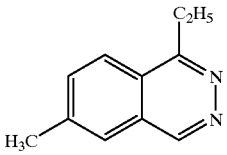

1-32

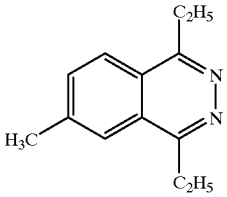

1-33

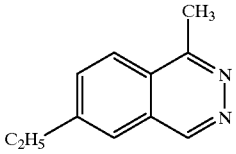

1-34

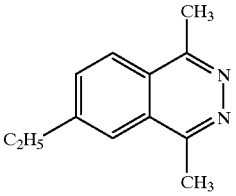

1-35

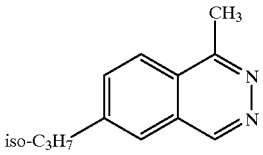

1-36

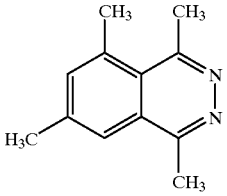

1-37

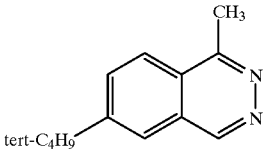

Compounds represented by formula (1) can be synthesized according to known methods, as described in R. G. Elder Field, Heterocyclic Compounds, John Wirey and Sons, Vol. 1 to 9, 1950–1967 and A. R. Katritzky, Comprehensive heterocyclic Chemistry, Pergamon Press, 1984.

The compound represented by formula (2) will be described. Z represents a non-metallic atom group necessary to form an aromatic heterocyclic 5-membered ring. The aromatic heterocyclic 5-membered ring is preferably a thiophene ring and may be substituted. The definition with respect to the expression "aromatic" is described in, for example, J. March, Advanced Organic Chemistry, chapter 2 (John Wirey and Sons, 1988). $R_1$ and $R_2$ each represent a hydrogen atom or a univalent substituent. $R_1$, $R_2$ and a substituent on the sulfur containing aromatic 5-membered ring formed by Z may combine with each other to form a ring. Further, the compound represented by formula (2) may form a salt upon protonation.

The univalent substituents represented by $R_1$ and $R_2$, or the substituent(s) on the aromatic heterocyclic 5-membered ring formed by Z may be the same with or different from each other. Examples of the substituents include an alkyl group (preferably having 1 to 20 carbon atoms, more preferably 1 to 12 carbon atoms and still more preferably 1 to 8 carbon atoms, such as methyl, ethyl, n-propyl, isopropyl, n-butyl, iso-butyl, tert-butyl, n-heptyl, n-octyl, n-decyl, n-hexadecyl, cyclopropyl, cyclopentyl, cyclohexyl), an alkenyl group (preferably having 2 to 20 carbon atoms, more preferably 2 to 12 carbon atoms, and still more preferably 2 to 8 carbon atoms, e.g., vinyl, allyl, 2-butenyl, 3-pentenyl, etc.), an alkynyl (preferably having 2 to 20 carbon atoms, more preferably 2 to 12 carbon atoms, and still more preferably 2 to 8 carbon atoms, e.g., propargyl, 3-pentynyl, etc.), aryl group (preferably having 6 to 30 carbon atoms, more preferably 6 to 20 carbon atoms, and still more preferably 6 to 12 carbon atoms, e.g., phenyl, p-tolyl, o-aminophenyl, naphthyl), an amino group (preferably having 0 to 20 carbon atoms, more preferably 0–10 carbon atoms, and still more preferably 0 to 6 carbon atoms, e.g., amino, methylamino, ethylamino, dimethylamino, diethylamino, dibenzylamino, etc.), an alkoxy group (preferably having 1 to 20 carbon atoms, more preferably 1 to 12 carbon atoms, and still more preferably 1 to 8 carbon atoms, e.g., methoxy, ethoxy, butoxy, etc.), an aryloxy group (preferably having 6 to 20 carbon atoms, more preferably 6 to 16 carbon atoms, and still more preferably 6 to 12 carbon atoms, e.g., phenyloxy, 2-naphthyloxy, etc.), an acyl group (preferably having 1 to 20 carbon atoms, more preferably 1 to 16 carbon atoms, and still more preferably 1 to 12 carbon atoms, e.g., acetyl, formyl, pivaloyl, benzoyl, etc.), an alkoxycarbonyl group (preferably having 2 to 20 carbon atoms, more preferably 2 to 16 carbon atoms, and still more preferably 2 to 12 carbon atoms, e.g., methoxycarbonyl, ethoxycarbonyl, cyclohexyloxycarbonyl, etc.), an aryloxycarbonyl group (preferably having 7 to 20 carbon atoms, more preferably 7 to 16 carbon atoms, and still more preferably 7 to 10 carbon atoms, e.g., phenyloxycarbonyl, etc.), an acyloxy group (preferably having 2 to 20 carbon atoms, more preferably 2 to 16 carbon atoms, and still more preferably 2 to 10 carbon atoms, e.g., acetoxy, benzoyloxy, etc.), an acylamino group (preferably having 2 to 20 carbon atoms, more preferably 2 to 16 carbon atoms, and still more preferably 2 to 10 carbon atoms, e.g., acetylamino, benzoylamino, etc.), an alkoxycarbonylamino group (preferably having 2 to 20 carbon atoms, more preferably 2 to 16 carbon atoms, and still more preferably 2 to 12 carbon atoms, e.g., methoxycarbonylamino, etc.), an aryloxycarbonylamino group (preferably having 7 to 20 carbon atoms, more preferably 7 to 16 carbon atoms, and still more preferably 7 to 12 carbon atoms, e.g., phenyloxycarbonylamino, etc.), a sulfonylamino group (preferably having 1 to 20 carbon atoms, more preferably 1 to 16 carbon atoms, and still more preferably 1 to 12 carbon atoms, e.g., methanesulfonylamino, benzenesulfonylamino, etc.), a sulfamoyl group (preferably having 0 to 20 carbon atoms, more preferably 0 to 16 carbon atoms, and still more preferably 0 to 12 carbon atoms, e.g.,sulfamoyl, methylsulfamoyl, dimethylsulfamoyl, phenylsulfamoyl, etc.), a carbamoyl group (preferably having 1 to 20 carbon atoms, more preferably 1 to 16 carbon atoms, and still more preferably 1 to 12 carbon atoms, e.g., carbamoyl, methylcarbamoyl, ethylcarbamoyl, diethylcarbamoyl, phenylcarbamoyl, etc.), an alkylthio group (preferably having 1 to 20 carbon atoms, more preferably 1 to 16 carbon atoms, and still more preferably 1 to 12 carbon atoms, e.g., methylthio, ethylthio, etc.), arylthio group (preferably having 6–20 carbon atoms, more preferably 6 to 16 carbon atoms and still more preferably 6 to 12 carbon atoms, e.g., phenylthio), a sulfonyl group (preferably having 1 to 20 carbon atom, more preferably 1 to 16 carbon atoms, and still more preferably 1 to 12 carbon atoms, e.g., methyl tosyl) a sulfinyl group (preferably having 1 to 20 carbon atoms, more preferably 1 to 16 carbon atoms, and still more preferably 1 to 12 carbon atoms, e.g., methanesulfinyl, benzenesulfinyl, etc.), an ureido group (preferably having 1 to 20 carbon atoms, more preferably 1 to 16 carbon atoms, and still more preferably 1 to 12 carbon atoms, e.g., ureido, methylureido, phenylureido, etc.), a phosphoric acid amido group (preferably having 1 to 20 carbon atoms, more preferably 1 to 16 carbon atoms, and still more preferably 1 to 12 carbon atoms, e.g., diethylphosphoric acid amido, phenylphosphoric acid amido, etc.), hydroxy group, mercapto group, a halogen atom (e.g., fluorine atom, chlorine atom, bromine atom, iodine atom), cyano group, sulfo group, sulfino group, carboxy group, nitro group, hydroxamic acid group, hydrazino group, and a heterocyclic group (e.g., imidazolyl, pyridyl, thienyl, furyl, piperidyl, morphoryl. etc.). These substituent groups may be further substituted. Further, plural substituent groups may be the same or different.

$R_1$ and $R_2$ are each preferably a hydrogen atom, an alkyl group, an aryl group, an alkoxy group, an aryloxy group, cyano group, a halogen atom, nitro group, or a heterocyclic group, more preferably a hydrogen atom, an alkyl group, an aryl group, an alkoxy group, an aryloxy group, a halogen atom or a heterocyclic group, still more preferably a hydrogen atom, an alkyl group, an aryl group, or an alkoxy group, and most preferably a hydrogen atom or an alkyl group. The substituent on the aromatic heterocyclic 5-membered ring formed through Z is preferably a hydrogen atom, an alkyl group, an aryl group, an alkoxy group, an aryloxy group, cyano group, a halogen atom, nitro group, a carboxy group, an amino group or an acyl group, more preferably a hydrogen atom, an alkyl group, an aryl group, an alkoxy group, an aryloxy group, or a halogen atom, still more preferably a hydrogen atom, an alkyl group, an aryl group or an alkoxy group, and most preferably a hydrogen atom, an alkyl group or an aryl group.

Exemplary examples of the compound represented by formula (2) are shown below but are by no means limited to these.

2-1

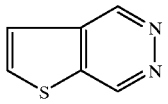

2-2

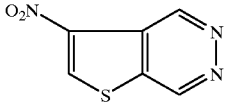

-continued 2-3

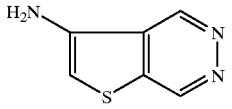

2-4

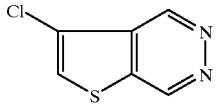

2-5

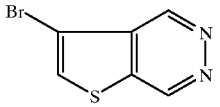

2-6

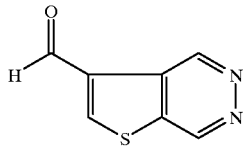

2-7

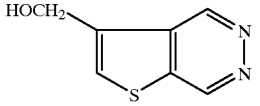

2-8

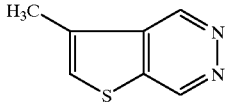

2-9

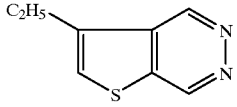

2-10

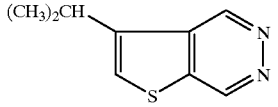

2-11

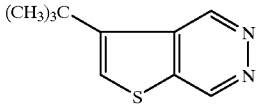

2-12

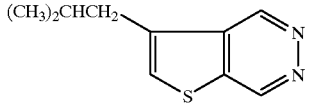

2-13

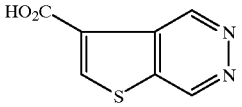

2-14

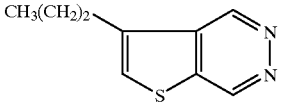

-continued
2-15
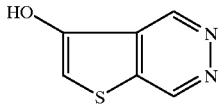
2-16
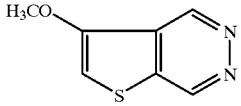
2-17
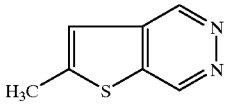
2-18
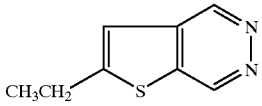
2-19
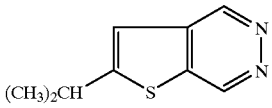
2-20
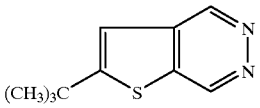
2-21
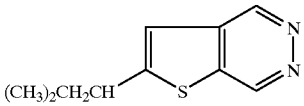
2-22
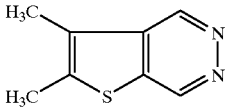
2-23
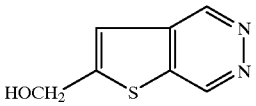
2-24
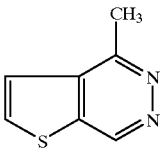
2-25
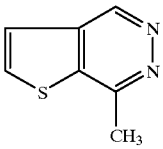
-continued
2-26
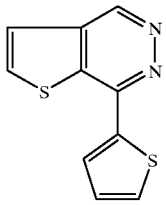
2-27
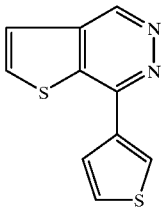
2-28
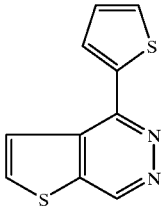
2-29
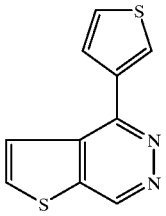
2-30
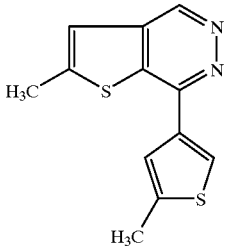
2-31
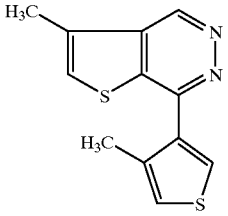
2-32
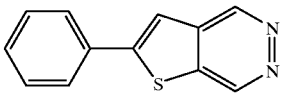

-continued 2-33

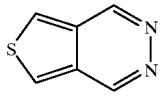

2-34

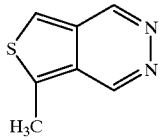

2-35

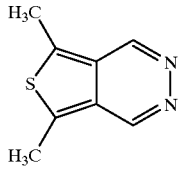

2-36

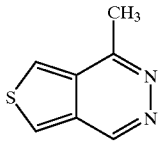

2-37

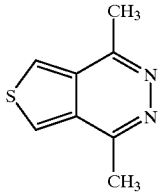

2-38

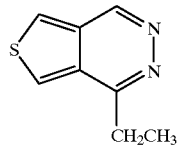

2-39

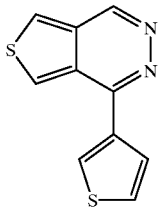

2-40

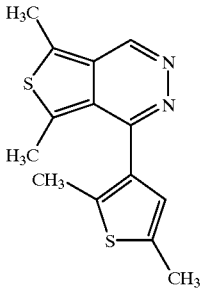

-continued 2-41

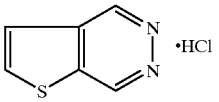

Compounds represented by formula (2) can be synthesized according to known methods, for example, described in Tetrahedron Letters, 1981, Vol. 22, page 345–348; J. heterocyc. Chem, 1980, Vol. 17, page 1019–1023; Bull. Soc. Chim. Fr., 1967, page 4220–4235; Bull. Soc. Chim. Fr., 1967, page 2495–2507; and French Patent 1453897.

Next, the compound represented by formula (3) will be described. T represents a univalent substituent, k is an integer of 1 to 4, and when k is 2 or more, plural Ts may be the same with or different from each other.

Examples of the substituent group represented by T include an alkyl group (preferably having 1 to 20 carbon atoms, more preferably 1 to 12 carbon atoms and still more preferably 1 to 8 carbon atoms, such as methyl, ethyl, n-propyl, isopropyl, n-butyl, tert-butyl, iso-butyl, n-heptyl, n-octyl, n-decyl, n-hexadecyl, cyclopropyl, cyclopentyl, cyclohexyl), an alkenyl group (preferably having 2 to 20 carbon atoms, more preferably 2 to 12 carbon atoms, and still more preferably 2 to 8 carbon atoms, e.g., vinyl, allyl, 2-butenyl, 3-pentenyl, etc.), an alkynyl (preferably having 2 to 20 carbon atoms, more preferably 2 to 12 carbon atoms, and still more preferably 2 to 8 carbon atoms, e.g., propargyl, 3-pentynyl, etc.), aryl group (preferably having 6 to 30 carbon atoms, more preferably 6 to 20 carbon atoms, and still more preferably 6 to 12 carbon atoms, e.g., phenyl, p-tolyl, naphthyl), an amino group (preferably having 0 to 20 carbon atoms, more preferably 0 10 carbon atoms, and still more preferably 0 to 6 carbon atoms, e.g., amino, methylamino, dimethylamino, diethylamino, dibenzylamino, etc.), an alkoxy group (preferably having 1 to 20 carbon atoms, more preferably 1 to 12 carbon atoms, and still more preferably 1 to 8 carbon atoms, e.g., methoxy, ethoxy, butoxy, etc.), an aryloxy group (preferably having 6 to 20 carbon atoms, more preferably 6 to 16 carbon atoms, and still more preferably 6 to 12 carbon atoms, e.g., phenyloxy, 2-naphthyloxy, etc.), an acyl group (preferably having 1 to 20 carbon atoms, more preferably 1 to 16 carbon atoms, and still more preferably 1 to 12 carbon atoms, e.g., acetyl, formyl, pivaloyl, benzoyl, etc.), an alkoxycarbonyl group (preferably having 2 to 20 carbon atoms, more preferably 2 to 16 carbon atoms, and still more preferably 2 to 12 carbon atoms, e.g., methoxycarbonyl, ethoxycarbonyl, tetradecyoxycarbonyl, etc.), an aryloxycarbonyl group (preferably having 7 to 20 carbon atoms, more preferably 7 to 16 carbon atoms, and still more preferably 7 to 10 carbon atoms, e.g., phenyloxycarbonyl, etc.), an acyloxy group (preferably having 1 to 20 carbon atoms, more preferably 1 to 16 carbon atoms, and still more preferably 1 to 10 carbon atoms, e.g., acetoxy, benzoyloxy, etc.), an acylamino group (preferably having 1 to 20 carbon atoms, more preferably 1 to 16 carbon atoms, and still more preferably 1 to 10 carbon atoms, e.g., acetylamino, benzoylamino, propionylamino, etc.), an alkoxycarbonylamino group (preferably having 2 to 20 carbon atoms, more preferably 2 to 16 carbon atoms, and still more preferably 2 to 12 carbon atoms, e.g., methoxycarbonylamino, etc.), an aryloxycarbonylamino group (preferably having 7 to 20 carbon atoms, more preferably 7 to 16 carbon atoms, and still more preferably 7 to 12 carbon atoms, e.g., phenyloxycarbonylamino, etc.), a sulfonylamino group (preferably having 1 to 20 carbon atoms, more preferably 1 to 16 carbon atoms, and still more preferably 1 to 12 carbon atoms, e.g., methanesulfonylamino, octanesulfonylamino, benzenesulfonylamino, etc.), a sulfamoyl group (preferably having 0 to 20 carbon atoms, more preferably 0 to 16 carbon atoms, and still more preferably 0 to 12 carbon atoms, e.g.,sulfamoyl, methylsulfamoyl, dimethylsulfamoyl, phenylsulfamoyl, etc.), a carbamoyl group (preferably having 1 to 20 carbon atoms, more preferably 1 to 16 carbon atoms, and still more preferably 1 to 12 carbon atoms, e.g., carbamoyl, methylcarbamoyl, diethylcarbamoyl, phenylcarbamoyl, etc.), an alkylthio group (preferably having 1 to 20 carbon atoms, more preferably 1 to 16 carbon atoms, and still more preferably 1 to 12 carbon atoms, e.g., methylthio, ethylthio, etc.), arylthio group (preferably having 6–20 carbon atoms, more preferably 6 to 16 carbon atoms and still more preferably 6 to 12 carbon atoms, e.g., phenylthio), a sulfonyl group (preferably having 1 to 20 carbon atom, more preferably 1 to 16 carbon atoms, and still more preferably 1 to 12 carbon atoms, e.g., methyltosyl) a sulfinyl group (preferably having 1 to 20 carbon atoms, more preferably 1 to 16 carbon atoms, and still more preferably 1 to 12 carbon atoms, e.g., methanesulfinyl, benzenesulfinyl, etc.), an ureido group (preferably having 1 to 20 carbon atoms, more preferably 1 to 16 carbon atoms, and still more preferably 1 to 12 carbon atoms, e.g., ureido, methylureido, phenylureido, etc.), a phosphoric acid amido group (preferably having 1 to 20 carbon atoms, more preferably 1 to 16 carbon atoms, and still more preferably 1 to 12 carbon atoms, e.g., diethylphosphoric acid amido, phenylphosphoric acid amido, etc.), hydroxy group, carboxy group, sulfo group, sulfino group (sulfinic acid group) mercapto group, a halogen atom (e.g., fluorine atom, chlorine atom, bromine atom, iodine atom), cyano group, nitro group, hydroxamic acid group, hydrazino group, and a heterocyclic group (e.g., imidazolyl, pyridyl, thienyl, furyl, piperidyl, morphoryl. etc.). Of these, a group capable of forming a salt with an alkali metal may form such a salt. These substituent groups may further be substituted. In cases of two or more substituents being contained, the substituents may be the same with or different from each other.

The substituent group represented by T is preferably an alkyl group, alkenyl group, an aryl group, an aryloxy group, an acyl group, an acyloxy group, an alkoxycarbonyl group, an acylamino group, an alkoxycarbonylamino group, an aryloxycarbonylamino group, a sulfonylamino group, a sulfamoyl group, a carbamoyl group, a ureido group, a phosphoric acid amino group, hydro group, carboxy group, sulfo group, sulfino group, sulfonyl group, a halogen atom, cyano group, nitro group, or a heterocyclic group; and more preferably an alkyl group, an aryl group, an alkoxy group, an aryloxy group, an acyl group, an acylamino group, an alkoxycarbonylamino group, an aryloxycarbonylamino group, a sulfonylamino group, a sulfamoyl group, a carbamoyl group, hydroxy group, sulfonyl group, a halogen atom, cyano group, or nitro group; still more preferably an alkyl group, an aryl group, an alkoxy group, an aryloxy group, an acyl group, an acylamino group, a sulfonylamino group, a sulfamoyl group, a carbamoyl group, hydroxy group, a sulfonyl group, a halogen atom, cyano group, or nitro group; and specifically more preferably an alkyl group, an aryl group, an alkoxy group or a halogen atom.

Exemplary examples of the compound represented by formula (3) are shown below but are by no means limited to these.

3-1

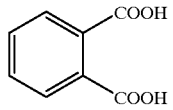

3-2

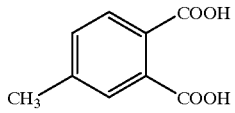

3-3

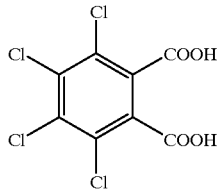

3-4

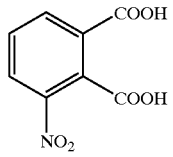

3-5

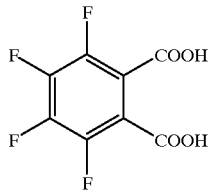

3-6

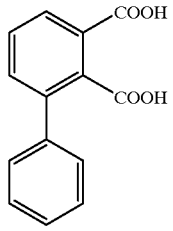

3-7

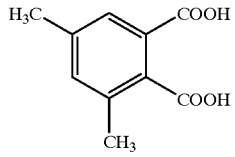

3-8

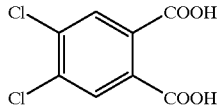

Compounds represented by formula (3) can be synthesized in accordance with known methods, for example, described in "Shin-Jikkenkagaku Koza" (Series of Experimental Chemistry) Vol. 14-III, chapter 5-1 (published by Maruzen); Organic Functional Group Preparations, chapter I-9 (Academic Press, New York and London). Further, some are commercially available.

The compound represented by formula (1), (2) or (3) can be incorporated into any one of a light-sensitive layer as an image forming layer and a light-insensitive layer such as a protective layer which are provided on the image forming layer side of a photothermographic material. The compound represented by formula (1), (2) or (3) is incorporated, depending on its purpose but preferably in an amount of $10^{-4}$ to 1 mol/mol Ag, more preferably $10^{-3}$ to 0.3 mol/mol Ag, and still more preferably $10^{-3}$ to 0.1 mol/mol Ag. The compound represented by formula (1), (2) or (3) may be incorporated alone or in combination. Specifically, it is preferred to use the compound of formula (1) or (2) in combination with the compound of formula (3).

The compound represented by formula (1), (2) or (3) can be incorporated in any form such as solution, powder, or a solid particle dispersion. Solid particle dispersion is achieved using known pulverizing means (e.g., ball mill, vibration ball mill, side mill, colloid mill, jet mill, roller mill, etc.). A dispersing aid may be employed in combination in the solid particle dispersion.

Spectral sensitization techniques of infrared-sensitive silver halide photographic materials are disclosed in U.S. Pat. Nos. 3,582,344 and 5,013,642; European patent No. 420,012; Russian patent Nos. 1,549,027, 1,596,961 and 1,780,427; JP-B No. 3-10391 and 6-52387 (hereinafter, the term JP-B refers to published Japanese Patent); JP-A Nos. 3-138638, 3-138642, 3-235940, 3-243944, 3-244667, 4-311948, 4-312577, 5-72660, 5-45773, 5-45774, 5-45775, 5-72660, 5-72661, 5-265120, 5-341432, 6-194781, 6-222491, 6-222492, 6-250323, 6-301141, 6-317868, 6-332103, 6-324425, 7-175158, 7-306512, 8-194282, 8-201959, 9-281638, 9-281639, 9-288326, 9-88327, 9-292672, 9-292673; and JP-B (Tokuhyo-hei) 9-5100122. Antihalation techniques are also disclosed in JP-A no. 7-13295 and U.S. Pat. No. 5,380,635.

In photographic materials to be exposed to infrared rays of 700 nm or more, visible absorption of a sensitizing dye or an anti-halation dye can be greatly reduced and a photographic material substantially having no color can be advantageously prepared. However, dyes having an absorption maximum in the infrared region and sensitizing thereto, in general, have a long conjugated chain, which is easily affected by environments. Thus, a spacing between the lowest unoccupied level and the highest occupied level of the dye is small and the lowest unoccupied level is close to the conduction band of silver halide, resulting in problems such that fogging easily occur, sensitivity is reduced after storage over a long period of time, or photographic material are easily affected by temperature or humidity at the time of exposure, leading to variation in sensitivity. Such problems with respect to sensitivity, storage stability and variation in photographic performance are remarkable not only in wet-processable photographic materials but also in photothermographic materials. To overcome such problems regarding infrared sensitization, there have been proposed various techniques for supersensitization. Supersensitizers used for infrared sensitization are described, for example, in European Patent Nos. 176,483, 203,698, 465,730 and 509,253; U.S. Pat. Nos. 4,946,962 and 5,024,928; Jp-A Nos. 61-69063, 62-299838, 63-159840, 2-67546, 2-134630, 2-157744, 4-184332, 4-255841, 5-45833, 5-45834, 5-313289, 6-2895558-262612 and 9-211773.

In this invention, a thiuronium salt represented by the following formula (4) is preferably employed as a supersensitizer:

formula (4)

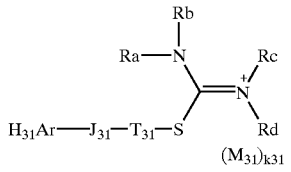

wherein $H_{31}Ar$ represent an aromatic hydrocarbon group or an aromatic heterocyclic group; $T_{31}$ represents a bivalent aliphatic hydrocarbon linkage group or a direct bond; $J_{31}$ represents a bivalent linking group containing at least one of an oxygen atom, sulfur atom and nitrogen atom or a direct bond; Ra, Rb, Rc and Rd each represent a hydrogen atom, an acyl group, an aliphatic hydrocarbon group, an aryl group or a heterocyclic group, or Ra and Rb, Rc and Rd, Ra and Rc, or Rb and Rd combine with each other to form a nitrogen containing ring; $M_{31}$ represents an ion necessary to neutralize an intramolecular charge; and $k_{31}$ represents the number of the ion necessary to neutralize an intramolecular charge.

Examples of a bivalent linking group containing at least one of an oxygen atom, sulfur atom and nitrogen atom, represented by $J_{31}$ include the following groups, which may be combined:

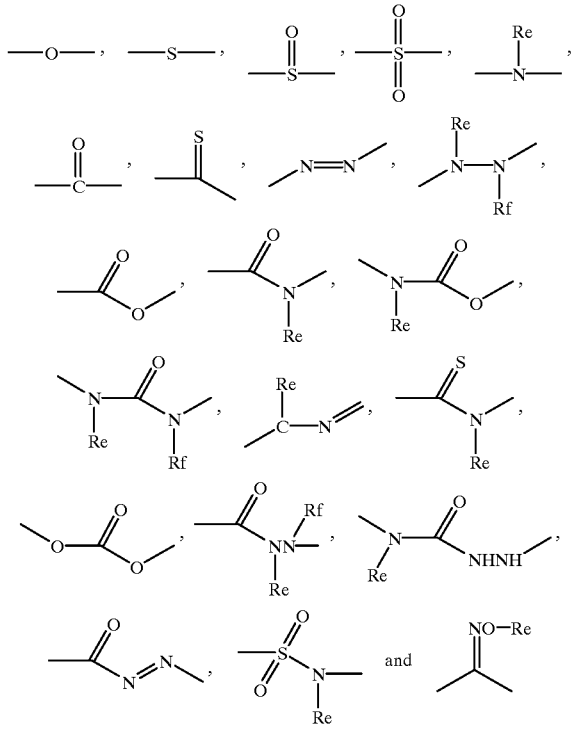

wherein Re and Rf are the same as defined in Ra through Rd. The aromatic hydrocarbon group represented by $ArH_{31}$ is a monocyclic or condensed aryl group (preferably having 6 to 30 carbon atoms, and more preferably 6 to 20 carbon atoms). Examples thereof include phenyl and naphthyl, and phenyl is preferred.

The aromatic heterocyclic group represented by $ArH_{31}$ is a 5- to 10-membered unsaturated heterocyclic group containing at least one of N, O and S, which may be monocyclic or condensed with other ring. A heterocyclic ring of the heterocyclic group is preferably a 5- or 6-membered aromatic heterocyclic ring or its benzo-condensed ring, more preferably a nitrogen-containing, 5- or 6-membered aromatic heterocyclic ring or its benzo-condensed ring, and still more preferably one or two nitrogen- containing, 5- or 6-membered aromatic heterocyclic ring or its benzo-condensed ring.

Examples of the aromatic heterocyclic group include groups derived from thiophene, furan, pyrrole, imidazole, pyrazolo, pyridine, pyrazine, pyridazine, triazole, triazine, indole, indazole, purine, thiadiazole, oxadiazole, quinoline, phthalazine, naphthylizine, quinoxaline, quinazolone, cinnoline, pteridine, acrydine, phenathroline, phenazine, tetrazole, thiazole, oxazole, benzimidazole, benzoxazole, benzthiazole, benzothiazoline, benzotriazole, tetrazaindene, and carbazole. Of these, groups derived from imidazole, pyrazolo, pyridine, pyrazine, indole, indazole, thiadiazole, oxadiazole, quinoline, phenazine, tetrazole, thiazole, oxazole, benzimidazole, benzoxazole, benzthiazole, benzothiazoline, benzotriazole, tetrazaindene, and carbazole are preferred; and groups derived from imidazole, pyridine, pyrazine, quinoline, phenazine, tetrazole, thiazole, benzoxazole, benzoimidazole, benzthiazole, benzothiazoline, benzotriazole, and carbazole are more preferred.

The aromatic hydrocarbon group and aromatic heterocyclic group represented by $ArH_{31}$ may be substituted. The substituent group is the same as the substituent groups defined in $T_{31}$. The substituent group may be further substituted, and plural substituting group may be the same or different. Further, the group represented by $ArH_{31}$ is preferably an aromatic heterocyclic group.

The aliphatic hydrocarbon group represented by Ra, Rb, Rc, Rd, Re and Rf include, for example, an alkyl group (preferably having 1 to 20 carbon atoms, more preferably 1 to 16 carbon atoms and still more preferably 1 to 12 carbon atoms), an alkenyl group (preferably having 2 to 20 carbon atoms, more preferably 2 to 16 carbon atoms, and still more preferably 2 to 12 carbon atoms), an alkynyl (preferably having 2 to 20 carbon atoms, more preferably 2 to 16 carbon atoms, and still more preferably 2 to 12 carbon atoms) an aryl group (preferably having 6 to 30 carbon atoms, more preferably 6 to 20 carbon atoms, and still more preferably 6 to 12 carbon atoms, e.g., phenyl, naphthyl), and a heterocyclic group (e.g., 2-thiazolyl, 1-piperadynyl, 2-pyridyl, 3-pyridyl,2-thienyl, 2-benzimidazolyl, carbazolyl, etc.). The heterocyclic group may be a monocyclic ring or a ring condensed with other rings.

The acyl group represented by Ra, Rb, Rc, Rd, Re and Rf includes an aliphatic or aromatic one, such as acetyl, benzoyl, formyl, and pivaloyl. The nitrogen containing heterocyclic group formed by combination of Ra and Rb, Rc and Rd, Ra and Rc, or Rb and Rd includes a 3- to 10-membered, saturated or unsaturated heterocyclic ring (e.g., ring groups such as piperidine ring, piperazine ring, acridine ring, pyrrolidine ring, pyrrol ring and morphorine ring).

Examples of acid anions used as the ion necessary to neutralize an intramolecular charge, represented by $M_{31}$ include a halide ion (e.g., chloride ion, bromide ion, iodide ion, etc.), p-toluenesulfonate ion, perchlorate ion, tetrafluorobarate ion, sulfate ion, methylsulfate ion, ethylsulfate ion, methanesulfonic acid ion and trifluoromethanesulfonic acid ion.

The aliphatic hydrocarbon group, an aryl group and heterocyclic group, represented by Ra, Rb, Rc, Rd, Re and Rf may be substituted at any position. Examples of such substituent groups include an alkyl group (including a cycloalkyl group and an aralkyl group, and preferably having 1 to 20 carbon atoms, more preferably 1 to 12 carbon atoms and still more preferably 1 to 8 carbon atoms, such as methyl, ethyl, n-propyl, isopropyl, n-butyl, tert-butyl, n-heptyl, n-octyl, n-decyl, n-undecyl, n-hexadecyl, cyclopropyl, cyclopentyl, cyclohexyl, benzyl, phenethyl), an alkenyl group (preferably having 2 to 20 carbon atoms, more preferably 2 to 12 carbon atoms, and still more preferably 2 to 8 carbon atoms, e.g., vinyl, allyl, 2-butenyl, 3-pentenyl, etc.), an alkynyl (preferably having 2 to 20 carbon atoms, more preferably 2 to 12 carbon atoms, and still more preferably 2 to 8 carbon atoms, e.g., propargyl, 3-pentynyl, etc.), aryl group (preferably having 6 to 30 carbon atoms, more preferably 6 to 20 carbon atoms, and still more preferably 6 to 12 carbon atoms, e.g., phenyl, p-tolyl, o-aminophenyl, naphthyl), an amino group (preferably having 0 to 20 carbon atoms, more preferably 0 10 carbon atoms, and still more preferably 0 to 6 carbon atoms, e.g., amino, methylamino, ethylamino, dimethylamino, diethylamino, diphenylamino, dibenzylamino, etc.), an imino group (preferably having 1 to 20 carbon atoms, more preferably 1 to 18 carbon atoms, and still more preferably 1 to 12 carbon atoms, e.g., methylimono, ethylimono, propylimino, phenylimino), an alkoxy group (preferably having 1 to 20 carbon atoms, more preferably 1 to 12 carbon atoms, and still more preferably 1 to 8 carbon atoms, e.g., methoxy, ethoxy, butoxy, etc.), an aryloxy group (preferably having 6 to 20 carbon atoms, more preferably 6 to 16 carbon atoms, and still more preferably 6 to 12 carbon atoms, e.g., phenyloxy, 2-naphthyloxy, etc.), an acyl group (preferably having 1 to 20 carbon atoms, more preferably 1 to 16 carbon atoms, and still more preferably 1 to 12 carbon atoms, e.g., acetyl, formyl, pivaloyl, benzoyl, etc.), an alkoxycarbonyl group (preferably having 2 to 20 carbon atoms, more preferably 2 to 16 carbon atoms, and still more preferably 2 to 12 carbon atoms, e.g., methoxycarbonyl, ethoxycarbonyl, etc.), an aryloxycarbonyl group (preferably having 7 to 20 carbon atoms, more preferably 7 to 16 carbon atoms, and still more preferably 7 to 10 carbon atoms, e.g., phenyloxycarbonyl, etc.), an acyloxy group (preferably having 1 to 20 carbon atoms, more preferably 1 to 16 carbon atoms, and still more preferably 1 to 10 carbon atoms, e.g., acetoxy, benzoyloxy, etc.), an acylamino group (preferably having 1 to 20 carbon atoms, more preferably 1 to 16 carbon atoms, and still more preferably 1 to 10 carbon atoms, e.g., acetylamino, benzoylamino, etc.), an alkoxycarbonylamino group (preferably having 2 to 20 carbon atoms, more preferably 2 to 16 carbon atoms, and still more preferably 2 to 12 carbon atoms, e.g., methoxycarbonylamino, etc.), an aryloxycarbonylamino group (preferably having 7 to 20 carbon atoms, more preferably 7 to 16 carbon atoms, and still more preferably 7 to 12 carbon atoms, e.g., phenyloxycarbonylamino, etc.), a sulfonylamino group (preferably having 1 to 20 carbon atoms, more preferably 1 to 16 carbon atoms, and still more preferably 1 to 12 carbon atoms, e.g., methanesulfonylamino, benzenesulfonylamino, etc.), a sulfamoyl group (preferably having 0 to 20 carbon atoms, more preferably 0 to 16 carbon atoms, and still more preferably 0 to 12 carbon atoms, e.g., sulfamoyl, methylsulfamoyl, dimethylsulfamoyl, phenylsulfamoyl, etc.), a carbamoyl group (preferably having 1 to 20 carbon atoms, more preferably 1 to 16 carbon atoms, and still more preferably 1 to 12 carbon atoms, e.g., carbamoyl, methylcarbamoyl, diethylcarbamoyl, phenylcarbamoyl, etc.), an alkylthio group (preferably having 1 to 20 carbon atoms, more preferably 1 to 16 carbon atoms, and still more preferably 1 to 12 carbon atoms, e.g., methylthio, ethylthio, etc.), arylthio group (preferably having 6–20 carbon atoms, more preferably 6 to 16 carbon atoms and still more preferably 6 to 12 carbon atoms, e.g., phenylthio), an alkylsulfonyl or arylsulfonyl group (preferably having 1 to 20 carbon atom, more preferably 1 to 16 carbon atoms, and still more preferably 1 to 12 carbon atoms, e.g., methanesulfonyl, tosyl) an alkylsulfonyl or arylsulfinyl group (preferably having 1 to 20 carbon atoms, more preferably 1 to 16 carbon atoms, and still more preferably 1 to 12 carbon atoms, e.g., methanesulfinyl, benzenesulfinyl, etc.), an ureido group (preferably having 1 to 20 carbon atoms, more preferably 1 to 16 carbon atoms, and still more preferably 1 to 12 carbon atoms, e.g., ureido, methylureido, phenylureido, etc.), a phosphoric acid amido group (preferably having 1 to 20 carbon atoms, more preferably 1 to 16 carbon atoms, and still more preferably 1 to 12 carbon atoms, e.g., diethylphosphoric acid amido, phenylphosphoric acid amido, etc.), hydroxy group, mercapto group, a halogen atom (e.g., fluorine atom, chlorine atom, bromine atom, iodine atom), cyano group, sulfo group, sulfino group, carboxy group, phosphono group, phosphono group, nitro group, hydroxamic acid group, hydrazino group, and a heterocyclic group (e.g., imidazolyl, benzimidazolyl, thiazolyl, benzothiazolyl, carbazolyl, pyridyl, furyl, piperidyl, morphoryl. etc.).

Of these substituent groups described above, hydroxy group, mercapto group, sulfo group, sulfino group, carboxy group, phosphono group, and phosphino group include their salts. The substituent group may be further substituted. In this case, plural substituent may be the same or different.

The preferred substituent groups include an alkyl group, aralkyl group, alkoxy group, aryl group, alkylthio group, acyl group, acylamino group, imino group, sulfamoyl group, sulfonyl group, sulfonylamino group, ureido group, amino group, halogen atom, nitro group, heterocyclic group, alkoxycarbonyl group, hydroxy group, sulfo group, carbamoyl group, and carboxy group. Specifically, an alkyl group, alkoxy group, aryl group, alkylthio group, acyl group, acylamino group, imino group, sulfonylamino group, ureido group, amino group, halogen atom nitro group, heterocyclic group, alkoxycarbonyl group, hydroxy group, sulfo group, carbamoyl group and carboxy group are more preferred; and an alkyl group, alkoxy group, aryl group, alkylthio group, acylamino group, imino group, ureido group, amino group, heterocyclic group, alkoxycarbonyl group, hydroxy group, sulfo group, carbamoyl group and carboxy group are still more preferred.

The bivalent, aliphatic hydrocarbon linkage group represented by $T_{31}$ include a straight-chain, branched cyclic alkylene group (preferably having 1 to 20 carbon atoms, more preferably 1 to 16 carbon atoms, and still more preferably 1 to 12 carbon atoms), an alkenylene group (preferably having 2 to 20 carbon atoms, more preferably 2 to 16 carbon atoms, and still more preferably 2 to 12 carbon atoms), an alkynylene group (preferably having 2 to 20 carbon atoms, more preferably 2 to 16 carbon atoms, and still more preferably 2 to 12 carbon atoms), each of which may be substituted by substituent group(s).

Exemplary examples of the compound represented by formula (4) are shown below but are by no means limited to these.

4-1

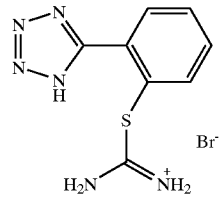

4-2

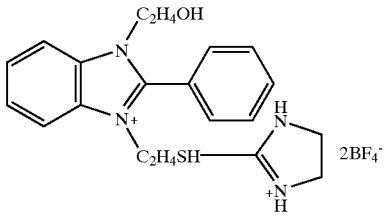

4-3

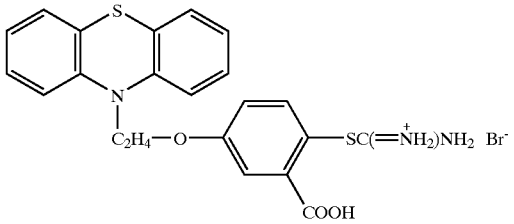

4-4

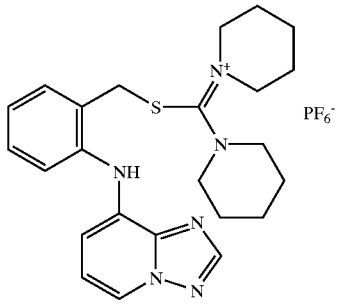

4-5

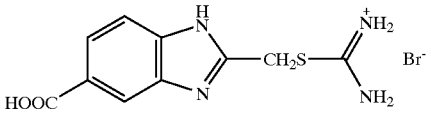

4-6

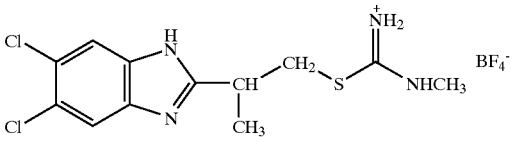

4-7

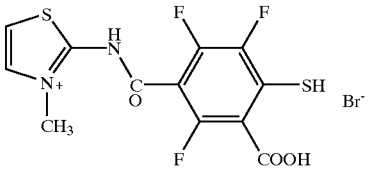

-continued
4-8
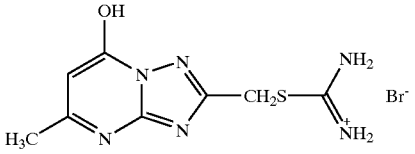
4-9
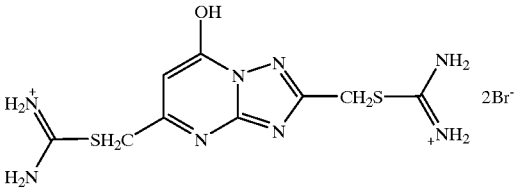
4-10
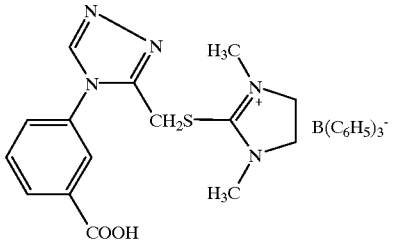
4-11
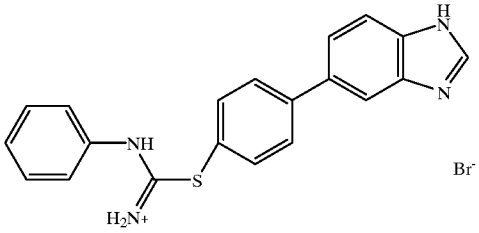
4-12
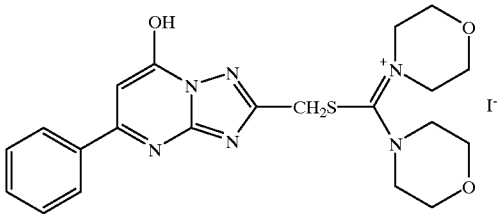
4-13
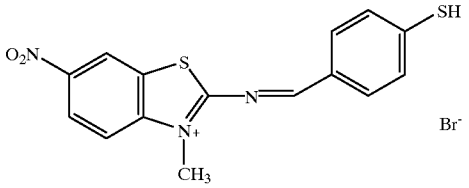
4-14
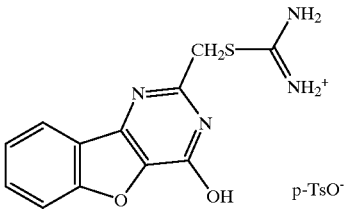
-continued
4-15
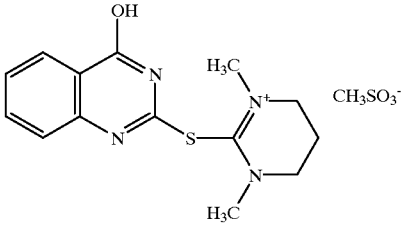
4-16
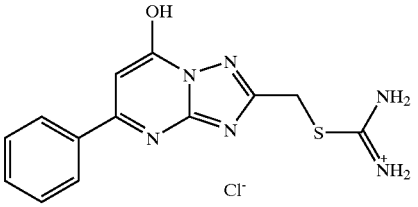
4-17
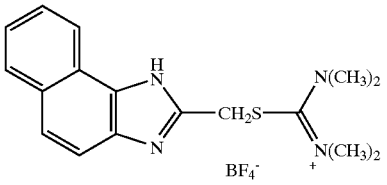
4-18
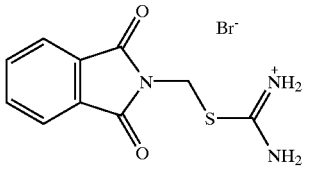
4-19
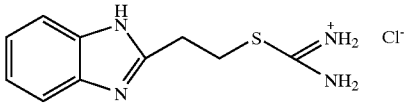
4-20
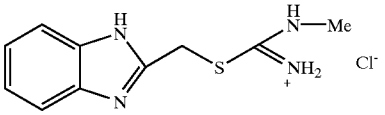
4-21
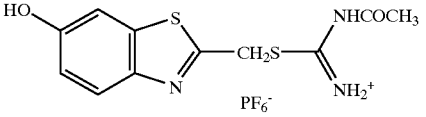
4-22
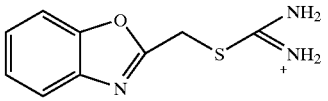
4-23
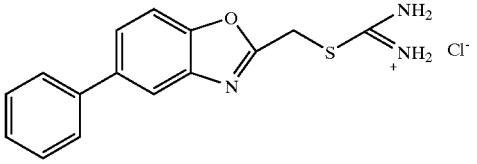

-continued 4-24

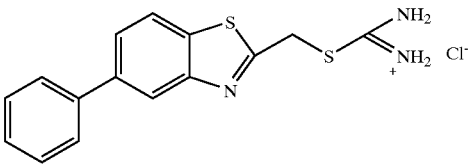

4-25

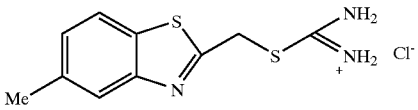

4-26

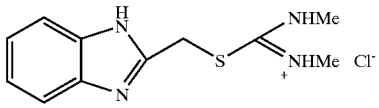

4-27

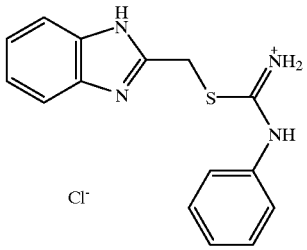

4-28

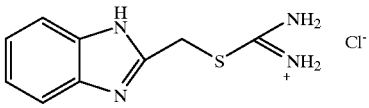

4-29

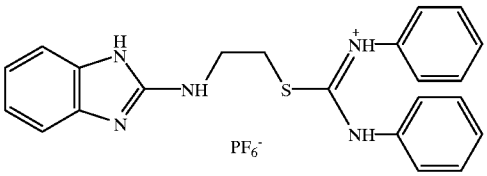

4-30

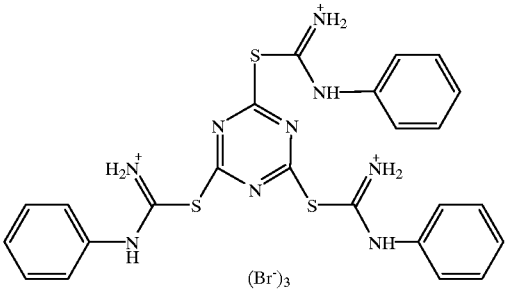

The compound represented by formula (4) is incorporated, depending of its purpose but preferably in an amount of $10^{-4}$ to 1 mol/mol Ag, more preferably $10^{-3}$ to 0.3 mol/mol Ag, and still more preferably $10^{-3}$ to 0.1 mol/molAg. The compound represented by formula (4) may be incorporated alone or in combination. The compound represented by formula (4) can be incorporated in any form such as solution, powder, or a solid particle dispersion. Solid particle dispersion is achieved using known pulverizing means (e.g., ball mill, vibration ball mill, side mill, colloid mill, jet mill, roller mill, etc.). A dispersing aid may be employed in combination in the solid particle dispersion.

Further, the compound represented by formula (4) is used preferably in combination with a heteroatom containing macrocyclic compound. The heteroatom containing macrocyclic compound contained in thermally developable photosensitive materials is more effective when used with an infrared sensitizing dye, leading to enhanced sensitivity and an improvement in desensitization during storage.

The heteroatom containing macrocyclic compound refers to a nine- or more membered macrocyclic compound containing at least a heteroatom selected from a nitrogen atom, an oxygen atom, a sulfur atom and a selenium atom. The macrocyclic compound is preferably a 12- to 24-membered ring and more preferably 15- to 21-membered ring. Representative compounds thereof include compounds commonly known as a crown ether, which was synthesized by Pederson in 1967 and a number of which have been synthesized since its specific report. The compounds are detailed in C. J. Pederson, Journal of American Chemical Society vol. 86 (2495), 7017–7036 (1967); G. W. Gokel & S. H. Korzeniowski, "Macrocyclic Polyether Synthesis", Springer-Vergal (1982); "Chemistry of Crown Ether" edited by Oda, Shono & Tabuse, published by Kyoritsu Shuppan (1978); "Host-Guest" edited by Tabuse, published by Kyoritsu Shuppan (1979); and Suzuki & Koga, Yuki Gosei Kagaku (Journal of Organic Synthetic Chemistry) vol. 45 (6) 571–582 (1987).

Exemplary examples of the heteroatom containing macrocyclic compounds used in the invention are shown below, but are not limited to these examples.

S-1

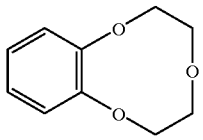

S-2

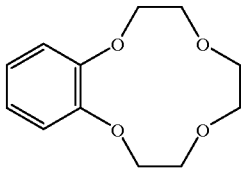

S-3

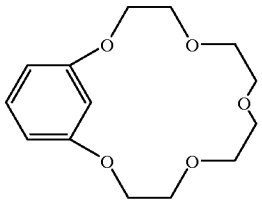

S-4

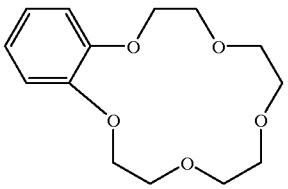

-continued
S-5
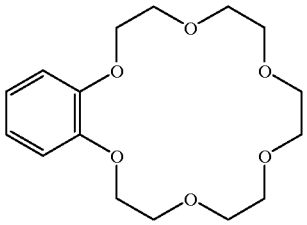
S-6
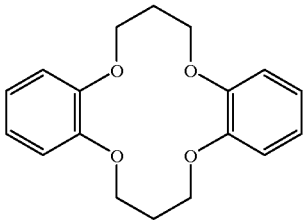
S-7
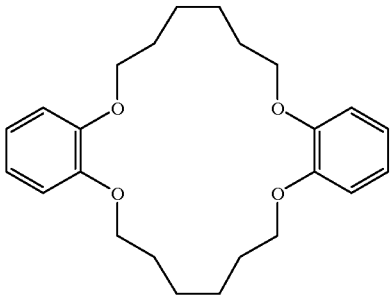
S-8
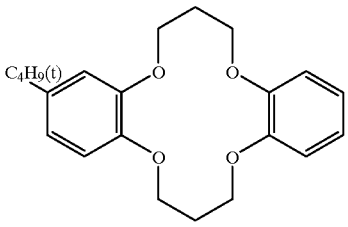
S-9
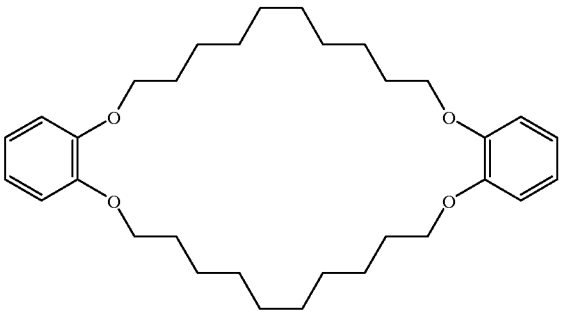
-continued
S-10
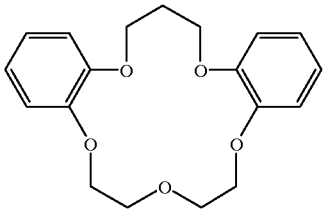
S-11
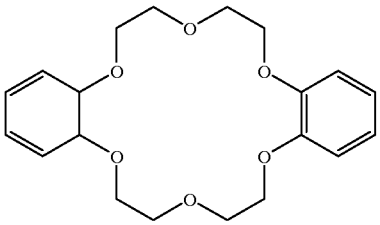
S-12
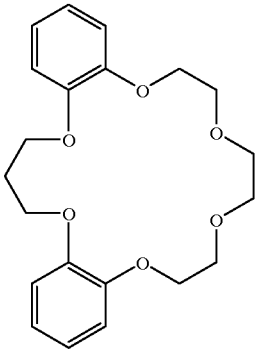
S-13
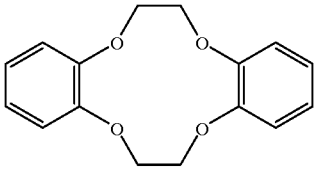
S-14
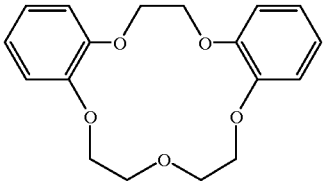
S-15
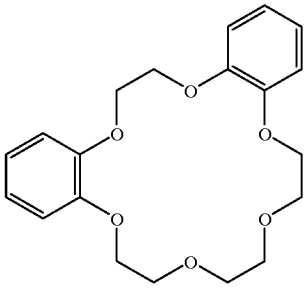

-continued
S-16
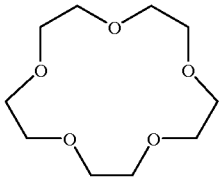
S-17
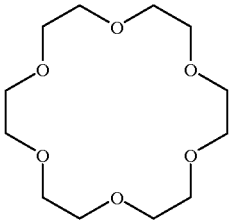
S-18
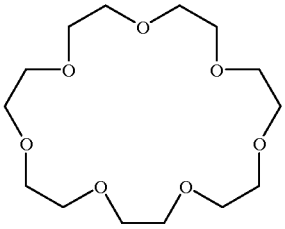
S-19
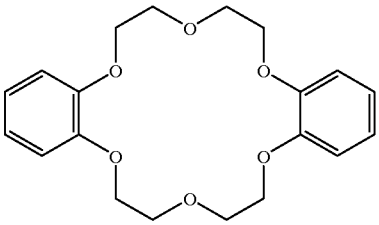
S-20
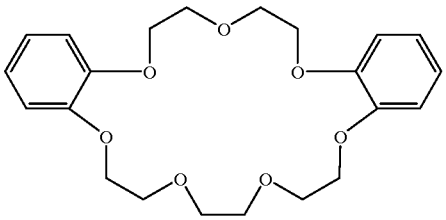
S-21
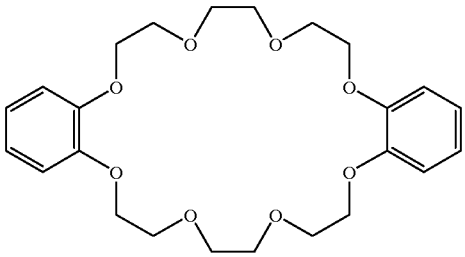
S-22
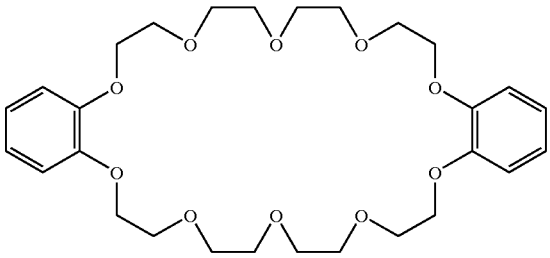
S-23
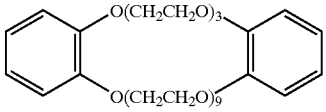
S-24
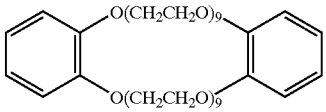
S-25
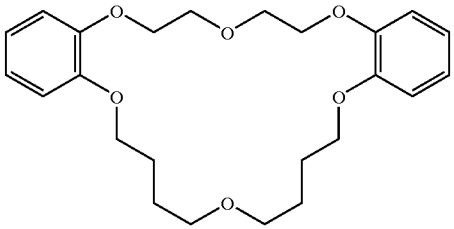
S-26
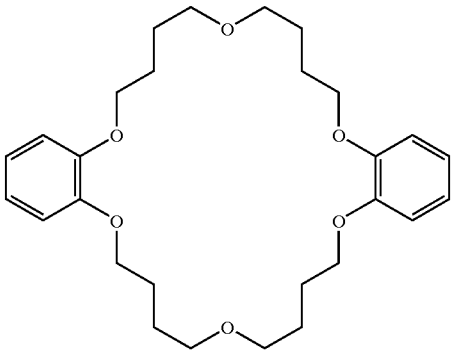
S-27
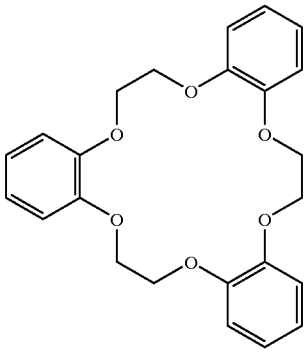

-continued
S-28
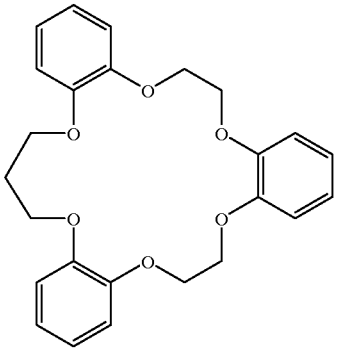
S-29
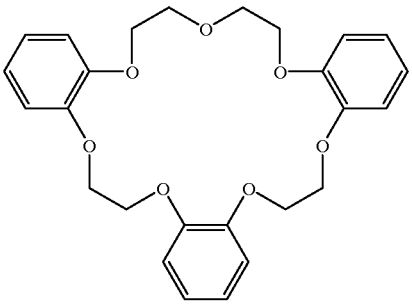
S-30
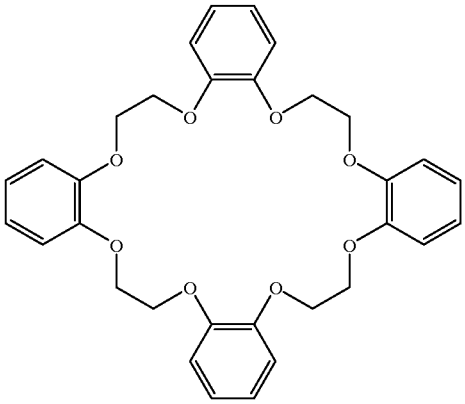
S-31
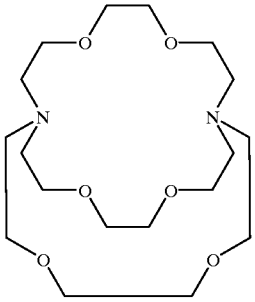
-continued
S-32
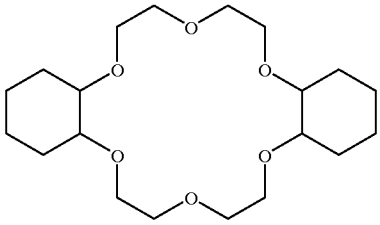
S-33
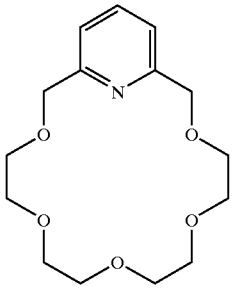
S-34
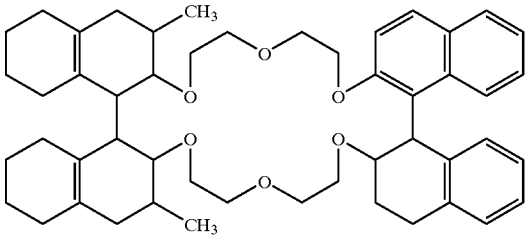
S-35
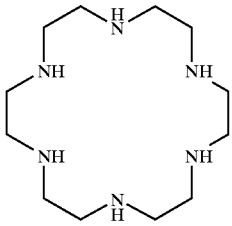
S-36
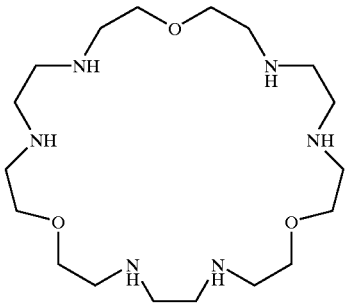
S-37
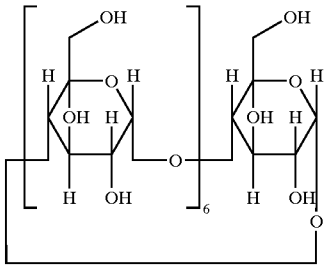

-continued

S-38

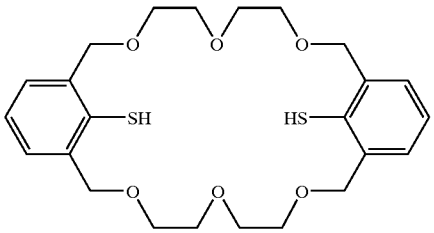

S-39

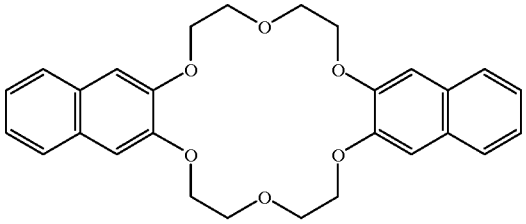

S-40

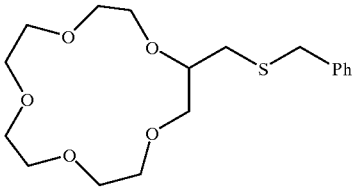

S-41

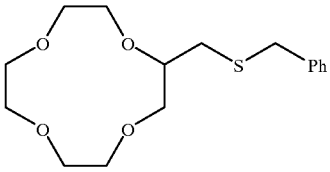

S-42

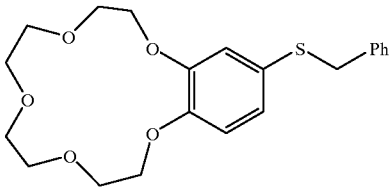

S-43

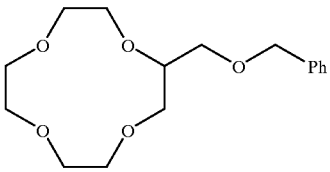

S-44

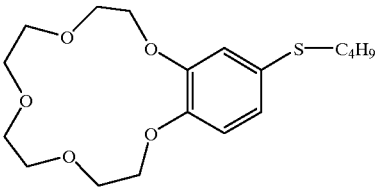

-continued

S-45

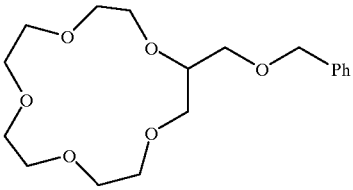

ph: phenyl

Advantageous effects of the use of the compound of formula (4) in combination with the heteroatom containing macrocyclic compound has not been definitely clear. Effects of incorporation of these macrocyclic compounds into conventional silver halide photographic materials are described in the literature described above. However, it is surprising that unexpected effects were found even in the thermally developable photosensitive materials, which are entirely different in condition from the conventional silver halide photographic materials. It is not definitely clear why these compounds exhibited advantageous effects specifically in the thermally developable photographic material. Unlike the photosensitive layer of the conventional silver halide photographic material, the thermally developable photosensitive layer contains a silver source other than silver halide (such as organic silver salts or toning agent silver complex salts), so that it is supposed that adsorption of a sensitizing dye to silver halide is easily deteriorated, as compared to the conventional silver halide photographic materials. It is also contemplated that the heteroatom containing macrocyclic compound acts onto it, promoting adsorption of the dye to silver halide.

The heteroatom containing macrocyclic compound may be added at any stage after forming silver halide and until preparing a coating solution, and is added preferably prior to adding the sensitizing dye. To enhance effects of the compound in the thermally developable photosensitive material, as will be described later, it is preferred to introduce an iodide into the region in the vicinity of the surface of silver halide grains used in the thermally developable photosensitive material. It is necessary to further strengthen the adsorption, as compared to conventional systems using gelatin. The heteroatom containing macrocyclic compounds are generally incorporated into the thermally developable photosensitive layer through solution in organic solvents such as methanol, ethanol or fluorinated alcohols, or water. In cases where solubility is not sufficient, dissolution-promoting agent may be used in combination, including potassium acetate, potassium iodide, potassium fluoride, potassium p-toluenesulfonate, $KBF_4$, $KPF_6$, $NH_4BF_4$ and $NH_4PF_6$. Any compound containing an ion capable of forming an inclusion compound together with the heteroatom containing macrocyclic compound, which is able to improve solubility may be usable as the dissolution-promoting agent.

In this invention, contrast-increasing agents may be employed to form high contrast images. Examples thereof include hydrazine derivatives described in U.S. Pat. Nos. 5,464,738, 5,496,695, 6,512,411 and 5,536,622; Japanese Patent Application Nos. 7-228627, 8-215822, 8-130842, 8-148113, 8-148111 and 8-148116; a quarternary nitrogen containing compound described in Japanese Patent Application No. 8-83566; and acrylonitrile compound described in U.S. Pat. No. 5,545,515. Exemplary compounds thereof are Compound 1 through 10 described in U.S. Pat. No.

5,464,738; H-1 through H-28 described in U.S. Pat. No. 5,496,695; I-1 through I-86 described in Japanese Patent Application No. 8-215822; H-1 through H-62 described in Japanese Patent Application No. 8-130842; Compound 1—1 through 1–21 described in Japanese Patent Application No. 8-148113, Compound 1 through 50 described in Japanese Patent Application No. 8-148111; Compound 1 through 40 described in Japanese Patent Application No. 8-148116; Compound P-1 through P-26 and T-1 through T-18 described in Japanese Patent Application No. 8-83566, Compound CN-1 through CN-13 described in U.S. Pat. No. 5,545,515. Further, contrast-increase promoting agents are preferably employed together with the contrast-increasing agent to form high contrast images. Examples of contrast-increase promoting agents (or nucleation-promoting agent) include amine compounds described in U.S. Pat. No. 5,545,505, specifically, AM-1 through Am-5; hydroxamic acids described in U.S. Pat. No. 5,545,507; acrylonitril such as CN-1 to AN-13 described in U.S. Pat. No. 5,545,507; hydrazine compounds, such as CA-1 to CA-6 described in U.S. Pat. No. 5,558,983; onium salts such as A-1 to A-42, B-1 to B-27 and C-1 to C-14 described in Japanese Patent Application No. 8-132836. These contrast-increasing agents and contrast-increase promoting agents are also disclosed in the foregoing disclosure with respect to the synthesis method, addition method and addition amount.

Next, light-sensitive silver halide used in this invention will be described in detail. Halide composition of the silver halide used in this invention is not specifically limited, including silver chloride, silver chlorobromide, silver bromide, silver iodobromide, silver iodochlorobromide. The halide composition within the grain may be uniform, or may be stepwise or continuously varied. Silver halide grains having a core shell structure are preferably employed. Such a structure is preferably a 2- to 5-layer structure core/shell grains, and more preferably 2 to 4-layered structure core/shell grains. A technique of localizing silver bromide on the surface of silver chloride or silver chlorobromide grains is also preferably employed.

Preparation methods of light-sensitive silver halide are known in the photographic art, as described in Research Disclosure No. 17029 (June, 1978) and U.S. Pat. No. 3,700,458. Concretely, a silver-providing compound and a halide-providing compound are added into a solution containing gelatin or other polymers to prepare light-sensitive silver halide grains, which are further mixed with an organic silver salt. In order to minimize cloudiness after image formation, the less the average grain size, the more preferred, and the average grain size is preferably less than 0.20 $\mu$m, more preferably between 0.01 and 0.15 $\mu$m, and still more preferably between 0.02 and 0.12 $\mu$m. The average grain size as described herein is defined as an average edge length of silver halide grains, in cases where they are so-called regular crystals in the form of cube or octahedron. In cases where they are tabular, the grain size is defined as a diameter of a circle having an area equivalent to the grain projected area (so-called circular equivalent diameter). Furthermore, in cases where grains are not regular crystals, for example, spherical, or bar-like grains, the grain size refers to the diameter of a sphere having the same volume as the silver grain.

The shape of silver halide grains may be cubic, octahedral, tabular, spherical, bar-like or potato-form grains. Of these, cubic grains or tabular grains are preferred. With regard to the tabular silver halide grains, the average aspect ratio is preferably 100:1 to 2:1, and more preferably 50:1 to 3:1. Corner-rounded silver halide grains are also preferred. The outer surface of silver halide grains is not specifically limited with respect to a Miller index, but a high ratio accounted for by a Miller index [100] plane is preferred. This ratio is preferably at least 50%; is more preferably at least 65%, and is most preferably at least 80%. The ratio accounted for by the Miller index [100] face can be obtained based on T. Tani, J. Imaging Sci., 29, 165 (1985) in which adsorption dependency of a [111] face or a [100] face is utilized.

Silver halide grains used in this invention preferably contain metals selected from the 7th to 11th groups of the periodical table or their complex. Such metals or the metals of the complexes are preferably rhodium, rhenium, ruthenium, osmium, or iridium. The metal complex may contained alone or in combination of two or more complexes of the same metal or different metals. The content is preferably $10^{-9}$ to $10^{-2}$ mol, and more preferably $10^{-8}$ to $10^{-4}$ mol per mol of silver. Concretely, metal complexes having a structure as described in JP-A 7-225449 can be employed. Rhodium compounds used in this invention are preferably an aqueous soluble rhodium compounds. Examples thereof are a rhodium (III) halide or a rhodium complex having a ligand such as halogen, amines or oxalate, including hexachlororhodium (III) complex, pentachlororhodium (III) complex, tetrachloridiaquorhodium (III) complex, hexabromorhodium (III) complex, hexaaminerhodium (III) complex, and trioxalaterhodium (III) complex. These rhodium compounds are employed through solution in water or appropriate solvents. To enhance stability of a rhodium compound solution, aqueous hydrogen halide solution (e.g., hydrogen chloride, hydrogen bromide, hydrogen fluoride, etc.) or an alkali halide (e.g., KCl, NaCL, KBr, NaBr, etc.) may be added thereto. In place of employing an aqueous rhodium compound, silver halide grains doped with rhodium may be added and dissolved. The rhodium compound is incorporated preferably in an amount of $1\times10^{-8}$ to $5\times10^{-6}$, and more preferably $5\times10^{-8}$ to $1\times10^{-6}$ mol per mol of silver halide. The compound may be added at any stage during preparation of silver halide grains and before emulsion-coating, and is preferably added during emulsion-making to be integrated within the silver halide grain.

Rhenium, ruthenium and osmium are incorporated in the form of an aqueous soluble complex, as described in JP-A 63-2042, 1-285941, 2-20852 and 2-20855. Specifically, six-coordinate complexes represented by the general following formula are preferred:

Formula: $(ML_6)^{n-}$:

wherein M represents Ru, Re or Os; L represents a coordinating ligand; and n is 0, 1, 2, 3 or 4. In this case, ammonium ion or alkali metal ions are used as a counter ion.

Exemplary examples of the referred ligand represented by L include a halide ligand, cyanide ligand, cyanato ligand, nitrosyl, thionitrosyl, nitrosyl and thionitrosyl. Exemplary examples of complexes are shown below, but are not limited to these.

$[ReCl_6]^{3-}$
$[ReBr_6]^{3-}$
$[Re(NO)Cl_5]^{2-}$
$[Re(NS)Br_5]^{2-}$
$[Re(NO)Cl_5]^{2-}$
$[Re(O)_2(CN)_4]^{3-}$
$[RuCl_6]^{3-}$
$[RuCl_4(H_2O)_2]^{-}$
$[RuCl_5(NO)]^{2-}$
$[RuBr_5(NS)]^{2-}$

-continued

| |
|---|
| $[Ru(CO)_3Cl_3]^{2-}$ |
| $[Ru(CO)Cl_5]^{2-}$ |
| $[OsCl_6]^{3-}$ |
| $[OsCl_5(NO)]^{2-}$ |
| $[Os(NO)(CN)_5]^{2-}$ |
| $[Os(NS)Br_5]^{2-}$ |
| $[Os(O)_2(CN)_4]^{4-}$ |

The content of these compounds is preferably $1\times10^{-9}$ to $1\times10^{-5}$ mol per mol of silver halide, and more preferably $1\times10^{-8}$ to $1\times10^{-6}$ mol per mol of silver halide.

The compound is optimally added at any stage during preparation of silver halide grains and before emulsion coating, and is preferably added during emulsion-making to be integrated with the silver halide grain.

To integrate the foregoing compounds in the interior of silver halide grains, the compounds are added during formation of silver halide grains in such a manner that a powdery metal complex is dissolved with NaCl or KCl and the resulting solution is added to an aqueous soluble salt or aqueous soluble halide solution used for grain formation; the metal complex solution is simultaneously added with silver salt and halide solutions during grain formation; or a given amount of the metal complex solution is added to the reaction vessel in advance. Specifically, it is preferred that a powdery metal complex is dissolved with NaCl or KCl and the resulting solution is added to an aqueous soluble salt or aqueous soluble halide solution used for grain formation. To allow the compound to be contained in the vicinity of the grain surface, a given amount of the metal complex solution may be added immediately after completion of grain formation, during or at the completion of physical ripening, or during chemical ripening.

Various iridium compounds are employed in this invention, including hexachloroiridium, hexaammine iridium, trioxalatoiridium, hexacyanoiridium, and pentachloronitrocyl iridium. Such iridium compounds are used through solution in water or an appropriate solvent. To enhance stability of a solution of the iridium compound, an aqueous hydrogen halide solution (e.g., hydrochloric acid, hydrobromic acid, hydrofluoric acid) or an alkali halide (e.g., KCl, NaCl, KBr, NaBr) is further added thereto. In place of employing an aqueous iridium compound, silver halide grains doped with iridium may be added and dissolved.

Further, cobalt, iron, nickel, chromium, palladium platinum, gold, thallium, copper or lead may be contained in silver halide grains. Specifically, cobalt, iron, chromium and ruthenium compounds are employed preferably in the form of a hexacyano-metal complex, such as ferricyanic acid ion, ferrocyanic acid ion, and hexacyanoruthenium acid ion. The metal complex may be homogeneously contained within a silver halide grain, or may be preferentially contained in the core or shell portion of the grain.

The foregoing metals are contained preferably in an amount of $1\times10^{-9}$ to $1\times10^{-4}$ mol per mol of silver halide. The metals are added, during grain formation, in the form of a single salt, a double salt or a complex salt.

A light-sensitive silver halide emulsion used in this invention may or may not be desalted. The silver halide emulsion can be desalted through noodle washing or a coagulation method.

The silver halide emulsion is preferably subjected to chemical sensitization. Chemical sensitization is carried out employing sulfur sensitization, selenium sensitization, tellurium sensitization or noble metal sensitization alone or in combination. With regard to the combination thereof, a combination of sulfur sensitization and gold sensitization, a combination of sulfur sensitization, selenium sensitization and gold sensitization, a combination of sulfur sensitization, selenium sensitization and gold sensitization, and a combination of sulfur sensitization, selenium sensitization and tellurium sensitization are preferred.

Sulfur sensitization is usually conducted in such a manner that a sulfur sensitizer is added to an emulsion and the emulsion is stirred at a temperature of 40° C. or higher for a given period of time. Commonly known sulfur sensitizers are employed, including thiosulfates, thioureas, thiazoles, and rhodanines as well as a sulfur compound contained in gelatin. The amount of the sulfur sensitizer to be added, depending on the pH or the temperature in chemical ripening, and the silver halide grain size, is preferably $10^{-7}$ to $10^{-2}$, and more preferably $10^{-5}$ to $10^{-3}$ per mol of silver halide.

Selenium sensitizers, known as selenium compounds, are employed commonly. Thus, a labile and/or non-labile selenium compounds are added to an emulsion and the emulsion is stirred at a temperature of 40° C. or higher for a given period of time. The labile selenium compounds include those which are described in JP-B 44-15748, 43-13489; JP-A 4-25832, 4-109240 and 3-121798. Compound represented by general formulas (VIII) and (IX) are described in JP-A 4-324855.

Tellurium sensitizers used in this invention are compounds capable of forming a sensitization site on the surface or in the interior of silver halide grains. The rate of forming silver telluride in a silver halide emulsion can be determined in accordance with the method described in JP-A 5-313284. Tellurium sensitizers usable in this invention include, for example, diacyltellurides, bis(oxycarbonyl)tellurides, bis(carbamoyl)tellurides, diacyltellurides, bis(oxycarbonyl)ditellurides, bis(carbamoyl)ditellurides, a compound containing a P═Te bond, tellurocarboxylic acid salts, di(or poly)tellurides, tellurides, tellulols, telluroacetals, tellurocarbonyl compounds, a compound containing a P—Te bond, Te-containing heterocyclic compounds, telluorocarbonyl compounds, inorganic tellurium compounds and colloidal tellurium. Exemplary examples thereof are described in U.S. Pat. Nos. 1,623,499, 3,320,069 and 3,772,031; British patent Nos. 235,2111,121,4961,295,462 and 1,396,696; Canadian patent No. 800,958; JP-A 4-204640; Japanese Patent Application Nos. 3-53693, 3-131598 and 4-129787; J. Chem. Soc. Chem. Commun., 635 (1979), ibid 1102 ((1079) and ibid 645 (1980); J. Chem. Soc. Perkin Trans. 12191 (1980); S. Patai "The Chemistry of Organic and Tellurium Compounds" vol. 1 (1986), and ibid vol. 2 (1987). Specifically, compounds represented by general formulas (II), (III) and (IV) of JP-A 5-313284 are preferred.

The selenium or tellurium sensitizer to be used, depending of silver halide grains and chemical ripening conditions, is preferably $10^{-8}$ to $10^{-2}$, and more preferably $10^{-7}$ to $10^{-3}$ mol per mol of silver halide. Chemical ripening conditions are not specifically limited but the pH and pAg are preferably 5 to 8 and 6 11, respectively, and the temperature is preferably 40 to 95° C., and more preferably 45 to 85° C.

Novel metal sensitizers usable in this invention include, for example, gold, platinum, palladium, and iridium compounds. Specifically, gold sensitization is preferred. Examples of gold sensitizers used in this invention include chloroauric acid, potassium chloroaurate, potassium aurithiocyanate and gold sulfide. The sensitizer is preferably used in an amount of $10^{-7}$ to $10^{-2}$ mol per mol of silver halide. Cadmium salts, sulfites, lead salts or thallium salts may concurrently be present during formation of silver halide grains or during their physical ripening.

Reduction sensitization may be employed in this invention. Exemplary compounds used for the reduction sensitization include stannous chloride, aminoiminomethanesulfinic acid, hydrazine derivatives, borane compounds, silane compounds and polyamine compounds. Reduction sensitization can also be performed by ripening a silver halide emulsion at a pH of 7 or more or at a pAg of 8.3 or less. Further, reduction sensitization can be performed through introduction of single addition of silver ions during grain formation. Thiosulfonic acid compounds may be added to a silver halide emulsion according to the method described in European patent No. 293,917.

Silver halide emulsions used in this invention may be used alone or in combination thereof (such as emulsions different in average grain size, emulsions different in halide composition, emulsions different in crystal habit, and emulsions different chemical ripening condition). The content light-sensitive silver halide is preferably 0.01 to 0.5 mol, 0.02 to 0.3, and still more preferably 0.03 to 0.25 mol per mol of an organic silver salt. The thus prepared silver halide grains are mixed with an organic silver salt in such a manner that both are mixed by means of a high-speed stirrer, a ball mill, a sand mill, colloid mill, vibration mill, or a homogenizer; or the light-sensitive silver halide is mixed with the organic silver salt at an optimal time during formation of the organic silver salt.

Sensitizing dyes can be used in the photothermographic materials used in this invention. There can be employed any sensitizing dye which is capable of sensitizing silver halide grains to the desired wavelength region upon adsorption onto the silver halide grains. Examples of the sensitizing dyes include cyanine dyes, merocyanine dyes, complex cyanine dyes, complex merocyanine dyes, holopolar cyanine dyes, styryl dyes, hemi-cyanine dyes, oxonol dyes and hemi-oxonol dyes. Sensitizing dyes usable in this invention are described in Research Disclosure (hereinafter, denoted as RD) Item 17643, sect. IV-A December, 1978, page 23); ibid, Item 1831, sect. IX (August, 1979, page 437) and references cited therein. There can be advantageously selected sensitizing dyes suitable for spectral characteristics of light sources used various laser imager, scanner, imagesetter and reproduction camera. As an example of spectral sensitization to the red light region, for example, compounds I-1 through I-38 described in JP-A No. 54-18726, compounds I-1 through I-35 described in JP-A No. 6-75322 and compounds I-1 through I-35 described in JP-A No. 7-287338 for a He—-Ne laser light source; and Dye 1 through 20 described in JP-B No. 55-39818 (herein, the term, JP-B means a published Japanese Patent), compounds I-1 through I-37 described in JP-A No. 62-284343 and compounds I-1 through I-34 described in JP-A No. 7-287338 for a LED light source are advantageously selected. Using a variety of commonly known sensitizing dyes including cyanine, merocyanine, styryl, hemi-cyanine, oxonol, hemi-oxonol and xanthene dyes, silver halide emulsion grains can be spectrally sensitized to the wavelength region of 750 to 1400 nm. Useful cyanine dyes are those which contain a basic nucleus such as a thiazoline nucleus, an oxazoline nucleus, a pyrroline nucleus, a pyridine nucleus, an oxazole nucleus, a thiazole nucleus, selenazole nucleus and an imidazole nucleus. In addition to the basic nucleus, an acid nucleus such as a thiohydantoin nucleus, rhodanine nucleus, oxazolidinedione nucleus, thiazolidinedione nucleus, barbituric acid nucleus, thiazolinone nucleus, malononitrile nucleus and pyrazolo nucleus are also effective. Of the foregoing cyanine and merocyanine dyes, those which contain an imino group or a carboxy group are specifically effective. For example, there are employed dyes optimally selected from those which are described in U.S. Pat. Nos. 3,761,279, 3,719,495, 3,877,943; British patent No. 1,466,201, 1,469,117 and 1,422,057; JP-B No. 3-10391 and 6-52387; JP-A 5-341432, 6-194781 and 6-301141. Specifically preferred dyes include, for example, cyanine dyes having a thio-ether bond, such as cyanine dyes described in JP-A Nos. 62-58239, 3-138638, 3-138642, 4-255840, 5-72659, 5-72661, 6-222491, 2-230506, 6-258757, 6-317868, 6-324425; and JP-A (Tokuhyohei) No. 7-500926; dyes containing a carboxylic acid group described in JP-A No. 3-163440 and 6-301141, U.S. Pat. No. 5,441,899; merocyanine dyes, polynucleus merocyanine dyes and polynucleus cyanine dyes, as described JP-A No. 47-6329, 49-105524, 51-127719, 52-80829, 54-61517, 59-214846, 60-6750, 63-159841, 6-35109, 6-59381, 7-146537, 7-146547, JP-A (Toku-Hyo-Hei) No. 55-50111, British Patent No. 1,467,638, and U.S. Pat. No. 5,281,515. Dyes capable of forming a J-band, such as a dye described U.S. Pat. No. 5,510,236 and in Example 5 of U.S. Pat. No. 3,871,887, JP-A 2-96131 and 59-48753 are also preferably employed in this invention.

Sensitizing dyes exhibiting spectral sensitivity within the infrared region are preferably employed in this invention. Example of infrared-sensitizing dyes include those described in U.S. Pat. Nos. 4,536,473, 4,515,888, and 4,959,294. The infrared-sensitizing dye is a compound exhibiting spectral absorption within the wavelength region of 750 to 1100 nm.

Representative examples of the infrared-sensitizing dye are shown below, but are by no means limited to these.

Infrared-sensitizing dye 1

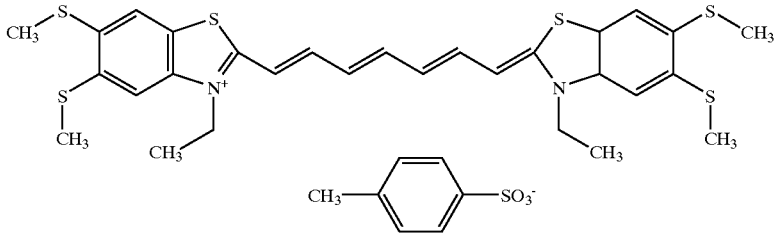

-continued
Infrared-sensitizing dye 2
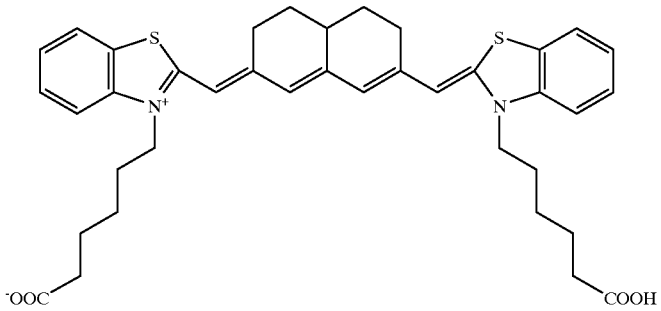
Infrared-sensitizing dye 3
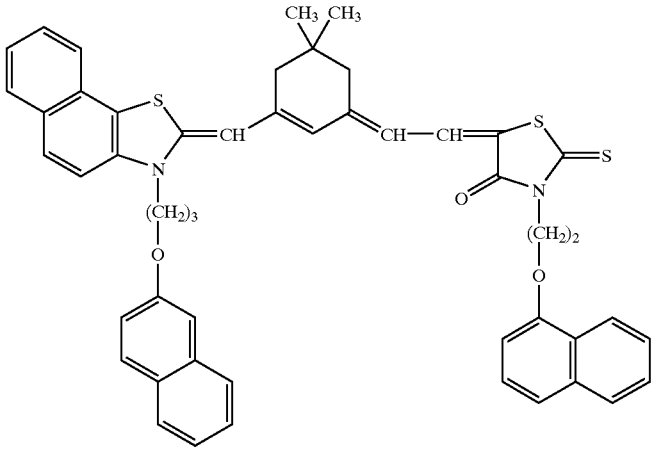
Infrared-sensitizing dye 4
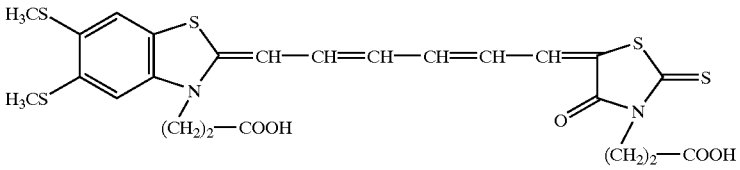
Infrared-sensitizing dye 5
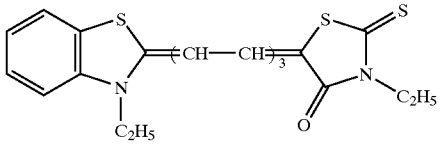
Infrared-sensitizing dye 6
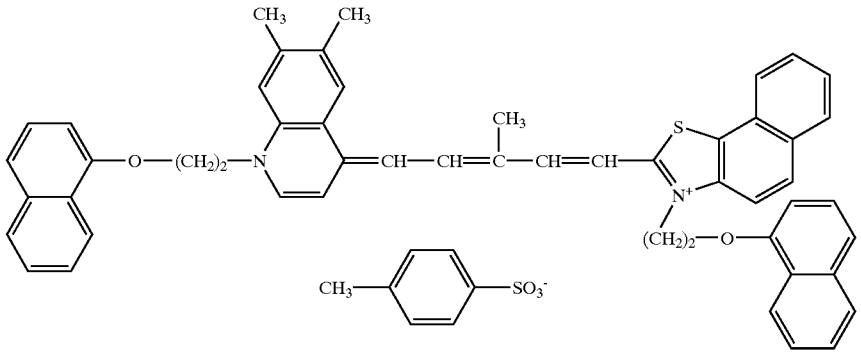

-continued
Infrared-sensitizing dye 7
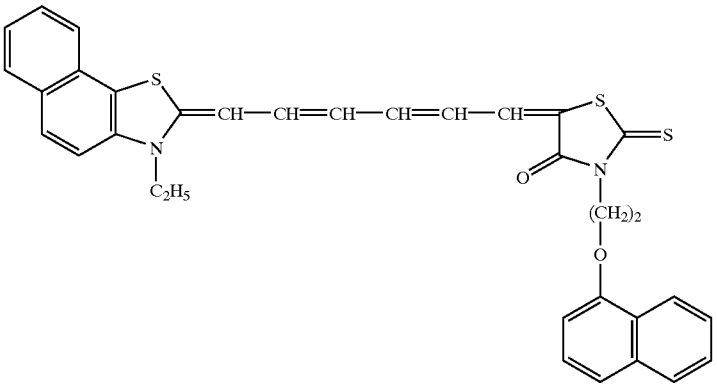
Infrared-sensitizing dye 8
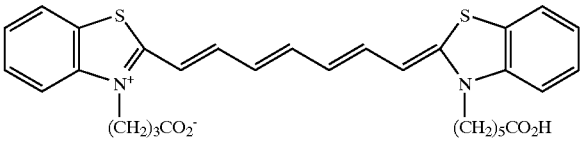
Infrared-sensitizing dye 9
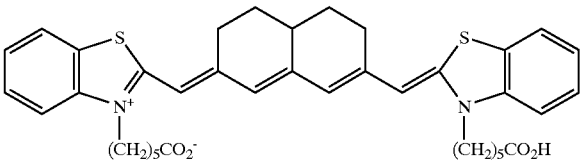
Infrared-sensitizing dye 10
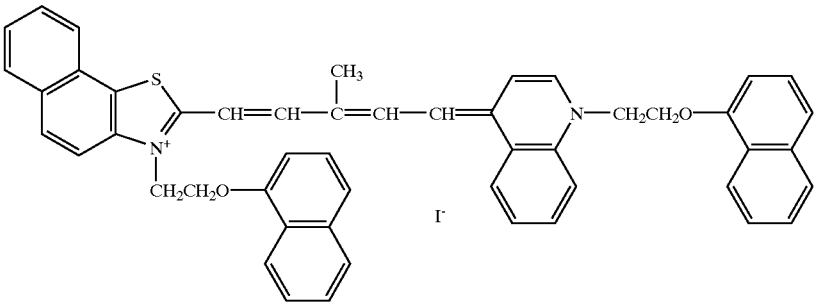
Infrared-sensitizing dye 11
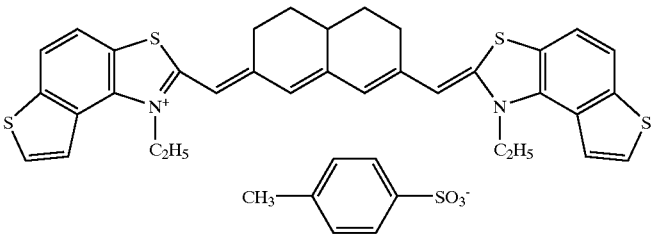

The infrared-sensitizing dye is used in an amount meeting photographic performance such as sensitivity and fog, and preferably $10^{-6}$ to 1 mol, and more preferably $10^{-4}$ to $10^{-1}$ mol per mol of silver halide contained in the light-sensitive layer.

Further, panchromatic sensitizing dyes are also preferably employed in this invention. The panchromatic sensitizing dye is a compound exhibiting spectral absorption with the wavelength region of 600 to 750 nm. Examples of the pachromatic sensitizing dye are shown below but are by no means limited to these.

Panchromatic sensitizing dye 1

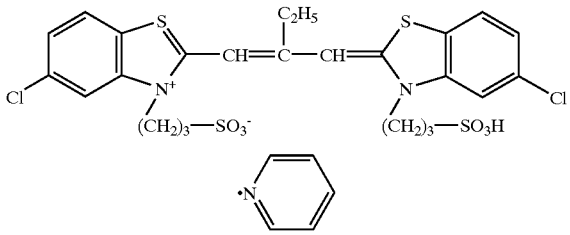

Panchromatic sensitizing dye 2

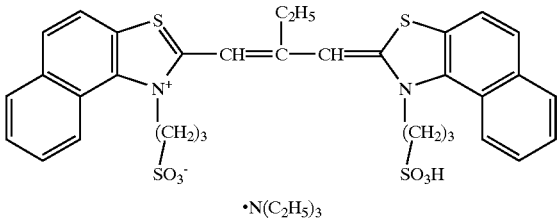

Panchromatic sensitizing dye 3

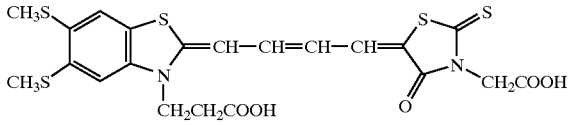

Panchromatic sensitizing dye 4

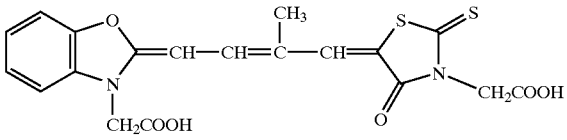

Panchromatic sensitizing dye 5

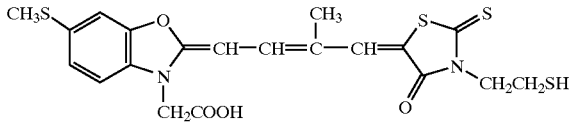

Panchromatic sensitizing dye 6

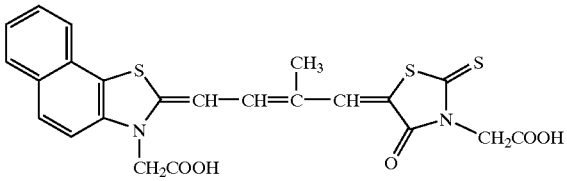

-continued

Panchromatic sensitizing dye 7

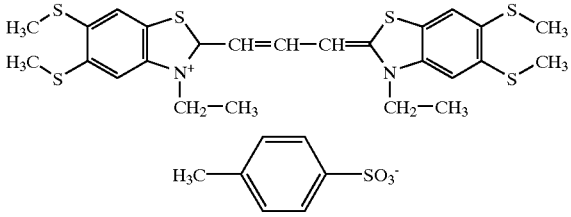

Panchromatic sensitizing dye 8

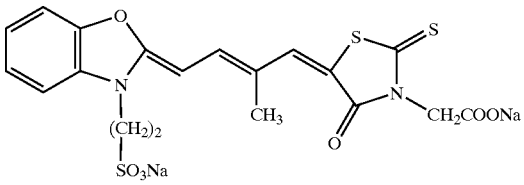

Panchromatic sensitizing dye 9

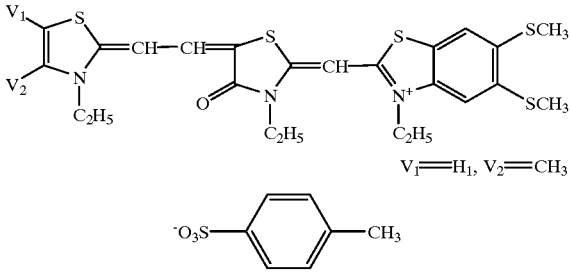

Panchromatic sensitizing dye 10

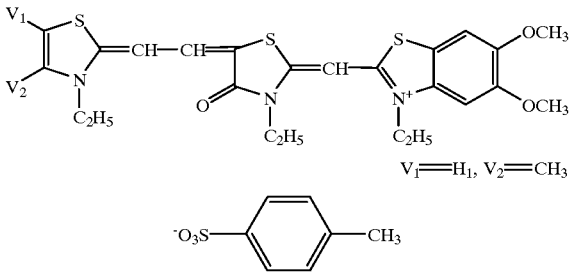

The panchromatic sensitizing dye is used in an amount meeting photographic performance such as sensitivity and fog, and preferably $10^{-6}$ to 1 mol, and more preferably $10^{-4}$ to $10^{-1}$ mol per mol of silver halide contained in the light-sensitive layer.

These dyes may be employed alone or in combination. For example, combined dyes are used for supersensitization. A dye having no spectral sensitizing ability or a substance having no absorption within the visible region, which exhibit supersensitization along with a spectral sensitizing dye, may be incorporated into a silver halide emulsion. Useful sensitizing dyes, combination of dyes exhibiting supersensitization and materials exhibiting supersensitization are described in RD 176, 17643, page 23, sect. IV-J, JP-B No. 49-25500, 43-4933 and JP-A 59-19032 and 59-192242. To incorporate a sensitizing dye into a silver halide emulsion, the dye may be directly dispersed in the emulsion, alternatively, the dye may be incorporated to the emulsion through solution in a solvent such as water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol, N,N-dimethylformamide. There can be also employed a technique of dissolving a dye in a volatile organic solvent, dispersing the solution in water or a hydrophilic colloidal medium and incorporating the dispersion into an emulsion, as described in U.S. Pat. No. 3,469,987; a technique of incorporating a dye into a silver halide emulsion through solution in an acid or incorporating the dye to the emulsion in the presence of an acid or base, as described in JP-b 44-23389, 44-27555 and 57-22091; a technique in which a dye is dissolved or dispersed in the presence of a surfactant to be incorporated to a silver halide emulsion, as described in U.S. Pat. No. 3,822,135; a technique in which a dye is directly dispersed in a hydrophilic colloidal medium and the dispersion is incorporated into a silver halide emulsion, as described in JP-A 53-102733 and 58-105141; a technique in which a dye is dissolved using a red-shifting compound and the solution is incorporated into a silver halide emulsion, as described in JP-A 51-74624. An ultrasonic homogenizer may be employed to dissolve a sensitizing dye. Sensitizing dyes may be added at any time during the process of emulsion preparation, for example, the process of forming silver halide emulsion grains and/or before desalting, during desalting and/or after desalting and before starting chemical ripening, as described in U.S. Pat. Nos. 2,735,766, 3,628,960, 4,183,756 and 4,225,666 and JP-A 58-184142 and 60-196749; and immediately before or during chemical ripening, or after chemical ripening and before coating, as described in JP-A 58-113920. Alternatively, a compound alone or in combination with another compound different in structure may be added separately, for example, during grain formation and during or after chemical ripening; or before, during and after chemical ripening. The compound to be added and the combination thereof may be optimally selected. The sensitizing dye can be incorporated in an intended amount so as to meet photographic performance such as sensitivity or fogging and preferably $10^{-6}$ to 1 mol, and more preferably $10^{-4}$ to $10^{-1}$ per mol of silver halide.

Light-insensitive organic silver salts used in this invention are those which are relative stable upon exposure to light and capable of forming silver images at a temperature of 80° C. or higher, in the presence of a light-exposed photocatalyst (such as latent images of silver halide) and a reducing agent. The organic silver salts usable in this invention include any organic compounds containing reducible silver ion source. Of organic silver salts are specifically preferred silver salts of long chain fatty acids (having 10 to 30 carbon atoms and more preferably 15 to 28 carbon atoms). Organic or inorganic silver complex salts exhibiting a stability constant of 4.0 to 10.0 are also preferred. Silver supplying material preferably accounts for 5 to 70% by weight of the image forming layer. Preferred organic silver salts include a silver salt of an organic carboxy group-containing compound. Examples thereof include silver salts of an aliphatic carboxylic acid and an aromatic carboxylic acid, but are not limited to these. Preferred silver salts of aliphatic carboxylic acids include, for example, silver behenate, silver arachidate, silver stearate, silver oleate, silver laurate, silver caproate, silver myristate, silver palmitate, silver maleate, silver fumarate, silver tartrate, silver linolate, silver butylate, silver camphorate and a mixture thereof.

Silver salts of mercapto group- or thione group-containing compounds are also usable in this invention. Preferred examples of such silver salts include 3-mercapto-4-phenyl-1,2,4-triazole silver salt, 2-mercaptobenzimidazole silver salt, 2-mercapto-5-aminothiadiazole silver salt, 2-(ethylglycolamido)benzothiazole silver salt, thioglycolic acid silver salt such as S-alkylthioglycolic acid silver salt (in which the alkyl group has 12 to 22 carbon atoms), dithiocarboxylic acid silver salt such as dithioacetic acid silver salt, thioamido silver salt, 5-carboxy-1-methyl-2-phenyl-4-thiopyridine silver salt, mercaptotriazine silver salt, 2-mercaptobenzoxazole silver salt, silver salts described in U.S. Pat. No. 4,123,274 including 1,2,4-mercaptothiazole silver salt such as 3-amino-5-benzylthio-1,2,4-thiazole silver salt, and a silver salt of a thione compound described in U.S. Pat. No. 3,301,678, such as 3-(3-carboxyethyl)-4-methyl-thiazoline-2-thione. Further, imino group containing compounds can also be employed. Preferred examples thereof include silver salts of benzotriazole and its derivatives such as methylbenzotriazole, halogen-substituted benzotriazole, e.g., 5-chlorobenzotriazole,1,2,4-triazole or 1-H-tetrazole described in U.S. Pat. No. 4,220,709, and silver salts of imidazole and its derivatives. There can be also employed silver acetylides described U.S. Pat. Nos. 4,761,361 and 4,775,613.

The shape of the organic silver salt is not specifically limited but needle crystals having a long axis (or longitudinal axis) and a short axis (lateral axis). Thus, needle crystals having a short axis of 0.01 to 0.20 $\mu$m and a long axis of 0.10 to 5.0 $\mu$m are preferred and needle crystals having a short axis of 0.01 to 0.15 and a long axis of 0.10 to 4.0 are more preferred. Particle size distribution of a silver salt is preferably monodispersed. Herein, the expression, monodispersed means that the standard deviation of the long axis length or the short axis length, divided by an average length of the long axis or short axis, respectively, is preferably 100 or less, more preferably not more than 80%, and still more preferably not more than 50%. The shape of an organic silver salt can be determined through transmission type electron microscopic observation. Alternatively, monodispersity of an organic silver salt can be defined by determining the standard deviation of a volume-weighted mean diameter and the standard deviation divided by a volume-weighted mean diameter (represented in terms of percentage) is preferably not more than 100%, more preferably not more than 80%, and still more preferably not more than 50%. For example, laser light is irradiated to organic silver salt particles dispersed in liquid and an auto-correction function can be determined with respect to time-variation of fluctuation of scattered light, from which the particle size (volume-weighted mean diameter) can be determined.

Organic silver salts used in this invention may be subjected to desalting. The method of desalting is not specifically limited but can be conducted in a commonly known manner. Filtration methods known in the art is preferably applied, including centrifugal filtration, suction filtration, ultrafiltration and washing through flock formation by coagulation.

In this invention, to obtain a solid particle dispersion of an organic silver salt exhibiting a high S/N ratio and having small particle sizes without causing coagulation, a dispersing method is preferably applied, in which an aqueous dispersion containing an organic silver salt and substantially no light-sensitive silver salt is transformed to a high-speed fluid flow, then causing pressure drop. After subjecting to such a process, the resulting aqueous dispersion is mixed with an aqueous light-sensitive silver salt dispersion to prepare a coating composition of a light-sensitive image-forming medium. Using the thus prepared coating composition, there can be obtained a photothermographic material exhibiting lowered haze, reduced fogging and enhanced sensitivity. On the contrary, in cases where a light-sensitive silver salt is concurrently present when dispersed through transforming to high speed fluid flow under high pressure, an increase of fogging and reduction of sensitivity result. The use of an organic solvent, as a dispersing medium, in place of water results in increased haze, increased fogging and reduced sensitivity. Further, in place of mixing the light-sensitive silver salt dispersion, conversion of a part of the organic silver salt into a light-sensitive silver salt results in reduction in sensitivity. In the foregoing, the aqueous dispersion solution obtained through dispersion at a high speed under high pressure substantially contains no light-sensitive salt and its content is not more than 0.1 mol %.

A solid dispersion apparatus used to conduct the dispersion method described above and techniques thereof are detailed, for example, in T. Kajiuchi & H. Fujii "Dispersion-system Rheology and dispersion technique" page357–403 (published by SHIZAN-SHA SHUPPAN, 1991), and "Progresses in Chemical Enginieering" vol. 24, page 184–185 edited by Kagakukogakukai, Tokai-shibu (published by MAKI-SHOTEN, 1990). In this dispersing method, at least an aqueous dispersion containing an organic silver salt is supplied to a pipe under pressure using a high pressure pump and allowed to pass through a narrow slit provided within the pipe, thereafter causing abrupt pressure drop therein to perform fine dispersion. In the high-pressure homogenizer used in this invention, it is contemplated that dispersion into fine particles is performed by dispersing power such as (a) shearing power produced when a dispersing medium passes through a narrow interstice at a high speed under a high pressure and (b) cavitation power produced when a dispersing medium is released from under high pressure to ordinary pressure. As such a dispersing apparatus is cited a Gaulin homogenizer, in which a mixture solution to be dispersed is supplied under a high pressure, converted to a high speed flow at an interstice on the cylindrical surface, collides with the surrounding walls at a high speed and dispersed by the resulting impact force to form an emulsion. The applied pressure is generally 10 to 60 MPa and the flow rate is with the range of a few meters to 30 m per second. To enhance dispersion efficiency, it is proposed that the high speed section in the form of a saw blade is employed to increase the collision number. Recently, there has been developed an apparatus enabling to conduct dispersion at a higher speed under a higher pressure. Representative examples thereof include Microfluidizer (available from Microfluidex International Corp.) and Nanomizer (vailable from TOKUSHUKIKA KoGYO Co., Ltd.). Specifically, dispersing apparatuses suitable for this invention include, for example, Microfluidizer M-110S-EH (fitted with an interaction chamber H10Z), M-110Y (fitted with an interaction chamber H10Z), M-140K (fitted with an interaction chamber H10Z), HC-5000 (fitted with an interaction chamber L30Z or H230Z), and HC-8000 (fitted with an interaction chamber E230Z or L30Z), each of which is available from Microfluidex International Corp.

Using the foregoing apparatus, an aqueous dispersion containing an organic silver salt is supplied to a pipe with applying pressure by means of a high pressure pump and allowed to pass through a narrow slit provided within the pipe, thereafter causing abrupt pressure drop and enabling to obtain a suitable organic silver salt dispersion.

An organic silver salt used in this invention can be dispersed to the desired particle size by adjusting the flow rate, the pressure difference at the time of pressure-dropping and the number of the dispersing treatment. The flow rate and the pressure difference at the time of pressure-dropping are preferably 200 to 600 m/sec and 90 to 300 MPa, and more preferably 300 to 600 m/sec and 150 to 300 MPa, respectively, in terms of photographic characteristics and particle size. The dispersing treatment number is optimally selected, and usually 1 to 10 times, and preferably 1 to 3 times in terms of productivity. It is not preferable to raise the temperature of the aqueous dispersion under high pressure in terms of dispersion property and photographic characteristics. Thus, at a temperature higher than 90° C., the particle size easily increases, but also fogging tends to be increased. Accordingly, before being converted to the high pressure and high flow rate, after being caused to be pressure-dropped, or before and after, it is preferred to provide a cooling stage to maintain the aqueous dispersion at a temperature of 5 to 90° C., preferably 5 to 80° C., and more preferably 5 to 65° C. Specifically, it is advantageous to provide such a cooling stage at the time when dispersed at a high pressure of 150 to 300 MPa. A cooling machine usable in this invention is optimally selected in accordance with the required heat-exchanging amount, including, for example, a double pipe or a double pipe provided with a static mixer, multiple heat-exchanger and a coiled heat-exchanger. To enhance the heat-exchanging efficiency, the diameter of the pipe and the thickness or material thereof can be selected taking account of the applied pressure. Well water of ca. 20° C., 5 to 10° C. water chilled by a refrigerator or a refrigerant of ethylene glycol/water maintained at −30° C. is optionally employed as a refrigerant used in the cooling machine.

In the dispersing procedure used in this invention, it is preferred to disperse the organic silver salt in the presence of aqueous soluble dispersing agents (or dispersion promoting agents). Examples of the dispersion promoting agents include synthetic anionic polymers such as polyacrylic acid, acrylic acid copolymer, maleic acid copolymer, maleic acid monoester copolymer, acrylomethylpropanesulfonic acid copolymer; semi-synthetic anionic polymers such as carboxtmethyl starch and carboxymethyl cellulose; anionic polymers such as alginic acid and pectinic acid; compounds described in JP-A 7-350753; commonly known anionic, cationic or nonionic surfactants, commonly known polymers such as polyvinyl alcohol, polyvinyl pyrrolidine, hydroxypropyl cellulose, and hydroxypropylmethyl cellulose; and natural polymers such as gelatin. Of these, polyvinyl alcohols and water-soluble cellulose derivatives are preferred.

In general, an organic silver salt in the form of powder or a wet cake is mixed with the dispersion promoting agent and supplied in the form of slurry to a dispersing apparatus. Alternatively, the thus mixed organic silver salt may be thermally treated or treated with a solvent to form the silver salt in a powdery or wet cake form. Using an appropriate pH adjusting agent, the pH may be controlled before, during or after dispersion. Besides mechanical dispersion, the organic silver salt may be coarsely dispersed through controlling a pH value and further dispersed in the presence of a dispersing agent by varying the pH to form fine particles. In such a case, organic solvents may be used as a solvent used in the stage of coarse dispersion and the organic solvent is removed after completion of the fine dispersion. Thus prepared dispersion can be stocked with stirring or in the state exhibiting a higher viscosity than hydrophilic colloid (for example, gelatin is used in a gelled form). The organic silver salt may be used in any amount but is preferably in an amount of 0.1 to 5 g, and more preferably 1 to 3 g/m$^2$, based on silver.

Photothermographic materials used relating to this invention preferably contain a reducing agent for organic silver salts. The reducing agent may be any material capable of reducing a silver ion to metallic silver, and preferably is an organic material. Commonly known photographic developing agents such as phenidone, hydroquinone and catechol are useful but hindered phenol type reducing agents are preferred. The reducing agent is contained preferably in an amount of 5 to 50 mol %, and more preferably 10 to 40 mol % per mol on silver of the image forming layer-side. In cases where contained in a layer other than the image forming layer, the amount is preferably 10 to 50 mol %. The reducing agent may be in the form of a so-called precursor, which is introduced so as to effectively function only at the time of development. A variety of reducing agents are usable in photothermographic material employing organic silver salts, as described in JP-A Nos. 46-6074, 47-1238, 47-33621, 49-4642, 49-115540, 50-14334, 50-36110, 50-147711, 51-32632, 51-102372, 51-32324, 51-51933, 52-84727, 55-108654, 56-16133, 57-82828, 57-82829, 6-3793; U.S. Pat. Nos. 3,667,058, 3,679,426, 3,751,252, 3,751,252, 3,751,255, 3,761,270, 3,782,949, 3,839,048, 3,928,686, 5,464,738; German Patent No. 2321328; and European patent No. 692732. Examples thereof include aldoximes such as phenylamidoxime, 2-thienylamidoxime and p-phenoxyphenylamidoxime; azines such as 4-hydroxy-3,5-dimethoxybenzaldehydeazine; a combination of fatty acid aryl hydrazide and ascorbic acid such as a combination of 2,2'-bis(hydroxymethyl)propionyl-β-phenylhydrazide; a combination of polyhydroxybenzene, and hydroxylamine, reductone and/or hydrazine, such as a combination of hydroquinone and bis(ethoxyethyl)hydroxylamine, piperidinohexose reductone and/or formyl-4-methylphenylhydrazine; hydroxamic acid such as phenylhydroxmic acid, p-hydroxyphenylhydroxamic acid, and β-anilinehydroxamic acid; a combination of azine and sulfonamidophenol such as phenothiazine and 2,6-dichloro-4-benzenesulfonamidophenol; -cyanophenylacetic acid derivatives such as ethyl-α-cyano-2-methylphenylacetate, and ethyl-α-cyanophenylacetate; bis-β-naphthol such as 2,2'-dihydroxy-1,1'binaphthyl, 6,6'-dibromo-2,2'-dihydroxy-1,1'-binaphthyl, and bis(2-hydroxy-1-naphthyl) methane; a combination of bis-β-naphthol and 1.3-dihydroxybenzene derivatives (such as 2,4-dihydoxybenzophenone, 2',4'-dihydroxyacetophenone, etc.); 5-pyrazolone such as 3-methyl-1-phenyl-5-pyrazolone; reductones such as dimethylaminohexose reductone, anhydrodihydroaminohexose reductone and anhydrodihydropiperidonehexose reductone; sulfonamidophenol reducing agents such as 2,6-dichloro-4-benzenesulfonamidophenol and p-benzenesulfonamidophenol; 2-phenylindane-1,3-dione; chroman such as 2,2-dimethyl-7-t-butyl-6-hydroxychroman; 1,4-dihydroxypyridine such as 2,6-dimethoxy-3,5-dicarboethoxy-1,4-dihydropyridine; bisphenols such as bis(2-hydroxy-3-t-butyl-5-methylphenyl) methane, 2,2-bis(4-hydroxy-3-methylphenyl)propane, 4,4-ethylidene-bis(2-t-butyl-6-methylphenol), 1,1-bis(2-hydroxy-3,5-dimethylphenyl)-3,5,5-trimethylhexane and 2,2-bis(3,5-dimethyl-4-hydroxyphenyl)propane; ascorbic acid derivatives such as palmotoc acid-1-ascorbyl and stearic acid-ascorbyl; aldehydes and ketones such as benzil and biacetyl; 3-pyrazolidone and indane-1,3-dione; and chromanols such as tocopherol. Preferred reducing agents are bisphenol and chromanol. Reducing agents used in this invention may be incorporated in any form such as solution, powder and solid particle dispersion. Solid particle dispersion can be achieved by commonly known means such as a ball mill, vibration ball mill, sand mill, colloid mill, jet mill and roller mill, in which dispersing agents may be employed.

In this invention, the photothermographic material preferably contains a compound represented by the following formula (5):

formula (5)

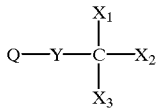

wherein Q represents an aryl group or a heterocyclic group; $X_1$, $X_2$ and $X_3$ each represent a hydrogen atom, a halogen atom, an acyl group, an alkoxycarbonyl group, aryloxycarbonyl group, a sulfonyl group or an aryl group, provided that at least one of $X_1$, $X_2$ and $X_3$ is a halogen atom; and Y represents —C(=O)—, —SO— or —$SO_2$—.

The compound represented by formula (5) will be further described. In this invention it is effective to employ a compound capable of deactivating a reducing agent so that the thus deactivated reducing agent is incapable of reducing an organic silver salt. As such a compound, compounds capable of releasing a halogen atom as an active species are employed and the compound represented by formula (5) is specifically preferred.

In formula (5), the aryl group represented by Q may be a monocyclic or a condensed cyclic compound, preferably being one having 6 to 30 carbon atoms (e.g., phenyl, naphthyl), more preferably a phenyl group, a naphthyl group, and still more preferably a phenyl group.

The heterocyclic group represented by Q a 3- to 10-membered saturated or unsaturated heterocyclic group containing at least one of N, O, and S atoms, which may be a monocycle or may form a cycle condensed with another ring.

The heterocyclic group is preferably a 5- or 6-membered unsaturated heterocyclic group, which may condense with another ring, more preferably a 5- or 6-membered aromatic heterocyclic group, which may condense with another ring, and still more preferably a 5- or 6-membered aromatic heterocyclic group containing 1 to 4 nitrogen atoms, which may condense with another ring. A heterocyclic ring of the heterocyclic group is preferably imidazole, pyrazolo, pyridine, pyrimidine, pyrazine, pyridazine, triazole, triazine, indole, indazole, purine, thiadiazole, oxadiazole, quinoline, phthalazine, naphthylidine, quinoxaline, quinazolone, cinnoline, pteridine, tetrazole, thiazole, oxazole, benzimidazole, benzoxazole, benzthiazole, indolenine, or tetrazaindene; more preferably imidazole, pyridine, pyrimidine, pyrazine, pyridazine, triazole, triazine, thiadiazole, oxadiazole, quinoline, phthalazine, naphthylidine, quinoxaline, quinazolone, cinnoline, tetrazole, thiazole, oxazole, benzimidazole, benzoxazole, benzthiazole, or tetrazaindene; and still more preferably pyridine, thiadiazole, quinoline and benzthiazole.

The aryl group or heterocyclic group represented by Q may be substituted. Examples of the substituent group include an alkyl group, an alkenyl group, an aryl group, an alkoxy group, an aryloxy group, an acyloxy group, an acyl group, an alkoxycarbonyl group, an aryloxycarbonyl group, an acyloxy group, an acylamino group, an alkoxycarbonylamino group, an aryloxycarbonylamino group, a sulfonylamino group, a sulfamoyl group, carbamoyl group, a sulfonyl group, a ureido group, a phosphoric acid amide group, a halogen atom, cyano group, sulfo group, a carboxy group, nitro group, and a heterocyclic group. Of these, an alkyl group, an aryl group, an alkoxy group, an aryloxy group, an acyl group, an acylamino group, an alkoxycarbonylamino group, an aryloxycarbonylamino group, a sulfonylamino group, a sulfamoyl group, carbamoyl group, a ureido group, a phosphoric acid amide group, a halogen atom, cyano group, nitro group, and a heterocyclic group are preferred, and an alkyl group, an aryl group and a halogen atom are more preferred.

$X_1$, $X_2$ and $X_3$ each are preferably a halogen atom, a haloalkyl group, an acyl group, an alkoxycarbonyl group, an aryloxycarbonyl group, a carbamoyl group, a sulfamoyl group, a sulfonyl group or a heterocyclic group; more preferably a haloalkyl group, an acyl group, an alkoxycarbonyl group, an aryloxycarbonyl group, or a sulfonyl group; and still more preferably a halogen atom, or a trihalomethyl group; and still more preferably a halogen atom. Of halogen atoms, chlorine atom, bromine atom and iodine atom are preferred, chlorine atom and bromine atom are more preferred, and a bromine atom still more preferred. Y is —C(=O)—, —SO—, or —$SO_2$— and preferably —$SO_2$—.

Examples of the compound represented by formula (5) are shown below but are by no means limited to these.

5-1

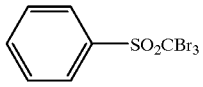

5-2

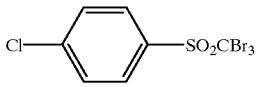

5-3

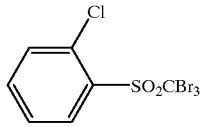

5-4

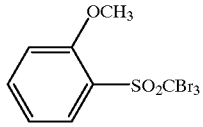

5-5

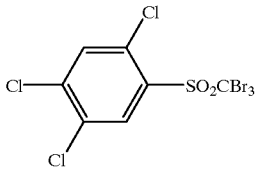

5-6

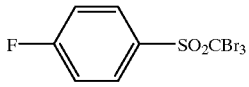

5-7

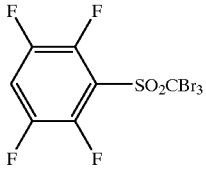

5-8

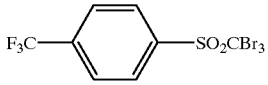

-continued 5-9

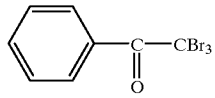

5-10

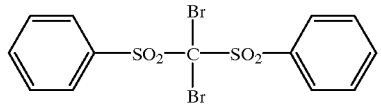

5-11

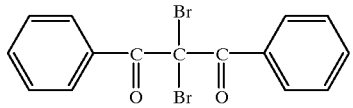

5-12

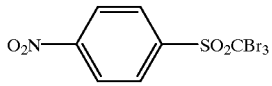

5-13

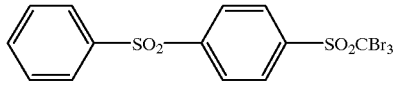

5-14

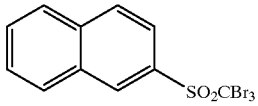

5-15

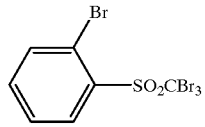

5-16

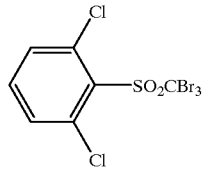

5-17

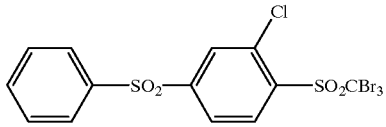

5-18

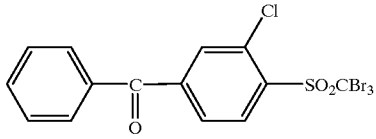

5-19

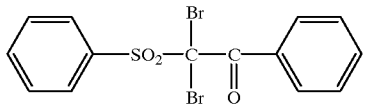

5-20

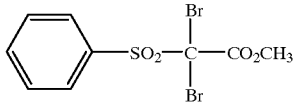

-continued
5-21
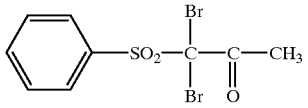
5-22
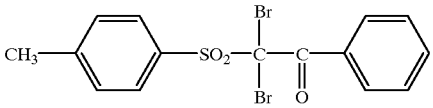
5-23
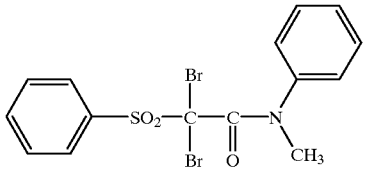
5-24
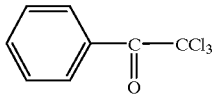
5-25
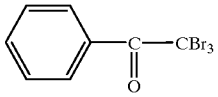
5-26
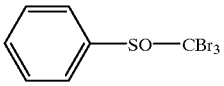
5-27
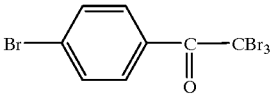
5-28
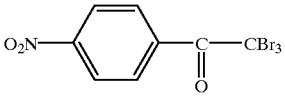
5-29
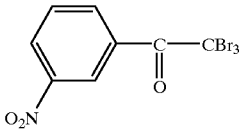
5-30
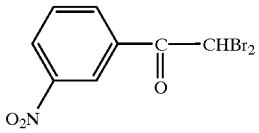
5-31
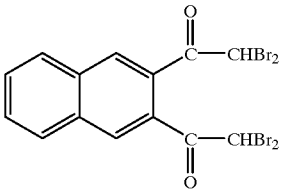
-continued
5-32
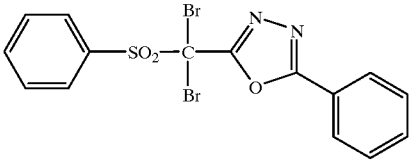
5-33
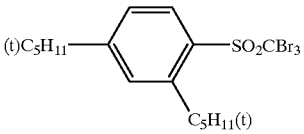
5-34
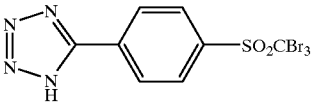
5-35
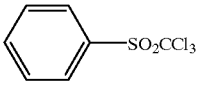
5-36
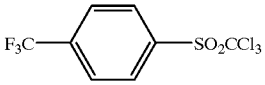
5-37
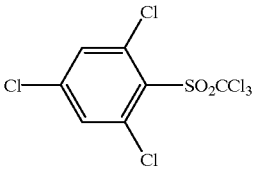
5-38
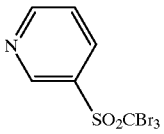
5-39
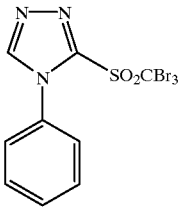
5-40
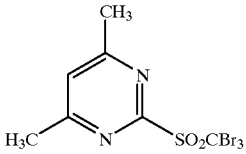
5-41
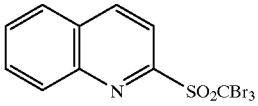

-continued
5-42
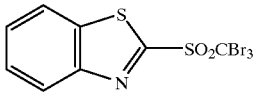
5-43
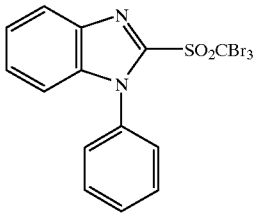
5-44
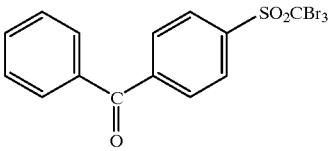
5-45
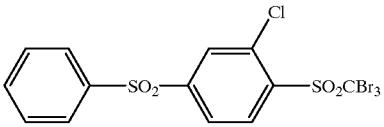
5-46
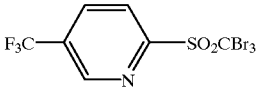
5-47
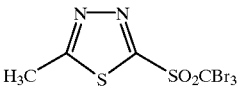
5-48
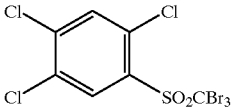
5-49
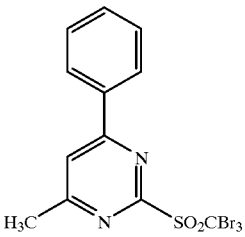
5-50
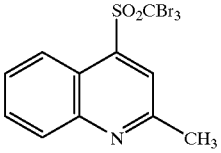
5-51
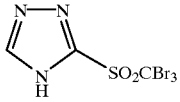
-continued
5-52
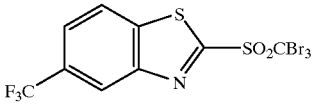
5-53
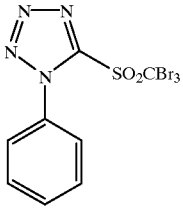
5-54
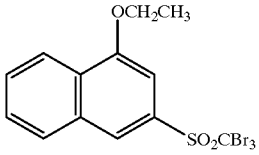
5-55
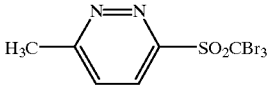
5-56
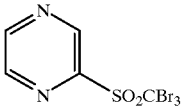
5-57
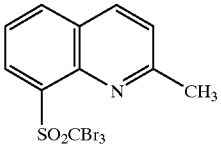
5-58
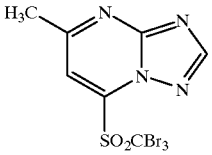
5-59
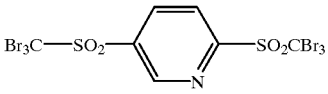
5-60
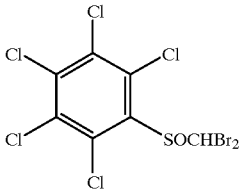

-continued 5-61

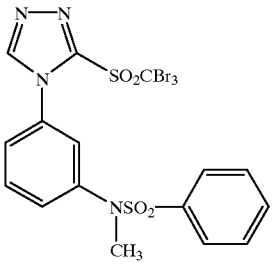

5-62

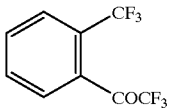

5-63

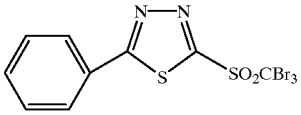

5-64

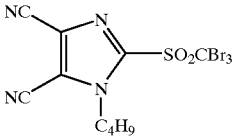

5-65

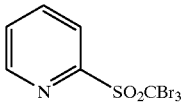

At least an image forming layer of the photothermographic material used in this invention preferably contains a polymeric latex in an amount of not less than 50% by weight, based on the total binder used in the image forming layer. Such a polymeric latex may be used not only in the image forming layer but also in a protective layer or a backing layer. In cases where the photothermographic material according to this invention is applied to graphic arts use in which one of major problems is dimensional stability, for example, it is preferred to incorporate a polymer latex into the protective layer or a backing layer. Herein, the polymeric latex is a water-insoluble polymeric material which is dispersed in an aqueous dispersing medium in the form of fine particles. The dispersion form thereof may be any one of a form in which a polymer is emulsified in a dispersing medium, a form of being emulsion-polymerized, being dispersed in the form of a micell and a form in which a polymer has a hydrophilic partial structure and its molecular chain is in the form of a molecular dispersion. The polymeric latexes are described in "Synthetic Resin Emulsion" (edited by T. Okuda and h. Inagaki, published by KOBUNSHI-KANKOKAI, 1978), "Application of Synthetic Latex" (edited by Sugimura et al., published by KOBUNSHI-KANKOKAI, 1993), and "Chemistry of Synthetic Latex" (S. Muroi, published by KOBUNSHI-KANKOKAI, 1970). The mean particle size of dispersing particles is 1 to 50,000 nm, and preferably 5 to 1,000 nm. The particle size distribution thereof is not specifically limited and may be polydispersed or monodispersed. The polymeric latexes used in the invention may be those having a uniform structure as well as core/shell type latexes. In this case, it is sometimes preferred that the glass transition temperature is different between the core and shell. The preferred range of the glass transition point of a polymer of the polymeric latex used as a binder is different between image forming layer and protective or backing layer. In cases where used in the image forming layer, the glass transition point is preferably −30 to 40° C. to promote diffusion of photographically useful materials at the time of thermal development. In cases where used in the protective layer or backing layer, the glass transition point is preferably 25 to 70° C. The minimum forming (or tarnishing) temperature (MFT) of the polymeric latexes is preferably 30 to 90° C., and more preferably 0 to 70° C. A tarnishing aid is also called a plasticizer, which is an organic compound (conventionally, an organic solvent) capable of lowering the MFT of a polymeric latex and described in "Chemistry of Synthetic Latex" (S. Muroi, published by KOBUNSHI-KANKOKAI, 1970).

Polymers used for polymeric latexes include acryl resin, vinyl acetate resin, polyester resin, polyurethane resin, rubber type resin, vinyl chloride resin, vinylidene chloride resin, polyolefin resin and their copolymers. Polymers may be a straight-chained polymer or branched polymer, or a cross-linked polymer, including homopolymers and copolymers. The copolymer may be a random copolymer or a block copolymer. The number-averaged molecular weight of the copolymer is preferably 5,000 to 1000,000, and more preferably 10,000 to 100,000. In cases where the molecular weight is excessively small, mechanical strength of an image forming layer such as a light-sensitive layer is insufficient, excessively large molecular weight results in deterioration in film forming property.

Exemplary examples of polymeric latexes used as binder include a latex of methylmethacrylate/ethylmethacrylate/methacrylic acid copolymer, a latex of methylmethacrylate/2-ethylhexylacrylate/styrene/acrylic acid copolymer, a latex of styrene/butadiene/acrylic acid copolymer, a latex of styrene/butadiene/divinylbenzene/methacrylic acid copolymer, a latex of methylmethacrylate/vinyl chloride/acrylic acid copolymer, and a latex of vinylidene chloride/ethylacrylate/acrylonitrile/methacrylic acid copolymer. Such polymers are commercially available, and examples of commercially available acryl resin include Sevian A-4635, 46583, and 4601 (available from DAISEL CHEMICAL INd. Ltd.)Nipol Lx811, 814, 821, 820, and 857 (available from NIHON ZEON Co. Ltd. Examples of polyester resin include FINETEX ES650, 611, 675, 850 (available from DAINIPPON INK CHEMICAL Co. Ltd.), and WD-size WMS (available from Eastman Kodak Corp.). Examples of polyurethane resin include HYDRAN AP10, 20, 30, 40 (available from DAINIPPON INK CHEMICAL Co. Ltd.). Examples of rubber resin include LACSTAR 7310K, 3307, 4700H, 7132C (available from DAINIPPON INK CHEMICAL Co. Ltd.); and Nipol Lx416, 410, 438C and 2507 (available from NIHON ZEON Co. Ltd.). Examples of vinylidene chloride resin include L502, L513 (available from ASAHI CHEMICAL IND. Co. Ltd.). Examples of olefin resin include CHEMIPAL s120, SA100 (available from MITSUI PETROLEUM CHEMICAL IND. Co. Ltd.). These polymers can be used alone or may be blended.

In this invention, the main binder in the light-sensitive layer, alternatively, the expression of the binder, which is mainly comprised of polymeric latex means that preferably, at least 50% by weight, and more preferably at least 70% by weight of the whole binder in the light-sensitive layer is accounted for by the polymer, i.e., polymeric latex used in the invention. The binder may be a polymer alone or blended polymers. In addition to the polymeric latex, hydrophilic polymers such as gelatin polyvinyl alcohol, methyl cellulose or hydroxypropyl cellulose may be optionally incorporated into the light-sensitive layer (or emulsion layer). The hydrophilic polymer is incorporated preferably in an amount of not more than 30% by weight, and more preferably not more than 15% by weight of the whole binder.

The image forming layer is preferably formed by coating a water-based coating solution, followed by drying. Herein, the expression, water-based means that at least 60% by weight of the solvent (or dispersing medium) contained in the coating solution is water. As solvents other than water, there can be usable water-miscible organic solvents such as methyl alcohol, ethyl alcohol, isopropyl alcohol, methyl cellosolve, ethyl cellosolve, dimethylformamide and ethyl acetate. Exemplary solvent composition other than water include water/methanol=90/10, water/methanol=70/30, water/ethanol=90/10, water/isopropanol=90/10, water/dimethylformamide=95/5, water/methanol/dimethylformamide=80/15/5, and water/methanol/dimethylformamide=90/5/5, in which numerals are represented by weight percentage. The total binder amount of the image forming layer is 0.2 to 30 g/m$^2$, and more preferably 1 to 15 g/m$^2$. The image forming layer may contain a cross-linking agent to cure the binder or a surfactant to improve coatability.

The silver halide emulsion and/or organic silver salt used in this invention can be protected from additional fogging by using antifoggant, a stabilizer or a stabilizer precursor and reduction in sensitivity during storage can be prevented. Antifoggants, stabilizers and stabilizer precursors which are usable alone or in combination include, for example, thiazonium salts described in U.S. Pat. Nos. 2,131,038 and 2,694,716; azaindenes described in U.S. Pat. Nos. 2,886,437 and 2,444,605; mercury salts described in U.S. Pat. No. 2,728,663; urazoles described in U.S. Pat. No. 3,287,135; sulfocatechols described in U.S. Pat. No. 3,235,652; oximes, nitron and nitroindazoles described in British patent No. 623,448; polyvalent metal salts described in U.S. Pat. No. 2,839,405; thironium salts described in U.S. Pat. No. 3,220,839; palladium, platinum and gold salts described in U.S. Pat. Nos. 2,566,263 and 2,597,915; organic halogen-substituted compounds described in U.S. Pat. Nos. 4,108,665 and 4,442,202; triazines described in U.S. Pat. Nos. 4,128,557, 4,137,079, 4,138,365 and 4,459,350; and phosphorus compounds described in U.S. Pat. No. 4,411,985.

Preferred antifoggants used in this invention are organic halogen compounds, as described in JP-A Nos. 50-119624, 50-120328, 51-121332, 54-58022, 56-70543, 56-99335, 59-90842, 61-129642, 62-129845, 6-208191, 7-5621, 7-2781, 8-15809; U.S. Pat. Nos. 5,340,712, 5,369,000 and 5,464,737.

Antifoggants used in this invention may be incorporated in any form such as solution, powder and solid particle dispersion. Solid particle dispersion can be achieved by commonly known means such as a ball mill, vibration ball mill, sand mill, colloid mill, jet mill and roller mill, in which dispersing agents may be employed.

Mercury (II) salts may be advantageously incorporated, as an antifoggant, into the image forming layer. Preferred mercury (II) salts are mercury acetate and mercury bromide. The mercury salt is incorporated preferably in an amount of $10^{-9}$ to $10^{-3}$, and more preferably $10^{-8}$ to $10^{-4}$ mol/mol Ag.

Benzoic acids may be incorporated into photothermographic materials used in this invention for the purpose of enhancing sensitivity or anti-fogging. Preferred benzoic acids are those described in U.S. Pat. Nos. 4,784,939 and 4,152,160; Japanese Patent Application Nos. 8-98051, 8-141241, and 8-151242. The benzoic acids may be incorporated into any position of the photothermographic material but is preferably incorporated into any layer on the light-sensitive layer-side, and more preferably into a layer containing an organic silver salt. The benzoic acids may be added at any time during the course of preparing a coating solution. In cases where added into the organic silver salt-containing layer, for example, the benzoic acids may be added at any time of preparation of an organic silver salt to preparation of a coating solution thereof, and is preferable added at a time after the preparation of an organic silver salt and immediately before coating. The benzoic acids may be added in any form, including powder, solution and solid particle dispersion. Alternatively, it may be added in the form of a solution of a mixture with a sensitizing dye, a reducing agent or image toning agent. The benzoic acids are incorporated preferably in an amount of $10^{-6}$ to 2, and more preferably $10^{-3}$ to 0.5 mol/mol Ag.

Mercapto compounds, disulfide compounds or thione compounds are advantageously used to control the developing rate or to enhance spectral sensitization efficiency, or to enhance storage stability before or after being subjected to development. Specifically, compounds represented by formula: Ar—SM or Ar—S—S—Ar, wherein M is a hydrogen atom or an alkali metal atom; Ar is an aromatic ring or condensed aromatic ring containing a nitrogen atom, oxygen atom, sulfur atom, selenium atom or tellurium atom. Such aromatic heterocyclic rings are preferably benzimidazole, naphthoimidazole, benzthiazole, naphthothiazole, benzoxazole, naphthooxazole, benzoselenazole, benzotellurazole, imidazole, oxazole, pyrazole, triazole, triazines, pyrimidine, pyridazine, pyrazine, pyridine, purine, and quinoline. Other aromatic heterocyclic rings may also be included. The aromatic heterocyclic rings described above may be substituted with a halogen atom (e.g., Cl, Br, I), a hydroxy group, an amino group, a carboxy group, an alkyl group (having one or more carbon atoms, and preferably 1 to 4 carbon atoms) or an alkoxy group (having one or more carbon atoms, and preferably 1 to 4 carbon atoms). Examples of mercapto group-substituted aromatic heterocyclic compounds include 2-mercaptobenzimidazole, 2-mercaptobenzoxazole, 2-mercaptobenzthiazole, 5-methyl-2-mercaptobenzimidazole, 6-ethoxy-2-mercaptobenzthiazole, 2,2'-dithiobis(benzthiazole), 3-mercapto-1,2,4-triazole, 4,5-diphenyl-2-imidazole, 2-mercaptoimidazole, 1-ethyl-2-mercaptobenzimidazole, 2-mercaptoquinoline, 8-mercaptopurine, 2-mercapto-4(3H)-quinazoline, 7-trifluoromethyl-4-quinolinethiol, 2,3,5,6-tetrachloro-4-pyridinethiol, 4-amino-6-hydroxy-2-mercaptopyridine monohydrate, 2-amino-5-mercapto-1,3,4-thiazole, 3-amino-5-mercapto-1,2,4-triazole, 4-hydroxy-2-mercaptopyridine, 2-mercaptopyridine, 4,6-diamino-2-mercaptopyridine, 2-mercapto-4-methylpyrimidine hydrochloride, 3-mercapto-5-phenyl-1,2,4-riazole, 2-mercapto-4-phenyloxazole. These compounds are preferably incorporated into an emulsion layer, in an amount of 0.0001 to 1.0 mol, and more preferably 0.001 to 0.3 mol per mol of silver.

The light-sensitive layer may contain, as a plasticizer or lubricant, polyhydric alcohols (e.g., glycerine or diols described in U.S. Pat. No. 2,960,404), fatty acids or their esters described in U.S. Pat. Nos. 2,588,765 and 3,121,060 and silicone resin described in British Patent No. 955,061.

Photothermographic materials relating to this invention may be provided with a surface protective layer to prevent adhesion. Any polymer may be usable as a binder for the surface protective layer and a carboxy group-containing polymer is preferably contained in an amount of 0.1 to 5 g/m$^2$. Examples of the carboxy group containing polymer include natural polymers (e.g., gelatin, alginic acid, etc.), modified natural polymers (carboxymethyl cellulose, phthalated gelatin, etc.), synthetic polymers (polymethacrylate, polyacrylate, co(alkylmethacrylate/acrylate)polymer, co(styrene/methacrylate)polymer). The content of the carboxy group is preferably 10 mmol to 1.4 mol per 100 g of a polymer. The carboxy group may form a salt with an alkali metal ion, an alkaline earth metal ion or an organic cation.

The surface protective layer may use an adhesion-preventing material. Examples of the adhesion-preventing material include wax, silica particles, styrene-containing block copolymer elastomer (e.g., styrene-butadiene-styrene, styrene-isoprene-styrene, etc.), cellulose acetate, cellulose acetate-butylate, cellulose propionate, and their mixture. The surface protective layer may contain a cross-linking agent to cure the binder or a surfactant to improve coatability.

A light-absorbing material or a filter dye described in U.S. Pat. Nos. 3,253,921, 2,274,782, 2,527,583 and 2,956,879 may be contained in the light-sensitive layer or the protective layer thereof. Dyes may be mordanted, as described in U.S. Pat. No. 3,282,699. The filter dye is preferably contained in an amount corresponding to an absorbance of 0.1 to 3.0, and more preferably 0.2 to 1.5 at the exposing light wavelength.

The light-sensitive layer may contain various dyes or pigments. Examples of the dyes or pigments are those described in color index, including pyrazoloazole dyes, anthraquinone dyes, azo dyes, azomethine dyes, oxonol dyes, carbocyanine dyes, styryl dyes, triphenylmethane dyes, indoaniline dyes, indophenol dyes, phthalocyanine dyes, organic pigments and inorganic pigments. Exemplary preferred dyes include anthraquinoe dyes (e.g., Compounds 1 through 9 described in JP-A 341441, Compounds 3–6 through 3–18, 3–23 through 3–38 described in JP-A 5-165147), azomethine dyes (e.g., Compounds 17 through 47 described in JP-A 5-341441), indoaniline dyes (e.g., Compounds 11 through 19 described in JP-A 5-289227, Compound 47 described in JP-A 5-341441, Compounds 2–10 and 2–11 described in JP-A 5-165147), and azo dyes (Compounds 10 through 16 described in JP-A 5-341441). These dyes may be added in the form of solution, emulsion or solid particle dispersion, or in the form of a dye mordanted with a polymeric mordant. The dye is preferably contained in an amount of 1 $\mu$g to 1 g per m$^2$.

The photothermographic material relating to this invention preferably comprises on one side of a support at least a light-sensitive layer containing a silver halide emulsion and on the other side of the support a backing layer, that is, a so-called single-coated photothermographic material is preferred.

The backing layer preferably exhibits a maximum absorbance of 0.3 to 2.0 at the desired wavelength region. In cases where the desired region is 750 to 1400 nm, the optical density is preferably 0.005 to 0.5 at the wavelengths of 360 to 750, and an antihalation layer exhibiting an optical density of 0.001 to 0.3 is more preferred. In cases the desired region is less than 750 nm, the maximum absorbance before image formation preferably is 0.3 to 2.0 within the desired region, and an antihalation layer exhibiting an optical density of 0.005 to 0.3 after image formation is more preferred. A method for reducing the optical density after image formation to the above-described range is not specifically limited and examples thereof include a technique of reducing the dye density through decolorization on heating, as described in Belgian Patent No. 733,706; reduction in density through decolorization upon exposure to light, as described in JP-A 54-17833.

Antihalation dyes usable in this invention include any compound having an intended absorption within the desired wavelength region, exhibiting sufficiently reduced absorption within the visible region after processing and leading to preferred absorption spectrum of the backing layer. Examples thereof include dyes described in JP-A 59-56458, 2-216140, 7-13295, 7-11432, and U.S. Pat. No. 5,380,635; compounds described in JP-A 2-68539, page 13, left lower column, line 1 to page 14, left lower column, line 9, JP-A 3-24539, page 14, left lower column to page 16, right lower column; and dyes decolorizable on processing as described in JP-A 52-139136, 53-132334, 56-501480, 57-16060, 57-68831, 57-101835, 59-182436, 7-36145, 7-199409, JP-B 48-33692, 50-16648, 2-41734, U.S. Pat. Nos. 4,088,497, 4,283,487, 4,548,896 and 5,187,049.

Binders suitable for the backing layer are transparent or semi-transparent and generally colorless, including natural polymers, synthetic resin, polymers and copolymers, and medium capable of forming film, such as gelatin, gum Arabic, poly(vinyl alcohol), hydroxyethyl cellulose, cellulose acetate, cellulose acetate-butyrate, poly(vinyl pyrrolidine), casein, starch, poly(acrylic acid), co(styrene-maleic acid)polymer, co(styrene-acrylonitrile)polymer, co(styrene-butadiene)polymer, poly(vinyl acetal) [e.g., poly (vinyl formal, poly(vinyl butyral)), polyesters, polyurethanes, phenoxy resin, poly(vinylidene chloride), polyepoxides, polycarbonates, poly(vinyl acetate)cellulose esters, and polyamides. The binder may be formed through water, an organic solvent or emulsion.

In the single-coated photothermographic material relating to this invention, a matting agent may be incorporated into the surface protective layer on the light-sensitive layer-side and/or a backing layer or the surface protective layer of the backing layer to improve transportability. Matting agents are, in general, fine organic or inorganic water-insoluble particles of an organic or inorganic compound. Any matting agent may be used, including organic matting agents described in U.S. Pat. Nos. 1,939,213, 2,701,245, 2,322,037, 3,262,782, 3,539,344, and 3,767,448; and inorganic matting agents described in U.S. Pat. Nos. 1,260,772, 2,192,241, 3,257,206, 3,370,951, 3,523,022 and 3,769,020. Exemplary organic compounds usable as a matting agent include water-dispersible vinyl polymers such as polymethyl acrylate, polymethyl methacrylate, polyacrylonitrile, acrylonitrile-$\alpha$-methylstyrene copolymer, polystyrene, styrene-divinylbenzene copolymer, polyvinyl acetate, polyethylenecarbonate, and polytetrafluoroethylene; cellulose derivatives such as methyl cellulose, cellulose acetate, cellulose acetate-propionate; starch derivatives such as carboxy-starch, carboxynitrophenyl-starch, urea-formaldehyde-starch reaction product, gelatin hardened with commonly known hardeners and hardened gelatin which has been hardened through coacervation and is in the form of a capsulated hollow body. Examples of inorganic compounds include silicon dioxide, titanium dioxide, magnesium dioxide, aluminum oxide, barium sulfate, calcium carbonate, silver chloride or silver bromide which has been de-sensitized according to the commonly know method, and diatomaceous earth. The foregoing matting agent may be used alone or in combination. The size or shape of a matting agent is not specifically limited and any particle size may be usable. The particle size is preferably 0.1 to 30 $\mu$m. The particle size distribution of a matting agent may be narrow or broad. In general, matting agents greatly affect haze or glossiness of the photothermographic material so that the particle size, shape or size distribution of a matting agent are optimally adjusted by blending plural kinds of matting agents.

It is preferred to incorporate a matting agent into a backing layer. In this case, the backing layer exhibits preferably, as a measure of a matting degree, a Beck's surface smoothness degree of 10 to 250 sec., and more preferably 50 to 180 sec. In this invention, matting agents are preferably incorporated into the outermost surface layer, a layer functioning as the outermost surface layer, a layer closest to the outermost surface layer, or a layer functioning as a so-called protective layer. The matting degree of a protective layer for the emulsion layer may be at any level of producing no star-like spot but the Beck's surface smoothness degree is preferably 10 to 10,000 sec, and more preferably 10 to 2,000 sec.

A photographic emulsion for photothermographic use is a constituent in one or more layers provided in the support. In the single layer arrangement, the layer comprises an organic silver salt, silver halide, a reducing agent, a binder, an image toning agent, a coating aid and other auxiliary adjuvant(s). In the double layer arrangement, the first emulsion layer (which is close to the support) contains an organic silver salt and silver halide, and the second layer or both layers contain other constituents. There is also realized a double layer arrangement which comprises a single emulsion layer containing all constituents and a protective top-coat. In a multi-layer color photothermographic material, this two layer combination for each color may be included. Alternatively, all constituent may be contained, as described in U.S. Pat. No. 4,708,928. In the case of a multi-dye, as described in U.S. Pat. No. 4,460,681, multi-color photothermographic material, each emulsion layer (light-sensitive layer) is distinguished from the other by a functional or non-functional barrier layer provided between emulsion layers. As described in U.S. Pat. Nos. 4,460,681 and 4,374,921, a backside resistive heating layer is also applicable to photothermographic materials relating to this invention.

Hardening agents may be employed in the light-sensitive layer, protective layer or backing layer. Examples of the hardening agents include poly-isocyanates described in U.S. Pat. No. 4,281,060, and JP-A 6-208193, epoxy compounds described in U.S. Pat. No. 4,791,042, and vinylsulfon compounds described JP-A 60-89048. Surfactants may be employed to improve coatability and antistatic property. Nonionic, anionic, cationic surfactants and fluorinated surfactants are employed. Exemplary examples thereof include fluorinated polymeric surfactants described in JP-A 62-170950 and U.S. Pat. No. 5,380,644, fluorinated surfactant described in JP-A 60-244945 and 63-188135, polysiloxan type surfactants described in U.S. Pat. No. 3,885,965, and polyalkyleneoxide and anionic surfactants described in JP-A 6-301140.

Photographic emulsions for photothermographic use are coated on a support. Exemplary supports include polyester film, subbed polyester film, polyethylene terephthalate film, polyethylene naphthalate film, cellulose nitrate film, cellulose ester film, polyvinyl acetal film, polycarbonate film, relevant resin materials, glass, paper and metal. There are typically employed baryta paper and a paper support coated with resin such as partially acetylated α-olefin polymer, specifically, α-olefin polymer having 2 to 10 carbon atoms, such as polyethylene, polypropylene, or ethylene-butene copolymer. The support may be transparent or opaque, but preferably is transparent. Bi-axially stretched polyethylene terephthalate (PET) film is also preferred.

When plastic resin film is allowed to pass through a thermal processor at a temperature of 80° C. or higher, the film generally elongates or shrinks. In cases where the processed photothermographic material is employed for graphic arts use, such dimensional variation causes serious problems in high definition multi-color printing. In this invention it is accordingly preferred to employ films exhibiting little dimensional variation, in which internal strain remained in the film at the time of biaxially stretching is relaxed and thermal shrinkage strain produced during thermal processing is minimized. For example, polyethylene terephthalate which has been subjected to a thermal treatment at a temperature of 100 to 210° C. is preferred. Resins exhibiting a high glass transition point are also preferred, including polyether ethylketone, polystyrene, polysulfone, polyethersulfone, polyacrylate and polycarbonate.

Photothermographic materials relating to this invention may have a layer containing a water-soluble salt (such as a chloride or nitrate), vapor-deposited metal layer, ionic polymers described in U.S. Pat. Nos. 2,861,056 and 3,206,312, water-insoluble inorganic salts described in U.S. Pat. No. 3,428,451 or fine tin oxide particles described in JP-A 60-252349 and 57-104931.

Examples of a method for obtaining color images by the use of the photothermographic material according to this invention include one described in JP-A 7-13295, page 10, left column, line 43 to page 11, left column, line 40. Stabilizers for color dye images include, for example, those described in British Patent No. 1,326,889, U.S. Pat. Nos. 3,432,300, 3,698,909, 3,574,627, 3,573,050, 3,764,337 and 4,042,394.

The photographic emulsion for photothermographic use can be coated by various coating procedure, such as dip-coating, air-knife coating, flow coating, and extrusion coating by a hopper, as described in U.S. Pat. No. 2,681,294. Two or more layers can be simultaneously coated by the methods described in U.S. Pat. No. 2,761,791 and British Patent No. 837,095.

The photothermographic material may be provided with an additional layer such as a dye receiving layer to receive transferred dye images, an opaque layer for reflection print, protective top-coat layer, primer layer known in the photographic art. In this invention, it is preferred to obtain images from one photographic material sheet and it is therefore preferred that a functional layer necessary to form images, such as an image receiving layer is not separated from the photographic material.

Photothermographic materials relating to this invention may be thermally developed in any manner, but are, after imagewise exposure, developed by heating. Preferred embodiments of a thermal processing machine include contact-type thermal processors, in which a photothermographic material is brought into contact with a heat source such as a heated roller or a heated drum, as described in JP-B 5-56499, Japanese Patent No. (Tokkyo-Koho) 684453, JP-A 9-292695 and 9-297385 and International Patent WO95/30934; and a non-contact type thermal processors, as described in JP-A 7-13294, International Patent WO97/28489, WO97/28488 and WO97/28487. Of these, non-contact type thermal processors are preferred. The developing temperature is preferably 80 to 250° C., and more preferably 100 to 140° C.; and the developing time is 1 to 180 sec., and more preferably 10 to 90 sec.

To prevent processing unevenness caused by dimensional change during thermal processing, it is effective to heat the photothermographic material at a temperature of 80 to 115° C. (preferable not higher than 130° C. for at least 5 sec. and then subject to thermal development to form images(i.e., so-called multiple heating method).

The photothermographic material relating to this invention may be exposed in any manner and an exposure light source is preferably laser light of 600 nm or more. Preferred laser light used in this invention include gas laser, YAG laser, dye laser, and semiconductor laser. The semiconductor laser may be used in combination with a second harmonic generator. Photothermographic materials relating to this invention tend to produce interference fringes at the time of exposure to light. Techniques for preventing an interference fringe include, for example, a technique described in JP-A 5-113548, in which laser light is obliquely incident on the photothermographic material and the use of multi-mode laser described in International patent WO95/31754. Photothermographic materials are preferably exposed so that laser beams are overlapped to eliminate scanning lines.

EXAMPLES

The present invention will be further described based on examples but are by no means limited to these.

Example 1

Preparation of Photographic Support

Both sides of a 175 μm thick PET film blue-tinted with a density of 0.170 (which was measured by densitometer PDA-65, available from Konica Corp.) were subjected to corona discharge at 8 w/m$^2$.

Preparation of Light-sensitive Silver Halide Emulsion

In 900 ml of deionized water were dissolved 7.5 g of gelatin having an average molecular weight of 100,000 and 10 mg of potassium bromide. After adjusting the temperature and the pH to 35° C. and 3.0, respectively, 370 ml of an aqueous solution containing 74 g silver nitrate and an equimolar aqueous solution containing potassium bromide, potassium iodide (in a molar ratio of 98 to 2) and $1\times10^{-4}$ mol/mol Ag of iridium chloride were added over a period of 10 minutes by the controlled double-jet method, while the pAg was maintained at 7.7. Thereafter, 4-hydroxy-6-methyl-1,3,3a,7-tetraazaindene was added and the pH was adjusted to 5 using NaOH. There was obtained cubic silver iodobromide grains having an average grain size of 0.06 μm, a variation coefficient of the projection area equivalent diameter of 10 percent, and the proportion of the {100} face of 87 percent. The resulting emulsion was flocculated to remove soluble salts, employing a flocculating agent and after desalting, 0.1 g of phenoxyethanol was added and the pH and pAg were adjusted to 5.9 and 7.5, respectively to obtain silver halide emulsion.

Preparation of Powdery Organic Silver Salt

In 4720 ml water at 80° C. were dissolved 111.4 g of behenic acid, 83.8 g of arachidic acid and 54.9 g of stearic acid. Further thereto was added 540.2 ml of aqueous 1.5M sodium hydroxide solution with stirring at a high-speed and after adding 6.9 ml of concentrated nitric acid, the mixture was cooled to 55° C. to obtain an aqueous fatty acid sodium salt solution. Then, 450 ml water was added thereto, 760.6 ml of aqueous 1M silver nitrate solution was added in 2 min., and after stirring for 20 min., the reaction mixture was filtered to remove soluble salts and washed with deionized water until the filtrate reached a conductivity of 2 μS/cm. After being subjected to centrifugal dehydration, the obtained solid product was dried with hot air at a temperature of 37° C. until the weight thereof was not reduced. Thus, powdery organic silver salt was obtained.

Preparation of Light-sensitive Emulsion-dispersing Solution

In 1457 g methyl ethyl ketone was dissolved 14.57 g of polyvinyl butyral powder (Butvar B-79, available from Monsanto Corp.) and further thereto was gradually added 500 g of the powdery organic silver salt with stirring by a dissolver type homogenizer. Thereafter, the mixture was dispersed using a media type dispersion machine (available from Gettzmann Corp.), which was packed 1 mm Zr beads (available from Toray Co. Ltd.) by 80%, at a circumferential speed of 13 m and for 0.5 min. of a retention time with a mill to obtain photosensitive emulsion dispersing solutions.

Preparation of Light-sensitive Layer Coating Solution

To 500 g of the light-sensitive emulsion dispersing solution, 100 g of methyl ethyl ketone (MEK) was added with stirring and maintained at 21° C. Pyridinium hydrobromide per bromide (PHP) of 0.45 g was added thereto and stirred for 1 hr., then, calcium bromide (3.25 ml of 10% methanol solution) was further added and stirred for 30 min. Then the following compounds added, stirred for 1 hr, then, cooled to 13° C. and further stirred for 30 min.

| | |
|---|---|
| Sensitizing dye-1 | 7 mg |
| 4-Chloro-2-benzoylbenzoic acid | 1.75 g |
| Supersensitizer (as shown in Table 1) | 0.00085 mole |

Further thereto, 48 g of polyvinyl butyral was added and dissolved, while being maintained at 13° C., and the following additives were added:

| | |
|---|---|
| Desmodu N3300 (aliphatic isocyanate, available from Movey Corp.) | 1.10 g |
| Tetrachlorophthalic acid | 0.5 g |
| Phthalazine (as shown in Table 1) | 0.009 mole |
| Phthalic acid (as shown in Table 1) | 0.003 mole |
| Reducing agent 1,1-bis(2-hydroxy-3,5-dimethylphenyl)-2-methylpropane | 15 g |

Sensitizing dye-1

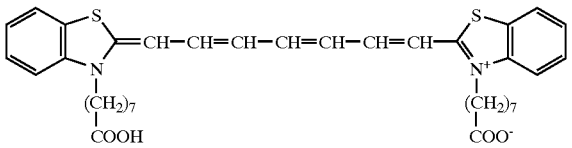

Coating and Drying

The thus obtained coating solution of light-sensitive layer was maintained at 13° C. and coated on the support described above. Drying was conducted at 75° C. for a period of 5 min.

Protective Layer Coating

A solution of the following composition was coated so as to have a wet thickness of 100 μm and then dried.

| | |
|---|---|
| Acetone | 175 ml |
| Methanol | 15 ml |
| Cellulose acetate-butyrate | 8 g |
| Phthalazine | 1.0 g |
| Tetrachlorophthalic acid anhydride | 0.5 g |
| Monodisperse silica (av. particle size 4 μm) | 1 wt %, based on binder |

Back Layer Coating

A solution of the following composition was coated so as to have a wet thickness of 80 μm and dried to obtain nine samples.

| | |
|---|---|
| Polyvinyl butyral (10% MEK solution) | 150 ml |
| Dye-B | 70 ml |
| Dye-C | 70 ml |

Dye-B

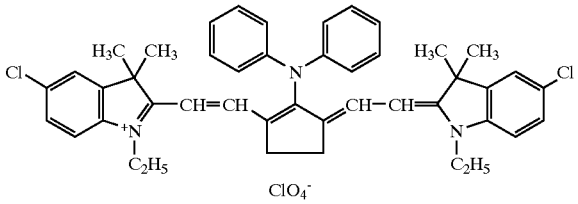

Dye-C

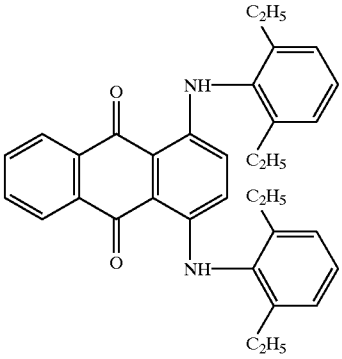

Evaluation

Photothermographic material samples each were evaluated according to the following procedure. Results thereof are shown in Table 1.

Exposure and Development

The thus prepared photothermographic material samples were each subjected to laser scanning exposure from the emulsion side using an exposure apparatus having a light source of 800 to 820 nm semiconductor laser of longitudinal multi-mode, which was made by means of high frequency overlapping. In this case, exposure was conducted at an angle between the exposed surface and exposing laser light was 75° and in an atmosphere at a temperature of 23° C. and 50% RH (and as a result, images with superior sharpness were unexpectedly obtained, as compared to exposure at an angle of 90°). Using an automatic processor provided with a heated drum, thereafter, exposed samples were subjected to thermal development at 110° C. for 15 sec., while bringing the protective layer surface of the photothermographic material into contact with the drum surface. The thermal development was conducted in an atmosphere at 23° C. and 50% RH.

Contrast

Optical densities of the thus obtained images were measured using densitometer PDA-65, available from Konica Corp. and the difference between the maximum and minimum densities was defined as a contrast.

Uniformity in Solid Density

Solid density images in the middle tone region, exhibiting an average optical density of 1.6±0.1 were measured with respect to 100 portions and a standard deviation thereof (σ) was defined as a measure of fluctuation (or unevenness). Thus, evaluation was made based on the following criteria:

| | |
|---|---|
| 5: $\sigma < 0.01$ | level markedly improved in density uniformity |
| 4: $0.01 \leqq \sigma < 0.015$ | level improved in density uniformity |
| 3: $0.015 \leqq \sigma < 0.025$ | good level of commercially available products |
| 2: $0.025 \leqq \sigma < 0.045$ | usual level of commercially available products |
| 1: $0.045 \leqq \sigma < 0.065$ | poor level of commercially available products (including coating streaks and unevenness) |

TABLE 1

| Sample No. | Supersensitizer | Phthalazine | Phthalic Acid | Contrast | Density Uniformity | Remark |
|---|---|---|---|---|---|---|
| 1 | MMBI | 1-11 | 3-1 | 3.36 | 2 | Comp. |
| 2 | 4-1 | 1-1 | 3-1 | 3.41 | 5 | Inv. |
| 3 | 4-1 | 1-4 | 3-1 | 3.57 | 5 | Inv. |
| 4 | 4-1 | 1-8 | 3-1 | 3.45 | 5 | Inv. |
| 5 | 4-1 | 2-1 | 3-1 | 3.47 | 5 | Inv. |
| 6 | 4-1 | 2-7 | 3-1 | 3.40 | 5 | Inv. |
| 7 | 4-1 | 2-17 | 3-1 | 3.45 | 5 | Inv. |
| 8 | 4-1 | 1-11 | 3-2 | 3.43 | 5 | Inv. |
| 9 | 4-1 | 1-11 | 3-7 | 3.45 | 5 | Inv. |
| 10 | 4-20 | 1-4 | 3-1 | 3.65 | 5 | Inv. |

MMBI: 5-methyl-2-mercaptobenzimidazole

Example 2

Preparation of a Subbed PET Photographic Support

Both surfaces of a biaxially stretched thermally fixed 175 μm PET film, available on the market, was subjected to corona discharging at 8 w/m$^2$·min. Onto one side of the film, the subbing coating composition a-1 descried below was applied so as to form a dried layer thickness of 0.8 μm, which was then dried. The resulting coating was designated Subbing Layer A-1. Onto the opposite surface, the subbing coating composition b-1 described below was applied to form a dried layer thickness of 0.8 μm. The resulting coating was designated Subbing Layer B-1.

| Subbing coating composition a-1 | |
|---|---|
| Latex solution (solid 30%) of a copolymer consisting of butyl acrylate (30 weight %), t-butyl acrylate (20 weight %) styrene (25 weight %) and 2-hydroxy ethyl acrylate (25 weight %) | 270 g |
| (C-1) | 0.6 g |
| Hexamethylene-1, 6-bis(ethyleneurea) | 0.8 g |
| Water to make | 1 liter |

| Subbing coating composition b-1 | |
|---|---|
| Latex liquid (solid portion of 30%) of a copolymer consisting of butyl acrylate (40 weight %) styrene (20 weight %) glycidyl acrylate (25 weight %) | 270 g |
| (C-1) | 0.6 g |
| Hexamethylene-1, 6-bis(ethyleneurea) | 0.8 g |
| Water to make | 1 liter |

Subsequently, the surfaces of Subbing Layers A-1 and B-1 were subjected to corona discharging with 8 w/m$^2$·minute. Onto the Subbing Layer A-1, the upper subbing layer coating composition a-2 described below was applied so as to form a dried layer thickness of 0.8 $\mu$m, which was designated Subbing Layer A-2, while onto the Subbing Layer B-1, the upper subbing layer coating composition b-2 was applied so as to form a dried layer thickness of 0.8 $\mu$m, having a static preventing function, which was designated Subbing Upper Layer B-2.

| Upper subbing layer coating composition a-2 | |
|---|---|
| Gelatin in an amount (weight) to make 0.4 g/m$^2$ | |
| (C-1) | 0.2 g |
| (C-2) | 0.2 g |
| (C-3) | 0.1 g |
| Silica particles (av. size 3 $\mu$m) | 0.1 g |
| Water to make | 1 liter |

| Upper subbing layer coating composition b-2 | |
|---|---|
| (C-4) | 60 g |
| Latex solution (solid 20% comprising) (C-5) as a substituent | 80 g |
| Ammonium sulfate | 0.5 g |
| (C-6) | 12 g |
| Polyethylene glycol (average molecular weight of 600) | 6 g |
| Water to make | 1 liter |

(C-1)

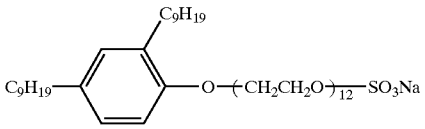

-continued (C-2)

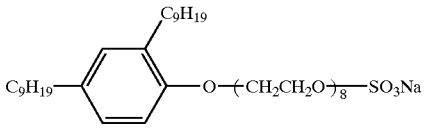

(C-3)

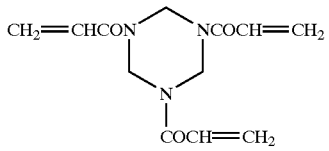

(C-4)

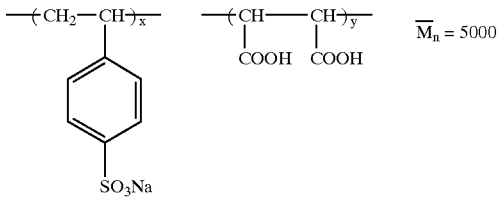

($\overline{M}$n is a number average molecular weight)
x:y = 75:25 (weight ratio)

(C-5)

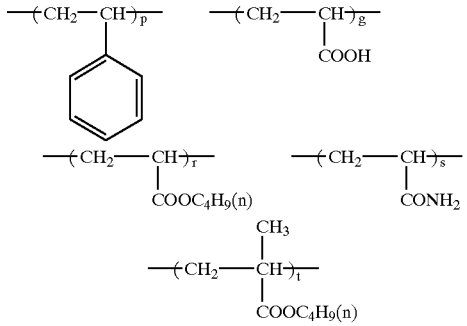

p:g:r:s:t = 40:5:10:5:40 (weight ratio)

(C-6)

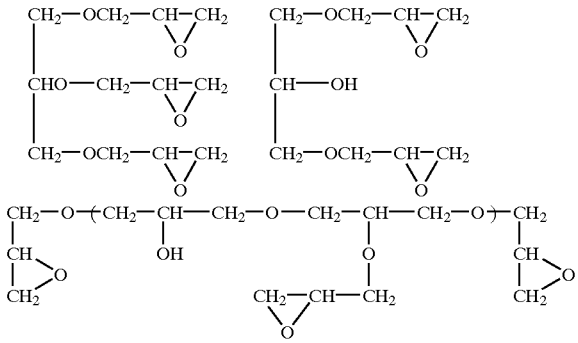

Mixture consisting of the three compounds illustrated above

Thermal Treatment of Support

The thus subbed support was heated at 140° C. and gradually cooled in the foregoing subbing process.

Preparation of Light Sensitive Silver Halide Emulsion

In 900 ml of deionized water were dissolved 7.5 g of gelatin and 10 mg of potassium bromide. After adjusting the temperature and the pH to 35° C. and 3.0, respectively, 370 ml of an aqueous solution containing 74 g silver nitrate and an equimolar aqueous solution containing potassium bromide, potassium iodide (in a molar ratio of 98 to 2), $1\times10^{-6}$ mol/mol Ag of $Ir(NO)Cl_5$ and $1\times10^{-6}$ mol/mol Ag of rhodium chloride were added over a period of 10 minutes by the controlled double-jet method, while the pAg was maintained at 7.7 and then the pH and pAg were maintained at 8.7 and 7.7, respectively to perform reduction sensitization. Thereafter, 4-hydroxy-6-methyl-1,3,3a,7-tetraazaindene was added and the pH was adjusted to 5 using NaOH. There was obtained cubic silver iodobromide grains having an average grain size of 0.06 μm, a variation coefficient of the projection area equivalent diameter of 11 percent, and the proportion of the {100} face of 87 percent. The resulting emulsion was flocculated to remove soluble salts, employing a flocculating agent and after desalting, 0.1 g of phenoxyethanol was added and the pH and pAg were adjusted to 5.9 and 7.5, respectively to obtain silver halide emulsion A.

Preparation of Aqueous Sodium Behenate

In 945 ml water were dissolved 32.4 g of behenic acid, 9.9 g of arachidic acid and 5.6 g of stearic acid at 90° C. The, after adding 98 ml of 1.5M aqueous sodium hydroxide solution with stirring and further adding 0.93 ml of concentrated nitric acid, the solution was cooled to a temperature of 55° C. to obtain an aqueous organic acid sodium salt solution.

Preparation of Pre-form Emulsion

To the solution were added 15.1 g of the silver halide emulsion obtained above and the pH was adjusted to 8.1 with aqueous sodium hydroxide. Subsequently, 147 ml of 1M aqueous silver nitrate solution was added in 7 min. and stirring continued further for 20 min., then, the reaction mixture was subjected to ultrafiltration to remove aqueous soluble salts. The obtained silver behenate was comprised of particles having a average particle size of 0.8 μm and a degree of monodispersity of 8%. After forming flog of the dispersion, water was removed, water washing and removal of water were repeated six times, then the product was dried to obtain a perform emulsion.

Preparation of Light Sensitive Emulsion

To the obtained perform emulsion, 544 g of methyl ethyl ketone solution (17% by weight) of polyvinyl butyral (mean molecular weight of 3000) and 107 g of toluene were gradually added and dispersed by 28 MPa.

Preparation of Photothermographic Material

Backing Layer Coating

The backing layer coating solution having the following composition was coated on the side of the upper sublayer B-2 of the support by an extrusion coater so as to form a wet layer thickness of 30 μm and dried at 60° C. for 3 min.

Backing Layer Coating Solution

| | |
|---|---|
| Cellulose acetate butyrate (10% methyl ethyl ketone solution) | 15 ml/m$^2$ |
| Infrared dye 1 | 14 mg/m$^2$ |
| Matting agent, monodisperse silica having monodispersity of 15% and average size of 10 μm | 30 mg/m$^2$ |
| $C_9F_{19}$—$C_6H_4$—$SO_3Na$ | 10 mg/m$^2$ |
| Infrared dye 1 | |

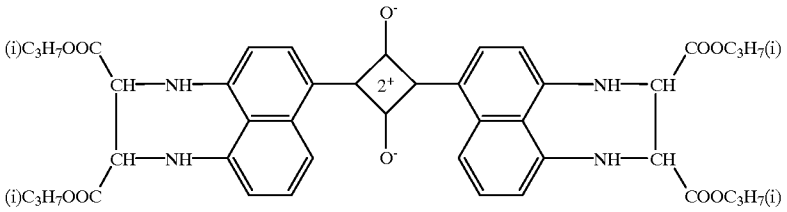

Light Sensitive Layer-side Coating

The light sensitive layer coating solution of the following composition was coated on the sublayer A-2 side of the support and further thereon, the protective layer coating solution was simultaneously coated by an extrusion coater at a coating speed of 20 m/min so as to form a silver coverage of 2.4 mg/m$^2$. Drying was conducted at 55° C. for 15 min.

Light sensitive layer coating solution

| | |
|---|---|
| Pre-form emulsion | 240 g |
| Sensitizing dye (Table 2) | $7.0\times10^{-2}$ mmol/Ag mol |
| Compound of formula (4) (Table 2) | 5.0 mmol/Ag mol |
| Macrocyclic compound (Table 2) | 3.0 mmol/Ag mol |
| Antifoggant 1 (6% methanol solution) | 3 ml |
| Calcium bromide (0.1% methanol solution) | 1.7 ml |
| Antifoggant 2 (10% methanol solution) | 1.2 ml |
| 2-(4-Chlorobenzoyl)-benzoic acid (12% methanol solution) | 9.2 ml |
| 2-Mercaptobenzimidazole (1% methanol solution) | 11 ml |
| Antifoggant 3 (5% methanol solution) | 17 ml |
| Reducing agent (20% methanol solution) | 29.5 ml |
| Phthalazinone | 0.6 g |
| 4-Methylphthalic acid | 0.25 g |
| Tetrachlorophthalic acid | 0.2 g |
| Antifoggant 2 | |

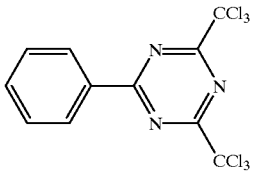

-continued

Antifoggant 1

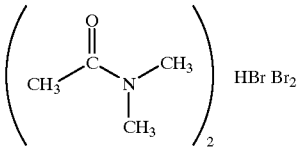

Antifoggant 3

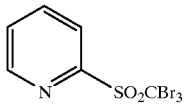

Surface Protective Layer Coating Solution

| | |
|---|---|
| Acetone | 5 ml/m$^2$ |
| Methyl ethyl ketone | 21 ml/m$^2$ |
| Cellulose acetate | 2.3 g/m$^2$ |
| Methanol | 7 ml/m$^2$ |
| Phthalazinone | 250 mg/m$^2$ |
| Matting agent, monodisperse silica having monodispersity of 10% and a mean size of 4 $\mu$m | 70 mg/m$^2$ |
| $CH_2{=}CHSO_2CH_2CH_2OCH_2CH_2SO_2CH{=}CH_2$ | 35 mg/m$^2$ |
| $C_9H_{19}{-}C_6H_4{-}SO_3Na$ | 10 mg/m$^2$ |

Photothermographic material samples No. 11 to 20 were thus prepared using sensitizing dyes and compounds of formula (4), as shown in Table 2, provided that the compound of formula (4) was added 30 min. after addition of the sensitizing dye.

The thus prepared photothermographic material samples were evaluated according to the following procedure.

Exposure and Development

The thus prepared photothermographic material samples were each subjected to laser scanning exposure from the emulsion side using an exposure apparatus having a light source of 800 to 820 nm semiconductor laser of longitudinal multi-mode, which was made by means of high frequency overlapping and then thermally developed. In this case, exposure was conducted at an angle between the exposed surface and exposing laser light was 75° (and as a result, images with superior sharpness were unexpectedly obtained, as compared to exposure at an angle of 90°).

Sensitometric Evaluation

Unexposed areas of the developed samples were measured with respect to a fog density (denoted as "Fog" in the Table). The less the value thereof, the better. Sensitivity (also denoted as "S") was represented by relative value of reciprocal of exposure necessary to a density of a fog density plus 1.0.

Thermostatic Aging Test

Three sheets of each of the photothermographic material samples put in a sealed vessel maintained at 25° C. and 55% RH and were allowed to stand in a thermostatic chamber maintained at 55° C. for 7 days (denoted as Aging-2). Separately, the sample put in the sealed vessel was allowed to stand at room temperature for 7 days (also denoted as Aging-1). The second sheet of each aged sample was exposed to 830 nm laser diode at an angle of 13° from vertical line to the sample surface and thermally developed at 120° C. for 15 sec. using a heated drum. The thus processed samples were measured with respect to sensitivity and fog density.

Results are shown in Table 2.

TABLE 2

| | Compound | | | Photographic Performance | | | |
|---|---|---|---|---|---|---|---|
| | | | | Aging-1 | | Aging-2 | |
| Sample No. | Formula (4) | Sensitizing Dye | Macrocyclic Compound | Fog | S | Fog | S |
| 11 | 4-20 | 4 | S-19 | 0.220 | 165 | 0.255 | 150 |
| 12 | 4-20 | 7 | S-19 | 0.215 | 160 | 0.245 | 150 |
| 13 | 4-20 | 36 | S-19 | 0.215 | 170 | 0.240 | 155 |
| 14 | 4-20 | 39 | S-19 | 0.215 | 165 | 0.240 | 150 |
| 15 | 4-22 | 36 | S-19 | 0.230 | 240 | 0.255 | 225 |
| 16 | 4-25 | 36 | S-19 | 0.230 | 250 | 0.255 | 230 |
| 17 | 4-28 | 36 | S-19 | 0.220 | 165 | 0.245 | 150 |
| 18 | 4-20 | 64 | S-19 | 0.215 | 150 | 0.240 | 125 |
| 19 | 4-20 | 31 | S-19 | 0.220 | 155 | 0.250 | 140 |
| 20 | 4-20 | 56 | S-19 | 0.220 | 155 | 0.255 | 140 |

As can be seen from Table 2, photothermographic materials exhibited enhanced sensitivity and reduced fog density, and superior storage stability (Aging-2).

Example 3

Aqueous-coated Photothermographic Material

Preparation of Organic Silver Salt Dispersion

In 850 ml water at 90° C. were dissolved 36 g of behenic acid, 4 g of arachidic acid and 7 g of stearic acid. Further thereto was added 187 ml of aqueous 1.0M sodium hydroxide solution with stirring at a high-speed and reacted for 120 min. After adding 71 ml of 1 mol/l nitric acid, the mixture was cooled to 50° C. to obtain an aqueous fatty acid sodium salt solution. Then, 125 ml of aqueous 21 g silver nitrate solution was added in 2 min., and after stirring for 20 min., the reaction mixture was filtered to remove soluble salts and washed with deionized water until the filtrate reached a conductivity of 2 $\mu$S/cm. The thus obtained solids content was added 100 g of aqueous 10 wt % polyvinyl alcohol solution (PVA 205, available from KURARE Co., Ltd.) and water was added to make 270 g in total and coarsely dispersed in an automatic mortar to obtain an organic silver salt dispersion. This dispersion was further dispersed by a nanomizer (available from Nono-Mizer Corp.) under the pressure of 98.07 MPa at collision. The thus obtained dispersion was comprised of organic silver salt needle particles exhibiting an average longest length of 0.8 $\mu$m and an average shortest length of 0.04 $\mu$m.

Preparation of Reducing Agent Dispersion

To 100 g of 1,1-bis(2-hydroxy-3,5-dimethylphenyl)-3,5,5-trimethylhexane (reducing agent) and 50 g of hydroxypropyl cellulose, 850 g of water was mixedly added to obtain slurry. The slurry was added into a vessel, together with 840 g of Zirconia beads of a mean diameter of 0.5 mm and dispersed by a dispersing machine (1/4G sand grinder mill, available from Imex Corp.) for 5 hrs. to obtain a reducing agent dispersion.

Preparation of Organic Poly-halogenated Compound Dispersion

To 50 g of tribromophenylsulfone (0.127 mol) and 10 g of hydroxypropyl cellulose, 940 g of water was mixedly added to obtain slurry. The slurry was added into a vessel, together with 840 g of Zirconia beads of a mean diameter of 0.5 mm and dispersed by a dispersing machine (1/4G sand grinder mill, available from Imex Corp.) for 5 hrs. to obtain an organic polyhalogen compound dispersion.

Preparation of Silver Halide Emulsion

In 1000 ml water, 22 g of phthalated gelatin and 30 mg of potassium bromide were dissolved. After adjusting the temperature and the pH to 35° C. and 5.0, respectively, 159 ml of an aqueous solution containing 18.6 g silver nitrate and 0.9 g of ammonium nitrate and 159 ml of an equimolar aqueous solution containing potassium bromide were added over a period of 10 minutes by the controlled double-jet method, while the pAg was maintained at 7.7. Then, 476 ml of an aqueous solution containing 55.4 g silver nitrate and 2 g of ammonium nitrate and 370 ml of an aqueous solution containing 1 mol/l potassium bromide and 10 μmol/l dipotassium hexachloroiridate were added over a period of 30 minutes by the controlled double-jet method, while the pAg was maintained at 7.7. Thereafter, 1 g of 4-hydroxy-6-methyl-1,3,3a,7-tetraazaindene was added and the pH was lowered and desalted through coagulation washing. Thereafter, 0.1 g of phenoxyethanol was added and the pH and pAg were adjusted to 5.9 and 8.2. There was obtained cubic silver iodobromide grains (containing 8 mol % core-iodide and average iodide of 2 mol % and having an average grain size of 0.05 μm, a variation coefficient of the projection area equivalent diameter of 8 percent, and the proportion of the {100} face of 85 percent). The thus prepared silver halide grain emulsion was heated to 60° C. and adding sodium thiosulfate of 85 μmol, 2,3,4,5,6-pentafluorophenyldiphenylphosphine selenide of 11 μmol, tellurium compound of 15 μmol, chloroauric acid of 3 μmol and thiocyanic acid of 270 μmol, each per of mol of silver, chemical ripening was conducted for 120 min. Thereafter, cooling to 40° C., the compound of formula (4), macrocyclic compound and sensitizing dye were added and after stirring for 30 min., the emulsion was cooled to 30° C. to obtain 8 kinds of silver halide emulsions.

Tellurium Compound

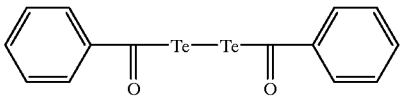

Preparation of Emulsion Layer Coating Solution

To 1350 g of the organic silver salt dispersion were added 140 ml of an aqueous 20 wt % PVA205 solution, 37 ml of an aqueous 10 wt % phthalazine solution, 220 g of the reducing agent dispersion and 61 g of the organic polyhalogen compound. Then, 1100 g of LACSTAR 3307B (available from DAINIPPON INK Co., Ltd., SRR latex containing, as a main component, styrene-butadiene copolymer, having an average particle size of 0.1 to 0.15 and 0.6 wt % equlibrium moisture content of polymer at 25° C. and 60% RH) was added thereto and 120 g of the foregoing silver halide emulsion was added to prepare a coating solution of the emulsion layer. The pH was adjusted to 5.0 with 1 mol/l sulfuric acid solution.

Preparation of Coating Solution of Interlayer of the Emulsion Layer Side

In 900 ml water was dissolved 100 g of MP203 (modified polyvinyl alcohol, available from KURARE Co., Ltd.) and 2 ml of an aqueous 5 wt % solution of di(2-ethylhexyl) sulfosuccinate sodium salt was further added thereto.

Preparation of Protective Layer Coating Solution

Inert gelatin of 145 g was dissolved in 1100 ml of hot water and thereto were added 400 g of 20 wt % polyethyl acrylate latex, 57 ml of 1 mol/l sulfuric acid, 10 ml of an aqueous 5 wt % solution of di(2-ethylhexyl) sulfosuccinate sodium salt and 280 ml of 10 wt % phthalic acid methanol solution to obtain a coating solution of the protective layer of the emulsion layer side.

Preparation of Overcoat Layer Coating Solution

After dissolving inert gelatin of 129 g in 1650 ml of hot water, were added thereto 130 g of gelatin dispersion containing 12 wt % fine polymethyl methacrylate particles (average particle size of 2.5 μm), 65 ml of 1 mol/l sulfuric acid and 20 ml of an aqueous 5 wt % solution of di(2-ethylhexyl) sulfosuccinate sodium salt to obtain solution. Simultaneously with this solution, an aqueous 2 wt % solution of potassium chromium (III) sulfate 12-hydrate was continuously added at a flow rate ratio of 0.3 to obtain a coating solution of an over-coat layer of the emulsion layer side.

Preparation of Backing Layer Coating Solution

Solid base of N,N,N',N'-tetraethylguanidine and 4-carboxysulfonyl-phenylsulfone (molar ratio of 1:2) of 10 g was dispersed in a mixture of 10 g polyvinyl alcohol and 88 g water using 1/16G sand grinder mill (available from Imex Corp.) to obtain an base solution. Basic dye precursor of 2.1 g, 7.9 g of acid material, 0.1 g of an antihalation dye and 10 g of ethyl acetate were mixed and the resulting organic solvent phase was mixed with an aqueous phase of 10 g of polyvinyl alcohol and 80 water to obtain a dye-emulsified dispersing solution (having an average particle size of 2.5 μm). The thus obtained base solution of 39 g was mixed with 26 g of dye and 36 g of an aqueous 10 wt % polyvinyl alcohol solution to obtain a coating solution of a backing layer.

Antihalation dye

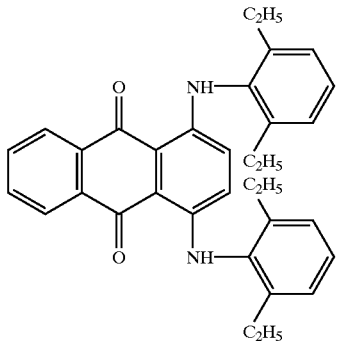

-continued

Basic dye precursor

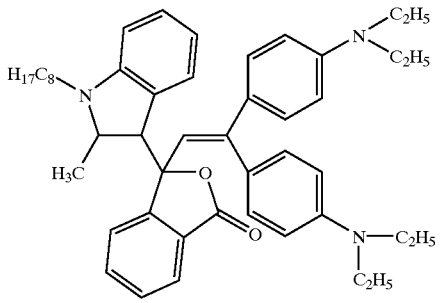

Acid material

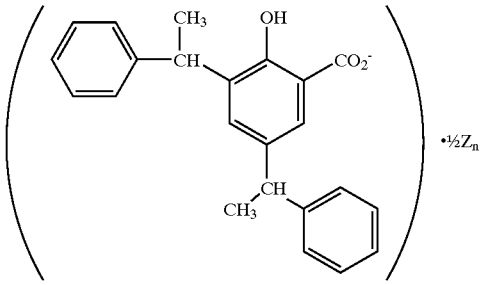

Preparation of Backing Protective Layer Coating Solution

Gelatin of 20 g, 0.6 g of polymethyl methacrylate (average particle size of 7 μm), 0.4 g of sidium dodecybenzenesulfonate and 1 g of X-22-2809 (silicone compound, available from SHINETSU SILICONE Co., Ltd.) were dissolved in 480 g of water to obtain a coating solution of a backing layer-protective layer.

Preparation of Sublayer Coating Solution A

To 200 ml of polyester copolymer dispersion PESRESIN A-515GB (30%, available from TAKAMATSU YUSHI CO., Ltd.), 50 g of fine polystyrene particles (average size of 0.2 μm) and 20 ml of surfactant A (1 wt %) were added and 1000 ml of distilled water was further added thereto to obtain sublayer coating solution A.

Surfactant A

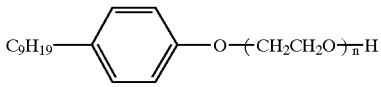

n ≈ 8.5

Preparation of Sublayer Coating Solution B

To 680 ml of distilled water, 200 ml of aqueous 30 wt % styrene-butadiene copolymer dispersion (styrene/butadiene/itaconic acid=47/50/3 by weight) and 0.1 g of fine polystyrene particles (average size of 2.5 μm) were added and 1000 ml of distilled water was further added to obtain sublayer coating solution B.

In 500 ml of distilled water, 10 g of inert gelatin was dissolved and further thereto was added 40 g of aqueous dispersion of fine tin oxide-antimony oxide composite particles (40 wt %) was added and 1000 ml of distilled water was further added thereto to obtain sublayer coating solution C.

Preparation of Subbed Support

One side of 175 μm thick biaxially stretched polyethylene terephthalate support, which was blue-tinted with a blue dye described below, was subjected to corona discharge and was coated with sublayer coating solution A by a bar coater so as to form a wet coating amount of 5 ml/m$^2$ and dried at 180° C. for 5 min. The resulting dry layer thickness was ca. 0.3 μm. Then, the other side of the support was subjected to corona discharge and coated with sublayer coating solution B by a bar coater so as to form a wet coating amount of 5 ml/m$^2$ and dry layer thickness of 0.3 μm, and dried at 180° C. for 5 min. Further thereon, sublayer coating solution C was coated by a bar coater so as to form a wet coating amount of 3 ml/m$^2$ and dry layer thickness of 0.03 μm, and dried at 180° C. for 5 min. to obtain a subbed support.

Blue dye

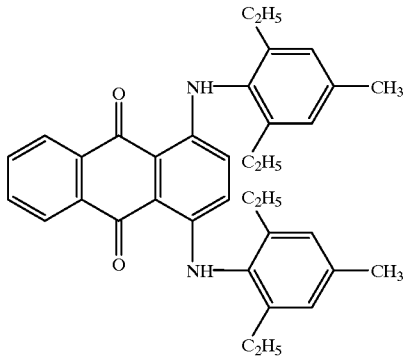

Preparation of Photothermographic Material

On the backing layer side of the subbed support, the foregoing backing layer coating solution, the flow rate of which was adjusted so as to give an optical density of 0.7 at 647 nm and the backing layer-protective layer solution, the flow rate of which was adjusted so as to give a coating amount of 50 g/m$^2$ were simultaneously coated employing a coater as shown in Stephen F. Kistler & Petert M. Schweizer "LIQUID FILM COATING" (CHAPMAN & AMP, published BY Hall, 1997), page 427, FIG. 111b.1. Further, 82 ml/m$^2$ of the emulsion layer coating solution, 6.5 ml/m$^2$ of the interlayer, 12.5 ml/m$^2$ of the protective layer coating solution and 12 ml/m$^2$ of the overcoat layer coating solution were simultaneously coated in this order on the opposite side of the backing layer of the support, and, after passing through the chilled zone, dried with hot air of 30° C. and 40% RH at a blowing rate of 20 m/sec. to obtain photographic material samples, as shown in Table 3. The surface flatness of the thus obtained photothermographic material was 600 sec on the emulsion side and 85 sec. on the backing side (which was determined based on Beck flatness, measured according to OHKEN-SHIKI flatness measurement, described in J. TAPPI paper pulp test method No. 5).

Evaluation

Photographic material samples were allowed to stand at 25° C. and 55% RH for 24 hrs. (Aging-1), then exposed to xenon flush light and thermally developed at 120° C. for 15 sec. from the opposite side of the light sensitive layer, using a thermal processing apparatus provided with a heated panel. Separately, photothermographic material samples were allowed to stand at 55° C. and 60% RH for 7 days (Aging-2) and similarly processed. The thus processed samples were evaluated with respect to sensitivity and fog density (i.e., minimum density). The sensitivity and fog density were the same as defined in Example 2. Results are shown in Table 3.

TABLE 3

| Sample No. | Compound: Formula (4) | Compound: Sensitizing Dye | Compound: Macrocyclic Compound | Photographic Performance: Aging-1 Fog | Aging-1 S | Aging-2 Fog | Aging-2 S |
|---|---|---|---|---|---|---|---|
| 21 | 4-20 | 36 | S-19 | 0.220 | 165 | 0.255 | 150 |
| 22 | 4-22 | 36 | S-19 | 0.215 | 160 | 0.245 | 150 |
| 23 | 4-25 | 36 | S-19 | 0.215 | 170 | 0.240 | 155 |
| 24 | 4-28 | 36 | S-19 | 0.215 | 165 | 0.240 | 150 |
| 25 | 4-20 | 7 | S-19 | 0.215 | 160 | 0.240 | 150 |

As can be seen from Table 3, advantageous effects similar to example 2 were obtained even in aqueous-coated photothermographic materials.

What is claimed is:

1. A photothermographic material comprising a light-sensitive silver halide, an organic silver salt, a reducing agent, a thiuronium salt and a binder, wherein the photothermographic material comprises at least one of compounds represented by the following formula (1), (2) and (3):

formula (1)

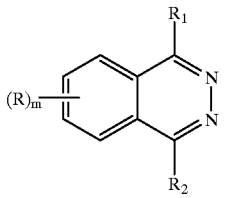

wherein R represents a univalent substituent and m is an integer of 1 to 4, provided that two adjacent Rs may combine with each other to form an aliphatic ring, aromatic ring or heterocyclic ring; $R_1$ and $R_2$ each represent a hydrogen atom or a univalent substituent;

formula (2)

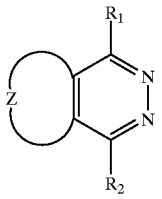

wherein Z represents a non-metallic atom group necessary to form an aromatic heterocyclic 5-membered ring; $R_1$ and $R_2$ each represent a hydrogen atom or a univalent substituent;

formula (3)

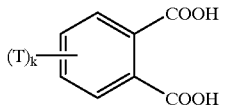

wherein T represents a univalent substituent; k is an integer of 1 to 4 said thiuronium salt is represented by the following formula (4):

formula (4)

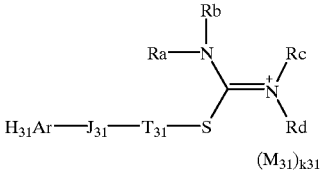

wherein $H_{31}Ar$ represent an aromatic hydrocarbon group or an aromatic heterocyclic group; $T_{31}$ represents a bivalent aliphatic hydrocarbon linkage group or a direct bond; $J_{31}$ represents a bivalent linking group containing at least one of an oxygen atom, sulfur atom and nitrogen atom, or a direct bond; Ra, Rb, Rc and Rd each represent a hydrogen atom, an acyl group, an aliphatic hydrocarbon group, an aryl group or a heterocyclic group, or Ra and Rb, Rc and Rd, Ra and Rc, or Rb and Rd combine with each other to form a nitrogen containing ring; $M_{31}$ represents an ion necessary to neutralize an intramolecular charge; and $k_{31}$ represents the number of the ion necessary to neutralize an intramolecular charge.

2. The photothermographic material of claim 1, wherein the photothermographic material comprises the compound represented by formula (1).

3. The photothermographic material of claim 1, wherein the photothermographic material comprises the compound represented by formula (2).

4. The photothermographic material of claim 1, wherein the photothermographic material comprises the compound represented by formula (3).

5. The photothermographic material of claim 1, wherein the photothermographic material comprises the compound represented by formula (3) and the compound represented by formula (1) or (2).

6. The photothermographic material of claim 1, wherein in formula (2), Z represents a non-metallic atom group necessary to form a thiophene ring, which may be substituted, provided that $R_1$ or $R_2$, and a substituent group on the thiophene ring may combine with each other to form a ring; R, $R_1$ and $R_2$ of formula (1), $R_1$, $R_2$ and a substituent group on the thiophene ring of formula (2), and T of formula (3) each are an alkyl group, an alkenyl group, an alkynyl group, an aryl group, an amino group, an alkoxy group, an aryloxy group, an acyl group, an alkoxycarbonyl group, an aryloxycarbonyl group, an acyloxy group, an acylamino group, an alkoxycarbonylamino group, an aryloxycarbonylamino group, a sulfonylamino group, a sulfamoyl group, a carbamoyl group, an alkylthio group, an arylthio group, a sulfonyl group, a sulfinyl group, a ureido group, a phosphoric acid amide group, hydroxy group, mercapto group, a halogen atom, cyano group, sulfo group, a carboxy group, nitro group, a hydroxamic acid group, a sulfino group, a hydrazine group or a heterocyclic group.

7. The photothermographic material of claim 1, wherein R, $R_1$ and $R_2$ of formula (1), and $R_1$, $R_2$ and a group on the aromatic heterocyclic 5-membered ring of formula (2) each are a hydrogen atom, an alkyl group, an aryl group, an alkoxy group, an aryloxy group, cyano group, a halogen atom, nitro group, or a heterocyclic group.

8. The photothermographic material of claim 1, wherein T of formula (3) is an alkyl group, an alkenyl group, an aryl group, an alkoxy group, an aryloxy group, an acyl group, an acyloxy group, an alkoxycarbonyl group, an acylamino group, an alkoxycarbonylamino group, an aryloxycarbonylamino group, a sulfonylamino group, a sulfamoyl group, a carbamoyl group, a ureido group, a phosphoric amide, hydroxy group, a carboxy group, sulfo group, a sulfino group, a sulfonyl group, a halogen atom, cyano group, nitro group or a heterocyclic group.

9. The photothermographic material of claim 5, wherein R, $R_1$ and $R_2$ of formula (1), and $R_1$, $R_2$ and a group on the aromatic heterocyclic 5-membered ring of formula (2) each are a hydrogen atom, an alkyl group, an aryl group, an alkoxy group, an aryloxy group, cyano group, a halogen atom, nitro group, or a heterocyclic group; T of formula (3) is an alkyl group, an aryl group, an alkoxy group, an aryloxy group, an acyl group, an acylamino group, an alkoxycarbonylamino group, an aryloxycarbonylamino group, a sulfamoyl group, a carbamoyl group, hydroxy group, a sulfonylamino group, a sulfonyl group, a halogen atom, cyano group or nitro group.

10. The photothermographic material of claim 1, wherein the compound represented by formula (1), (2) or (3) is contained in an amount of $10^{-4}$ to 1 mol/Ag mol.

11. The photothermographic material of claim 9, wherein the compound represented by formula (1), (2) or (3) is contained in an amount of $10^{-3}$ to 0.3 mol/Ag mol.

12. The photothermographic material of claim 1, wherein $J_{31}$ is one of the following groups:

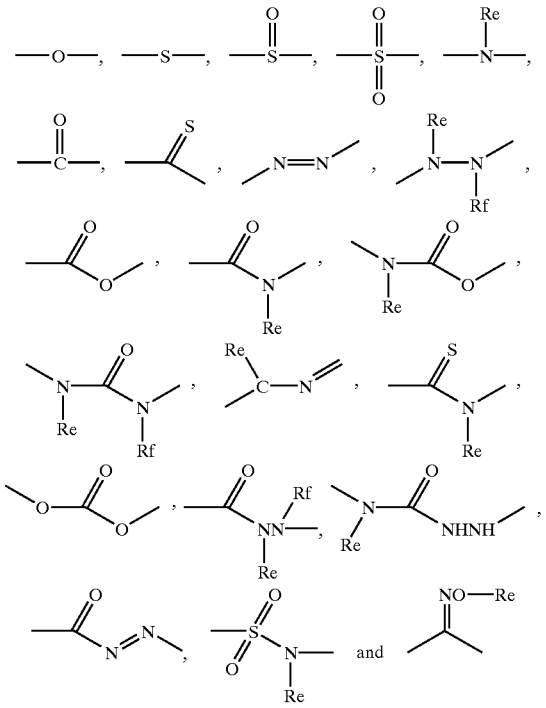

wherein Re and Rf each are the same as defined in Ra through Rd of formula (4); $H_{31}Ar$ is an aryl group having 6 to 30 carbon atoms or a 5- to 10-membered unsaturated heterocyclic group containing at least one of N, O and S; the aliphatic hydrocarbon group represented by Ra, Rb, Rc, Rd, Re and Rf is an alkyl group, an alkenyl group, an alkynyl group, an aryl group having 6 to 20 carbon atoms, a saturated or unsaturated heterocyclic group having 3 to 10 carbon atoms; the acyl group represented by Ra, Rb, Rc, Rd, Re and Rf is an aliphatic or aromatic acyl group having 1 to 12 carbon atoms; the bivalent aliphatic hydrocarbon linkage group represented by $T_{31}$ is an alkylene group, an alkenylene group or an alkynylene group.

13. The photothermographic material of claim 1, wherein the thiuronium salt represented by formula (4) is contained in amount of $10^{-4}$ to 1 mol/Ag mol.

14. The photothermographic material of claim 1, wherein a layer containing the thiuronium salt is formed by coating an aqueous thiuronium solution containing at least 30% by weight water.

15. The photothermographic material of claim 14, wherein said layer contains a polymeric latex.

16. The photothermographic material of claim 14, the photothermographic material comprises an infrared-sensitizing dye or a panchromatic sensitizing dye.

17. The photothermographic material of claim 14, wherein the photothermographic material comprises a compound represented by formula (5):

formula (5)

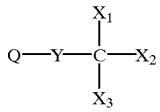

wherein Q represents an aryl group or a heterocyclic group; $X_1$, $X_2$ and $X_3$ each represent a hydrogen atom, a halogen atom, an acyl group, an alkoxycarbonyl group, aryloxycarbonyl group, a sulfonyl group or an aryl group, provided that at least one of $X_1$, $X_2$ and $X_3$ is a halogen atom; and Y represents —C(=O)—, —SO— or —$SO_2$—.

18. The photothermographic material of claim 1, wherein the photothermographic material comprises a heteroatom containing macrocyclic compound.

19. The photothermographic material of claim 18, wherein the photothermographic material comprises a sensitizing dye exhibiting a sensitivity maximum at a wavelength of not less than 600 nm.

20. The photothermographic material of claim 19, wherein the macrocyclic compound is a nine- or more membered ring compound containing a heteroatom selected from the group consisting of a nitrogen atom, oxygen atom, sulfur atom and selenium atom the macrocyclic compound being contained in an amount of $10^{-4}$ to 1 mol/Ag mol.

21. An image forming method comprising:

exposing a photothermographic material as defined in claim 1 and subjecting the exposed photothermographic material to thermal development to form an image.

* * * * *